US008854346B2

(12) United States Patent
Yamauchi

(10) Patent No.: US 8,854,346 B2
(45) **Date of Patent: *Oct. 7, 2014**

(54) PIXEL CIRCUIT AND DISPLAY DEVICE

(75) Inventor: Yoshimitsu Yamauchi, Osaka (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 218 days.

This patent is subject to a terminal disclaimer.

(21) Appl. No.: 13/504,435

(22) PCT Filed: Jul. 22, 2010

(86) PCT No.: PCT/JP2010/062319

§ 371 (c)(1),
(2), (4) Date: Apr. 26, 2012

(87) PCT Pub. No.: WO2011/055573

PCT Pub. Date: May 12, 2011

(65) Prior Publication Data

US 2012/0218247 A1 Aug. 30, 2012

(30) Foreign Application Priority Data

Nov. 6, 2009 (JP) ..... 2009-255346

(51) Int. Cl.
*G09G 5/00* (2006.01)
*G09G 3/36* (2006.01)

(52) U.S. Cl.
CPC ..... *G09G 3/3648* (2013.01); *G09G 2300/0814* (2013.01); *G09G 3/3659* (2013.01); *G09G 2300/0809* (2013.01); *G09G 3/3655* (2013.01); *G09G 2300/0465* (2013.01); *G09G 2300/0876* (2013.01); *G09G 3/3614* (2013.01); *G09G 2330/021* (2013.01); *G09G 2320/0247* (2013.01); *G09G 2300/0417* (2013.01)
USPC ..... 345/205; 345/211

(58) Field of Classification Search
CPC ..... G09G 2300/0465; G09G 2300/0809; G09G 2300/0814; G09G 2300/0819; G09G 2300/0876; G09G 2300/088; G09G 2300/0885; G09G 2300/089; G09G 2300/0895; G09G 2300/0417; G09G 2320/0247; G09G 2330/021; G09G 3/3659; G09G 3/3648; G09G 3/3655; G09G 3/3614
USPC ..... 345/87, 90, 92, 94, 95, 98, 99, 204, 345/205, 206, 208, 211, 214, 215
See application file for complete search history.

(56) References Cited

U.S. PATENT DOCUMENTS 7,184,006 B2 * 2/2007 Kim ..... 345/76
7,239,309 B2 * 7/2007 Smith et al. ..... 345/207

(Continued)

FOREIGN PATENT DOCUMENTS

JP 61-69283 4/1986
JP 61-74481 4/1986

(Continued)

OTHER PUBLICATIONS

International Search Report and Written Opinion mailed Aug. 17, 2010, directed to International Patent Application No. PCT/JP2010/062319; 12 pages.

*Primary Examiner* — Tom Sheng
(74) *Attorney, Agent, or Firm* — Morrison & Foerster LLP

(57) ABSTRACT

In a display device including a pixel circuit having a transistor with a low electron mobility, low power consumption is realized without decreasing an aperture ratio. An liquid crystal capacitor element (Clc) is formed between a pixel circuit (20) and a counter electrode (80). One ends of the pixel electrode (20), a first switch circuit (22), and a second switch circuit (23) and a first terminal of a second transistor (T2) form an internal node (N1). The other end of the first switch circuit (22) is connected to a source line (SL). The second switch circuit (23) has the other end connected to a voltage supply line (VSL), and is a series circuit of transistors (T1 and T3). A control terminal of the transistor (T1), a second terminal of the transistor (T2), and one end of the boost capacitor element (Cbst) form an output node (N2). The other end of the boost capacitor element (Cbst) and the control terminal of the transistor (T2) are connected to a selecting line (SEL) and a reference line REF, respectively. A control terminal of the transistor (T3) is connected to the selecting line (SEL) through a delay circuit (31).

27 Claims, 46 Drawing Sheets

(56) References Cited

U.S. PATENT DOCUMENTS

| | | | | |
|---|---|---|---|---|
| 7,304,674 | B2 | 12/2007 | Mentzer et al. | |
| 7,692,619 | B2 * | 4/2010 | Shin | 345/100 |
| 8,058,795 | B2 | 11/2011 | Asano | |
| 8,339,531 | B2 * | 12/2012 | Yamauchi | 349/41 |
| 2002/0118150 | A1 * | 8/2002 | Kwon | 345/76 |
| 2004/0066360 | A1 * | 4/2004 | Tobita | 345/87 |
| 2004/0130544 | A1 | 7/2004 | Sun | |
| 2005/0007353 | A1 * | 1/2005 | Smith et al. | 345/204 |
| 2006/0232577 | A1 | 10/2006 | Edwards et al. | |
| 2009/0079684 | A1 | 3/2009 | Watanabe | |
| 2010/0253710 | A1 * | 10/2010 | Rankov et al. | 345/690 |
| 2011/0032232 | A1 * | 2/2011 | Smith | 345/211 |
| 2011/0181561 | A1 * | 7/2011 | Smith | 345/204 |
| 2012/0218246 | A1 * | 8/2012 | Ueda et al. | 345/211 |

FOREIGN PATENT DOCUMENTS

| | | |
|---|---|---|
| JP | 2004-212924 | 7/2004 |
| JP | 2005-18088 | 1/2005 |
| JP | 2006-343563 | 12/2006 |
| JP | 2007-502068 | 2/2007 |
| JP | 2007-334224 | 12/2007 |

* cited by examiner

| | | | |
|---|---|---|---|
| T1(H) | ON | ON | OFF |
| T1(L) | (OFF) | OFF | OFF |
| T2(H) | OFF | OFF | OFF |
| T2(L) | ON | ON | ON |
| T3 | OFF | ON | OFF |
| T4 | OFF | OFF | OFF |

| | | | |
|---|---|---|---|
| T1(H) | ON | ON | OFF |
| T1(L) | (OFF) | OFF | OFF |
| T2(H) | OFF | OFF | OFF |
| T2(L) | ON | ON | ON |
| T3 | OFF | ON | OFF |
| T4 | OFF | OFF | OFF |

| | | | |
|---|---|---|---|
| T1(H) | ON | ON | OFF |
| T1(L) | (OFF) | OFF | OFF |
| T2(H) | OFF | OFF | OFF |
| T2(L) | ON | ON | ON |
| T3 | OFF | ON | OFF |
| T4 | OFF | OFF | OFF |

| | | | |
|---|---|---|---|
| T1(H) | ON | ON | OFF |
| T1(L) | (OFF) | OFF | OFF |
| T2(H) | OFF | OFF | OFF |
| T2(L) | ON | ON | ON |
| T3 | OFF | ON | OFF |
| T4 | OFF | OFF | OFF |

| | | | |
|---|---|---|---|
| T1(H) | ON | ON | OFF |
| T1(L) | (OFF) | OFF | OFF |
| T2(H) | OFF | OFF | OFF |
| T2(L) | ON | ON | ON |
| T3 | OFF | ON | OFF |
| T4 | OFF | OFF | OFF |

| | | | |
|---|---|---|---|
| T1(H) | ON | ON | OFF |
| T1(L) | (OFF) | OFF | OFF |
| T2(H) | OFF | OFF | OFF |
| T2(L) | ON | ON | ON |
| T3 | OFF | ON | OFF |
| T4 | OFF | OFF | OFF |

| | | | |
|---|---|---|---|
| T1(H) | ON | ON | OFF |
| T1(L) | (OFF) | OFF | OFF |
| T2(H) | OFF | OFF | OFF |
| T2(L) | ON | ON | ON |
| T3 | OFF | ON | OFF |
| T4 | OFF | OFF | OFF |

| | | | |
|---|---|---|---|
| T1(H) | ON | ON | OFF |
| T1(L) | (OFF) | OFF | OFF |
| T2(H) | OFF | OFF | OFF |
| T2(L) | ON | ON | ON |
| T3 | OFF | ON | OFF |
| T4 | OFF | OFF | OFF |

PIXEL CIRCUIT AND DISPLAY DEVICE

REFERENCE TO RELATED APPLICATIONS

This application is a National Phase filing under 35 U.S.C. §371 of International Application No. PCT/JP2010/062319 filed on Jul. 22, 2010, and which claims priority to Japanese Patent Application No. 2009-255346 filed on Nov. 6, 2009.

FIELD OF THE INVENTION

The present invention relates to a pixel circuit and a display device including the pixel circuit and, in particular, an active-matrix type display device.

BACKGROUND OF THE INVENTION

In a mobile terminal such as a cellular phone or a mobile game console, a liquid crystal display device is generally used as a display means. Since a cellular phone is driven by a battery, a power consumption is strongly required to be reduced. For this reason, information such as time or a battery life that is required to be always displayed is displayed on a reflective sub-panel. In recent years, on the same main panel, a normal display by a full-color display and a reflective always-on display have been required to be compatible.

FIG. 45 shows an equivalent circuit of a pixel circuit in a general active-matrix type liquid crystal display device. FIG. 46 shows an example of a circuit arrangement of an active-matrix type liquid crystal display device having m×n pixels. Both reference symbols m and n denote integers each of which is 2 or more.

As shown in FIG. 46, switch elements configured by thin film transistors (TFTs) are arranged at intersections between m source lines SL1, SL2, . . . , SLm and n scanning lines GL1, GL2, . . . , GLn. In FIG. 45, the source lines SL1, SL2, . . . , SLm are represented by a source line SL, and, similarly, the scanning lines GL1, GL2, . . . , GLn are represented by a symbol GL.

As shown in FIG. 45, a liquid crystal capacitor element Clc and an auxiliary capacitor element Cs are connected in parallel to each other through a TFT. The liquid crystal capacitor element Clc is configured by a laminated structure in which a liquid crystal layer is formed between a pixel electrode 20 and a counter electrode 80. The counter electrode is also called a common electrode.

FIG. 46 simply shows only a TFT and a pixel electrode (black rectangular portion) in each pixel circuit.

The auxiliary capacitor element Cs has one end (one electrode) connected to the pixel electrode 20 and the other end (other electrode) connected to an auxiliary capacitive line CSL to stabilize a voltage of pixel data held in the pixel electrode 20. The auxiliary capacitor element Cs advantageously suppresses a voltage of pixel data held in a pixel electrode from varying due to a leakage current in the TFT, a variation in electric capacity of the liquid crystal capacitor element Clc between a black display and a white display caused by dielectric anisotropy held by liquid crystal molecules, a variation in voltage through a parasitic capacity between a pixel electrode and a peripheral wire, and the like. Voltages of the scanning lines are sequentially controlled to turn on TFTs connected to one scanning line, and voltages of pixel data supplied to source lines are written in corresponding pixel electrodes, respectively, in units of scanning lines.

In a normal display by a full-color display, even though display contents are a still image, the same display contents are repeatedly written in the same pixel for each frame. In this manner, the voltages of the pixel data held in the pixel electrodes are updated to minimize a variation in voltage of the pixel data and to secure a display of a high-quality still image.

A power consumption to drive a liquid crystal display device is almost controlled by a power consumption to drive a source line by a source driver, and is almost expressed by a relational expression represented by the following numerical expression 1. In numerical expression 1, reference symbol P denotes a power consumption; f, a refresh rate (the number of times of a refresh action of one frame per unit time); C, a load capacity driven by a source driver; V, a drive voltage of the source driver; n, the number of scanning lines; and m, the number of source lines. In this case, the refresh action is an operation that applies a voltage to a pixel electrode through a source line while keeping display contents.

$$P \propto f \cdot C \cdot V^2 \cdot n \cdot m \qquad \text{(Numerical Expression 1)}$$

In the always-on display, since the display contents are a still image, the voltage of the pixel data need not be always updated for each frame. For this reason, in order to further reduce the power consumption of the liquid crystal display device, a refresh frequency in the always-on display state is lowered. However, when the refresh frequency is lowered, a pixel data voltage held in a pixel electrode varies by a leakage current of a TFT. The variation in voltage causes a variation in display luminance (transmittance of liquid crystal) of each pixel and becomes to be observed as flickers. Since an average potential in each frame period also decreases, deterioration of display quality such as insufficient contrast may be probably caused.

In this case, as a method of simultaneously realizing a solution of a problem of deterioration of display quality caused by a decrease in refresh frequency and a reduction in power consumption in an always-on display of a still image such as a display of a battery life or time, for example, a configuration described in the following Patent Document 1 is disclosed. In the configuration disclosed in Patent Document 1, liquid crystal displays by both transmissive and reflective functions are possible. Furthermore, a memory unit is arranged in a pixel circuit in a pixel area in which a reflective liquid crystal display can be obtained. The memory unit holds information to be displayed in a reflective liquid crystal display unit as a voltage signal. In a reflective liquid crystal display state, a voltage held in the memory unit of the pixel circuit is read out to display information corresponding to the voltage.

In Patent Document 1, the memory unit is configured by an SRAM, and the voltage signal is statically held. For this reason, a refresh action is not required, and maintenance of display quality and a reduction in power consumption can be simultaneously realized.

[Patent Document 1] Unexamined Japanese Patent Publication No. 2007-334224

SUMMARY OF THE INVENTION

However, when the above configuration is applied to a liquid crystal display device used in a cellular phone or the like, in addition to an auxiliary capacitor element to hold a voltage of each pixel data serving as analog information in a normal operation, a memory unit to store the pixel data needs to be arranged for each pixel or each pixel group. In this manner, since the numbers of elements and signal lines to be formed on an array substrate (active matrix substrate) that configures the display unit in the liquid crystal display device increase, an aperture ratio in a transmission mode decreases. When a polarity-inverted drive circuit to AC-drive a liquid crystal is arranged together with the memory unit, the aperture ratio further decreases. In this manner, when the aperture ratio decreases due to the increase in number of elements or signal lines, a luminance of a display image decreases in a normal display mode.

In recent years, a computer that is slightly smaller than a notebook computer and is called a so-called netbook computer has remarkably prevailed. Since such a small computer has a liquid crystal display area larger than that of a cellular phone, it is considered that amorphous silicon (a-Si) has been used as a mainstream TFT substrate.

However, the amorphous silicon has a mobility that is thousand times lower than that of polysilicon used in a liquid crystal substrate for a cellular phone, and a response speed lower than that of the polysilicon. For this reason, when a transistor element is formed on an amorphous silicon substrate, a timing at which a voltage is applied to a signal line connected to a control terminal of the transistor element is different from a timing at which the transistor element is turned on. This may influence a pixel voltage after writing.

The present invention has been made in consideration of the above problems and, it is an object of the present invention to provide a pixel circuit and a display device that can prevent deterioration of a liquid crystal and display quality with a low power consumption without causing a decrease in aperture ratio. In particular, it is an object to provide a pixel circuit and a display device in which, also when a pixel circuit is configured on an amorphous silicon substrate having a small mobility, the pixel voltage obtained after writing can be maintained without influencing the pixel voltage.

In order to achieve the above object, the pixel circuit according to the present invention is characterized by employing the following configuration.

A pixel circuit according to the present invention includes:

a display element unit including a unit display element;

an internal node that is a part of the display element unit and holds a voltage of pixel data applied to the display element unit;

a first switch circuit that transfers the voltage of the pixel data supplied from a data signal line to the internal node through at least a predetermined switch element;

a second switch circuit that transfers the voltage supplied from the data signal line to the internal node without passing through the predetermined switch element; and a control circuit that holds a predetermined voltage depending on the voltage of the pixel data held by the internal node at one end of a first capacitor element and controls on/off of the second switch circuit.

The pixel circuit includes first to third transistor elements having a first terminal, a second terminal, and a control terminal that controls conduction between the first and second terminals. Of the transistor elements, the first and third transistor elements are arranged in the second switch circuit and the second transistor element is arranged in the control circuit. The second switch circuit is configured by a series circuit having the first transistor element and the third transistor element, and the control circuit is configured by a series circuit having the second transistor element and the first capacitor element.

The first switch circuit has one end connected to a data signal line, and the second switch circuit has one end connected to a voltage supply line. Both the switch circuits have the other terminals connected to the internal node. The first terminal of the second transistor element is also connected to the internal node.

The control terminal of the first transistor element, the second terminal of the second transistor element, one end of the first capacitor element are connected to each other to form an output node of the control circuit. The control terminal of the second transistor element is connected to a first control line, and the control terminal of the third transistor element is connected to a second control line through a delay circuit. Furthermore, the other end of the first capacitor element, i.e., a terminal which does not form the output node is connected to the second control line without passing through the delay circuit.

As another configuration, the other terminal of the first capacitor element can be configured to be connected to a third control line without passing through the delay circuit.

In this case, in the delay circuit, first and second delay transistor elements each having a first terminal, a second terminal, and a control terminal that controls conduction between the first and second terminals are arranged, the first delay transistor element has the first terminal connected to the control terminal of the third transistor element, and the second terminal and the control terminal connected to the second control line, and the second delay transistor element has the first terminal connected to the control terminal of the third transistor element, the second terminal connected to the second control line, and the control terminal connected to the first control line.

As another configuration of the delay circuit, first and second delay transistor elements each having a first terminal, a second terminal, and a control terminal that controls conduction between the first and second terminals and a delay capacitor element are arranged, the first delay transistor element has the first terminal connected to the control terminal of the third transistor element and the second terminal connected to the second control line, the second delay transistor element has the first terminal and the control terminal connected to the first control line, and the delay capacitor element has one end connected to the second control line and the other end connected to the control terminal of the first delay transistor element and the second terminal of the second delay transistor element.

A voltage supply line can also be used as an independent signal line or can also be used as a first control line or a data signal line.

In addition to the configuration, a second capacitor element having one end connected to the internal node and having the other end connected to a fourth control line or a predetermined fixed voltage line may be further arranged. At this time, the fourth control line may also serve as the voltage supply line.

The predetermined switch element is configured by a fourth transistor element having a first terminal, a second terminal, and a control terminal that controls conduction between the first and second terminals, and the fourth transistor element also preferably has the first terminal connected to the internal node, the second terminal connected to the data signal line or the first terminal of the third transistor element, and the control terminal connected to a scanning signal line.

The first switch circuit also preferably has a configuration that does not include a switch element except for the predetermined switch element.

The first switch circuit is preferably configured by a series circuit of the third transistor element in the second switch circuit and the predetermined switch element or a series circuit of a fifth transistor having a control terminal connected to the control terminal of the third transistor element in the second switch circuit and the predetermined switch element.

When the other end of the first capacitor element in the pixel circuit is connected to the second control line without passing through the delay circuit, a display device according to the present invention includes a pixel circuit array in which a plurality of pixel circuits are arranged in each of a row direction and a column direction, wherein the data signal line is arranged for each of the columns one by one, the pixel circuits arranged in the same column have one ends of the first switch circuits connected to the common data signal line, the pixel circuits arranged in the same row or the same column have control terminals of the second transistor elements connected to the common first control line, the pixel circuits arranged in the same row or the same column have control terminals of the third transistor elements connected to the common second control line through the delay circuits, the pixel circuits arranged in the same row or the same column have the other ends of the first capacitor elements connected to the common second control line without passing through the delay circuits, a data signal line drive circuit that independently drives the data signal lines and a control line drive circuit that independently drives the first and second control lines are provided, and when the first control line also serves as the voltage supply line or when the voltage supply line is an independent wire, the control line drive circuit drives the voltage supply line, and when the data signal line also serves as the voltage supply line, the data signal line drive circuit drives the voltage supply line.

When the other end of the first capacitor element in the pixel circuit is connected to the third control line without passing through the delay circuit, in place of the above configuration, the control terminals of the third transistor elements of the pixel circuits arranged in the same row or the same column are connected to the common second control line through the delay circuit.

It can be assumed that at least the second transistor element is configured by an amorphous TFT. At this time, the first and third transistor elements other than the second transistor element may also be configured by amorphous TFTs. Furthermore, when the delay circuit has a delay transistor element therein, the delay transistor element may also be configured by an amorphous TFT.

The display device according to the present invention has a pixel circuit array in which a plurality of pixel circuits are arranged in each of a row direction and a column direction, wherein the pixel circuit includes:

a display element unit including a unit display element;

an internal node that is a part of the display element unit and holds a voltage of pixel data applied to the display element unit;

a first switch circuit that transfers the voltage of the pixel data supplied from a data signal line to the internal node through at least a predetermined switch element;

a second switch circuit that transfers a voltage supplied to a predetermined voltage supply line to the internal node without passing through the predetermined switch element; and a control circuit that holds a predetermined voltage depending on the voltage of the pixel data held by the internal node at one end of a first capacitor element and controls on/off of the second switch circuit, the second switch circuit includes a first transistor element and a third transistor element, the control circuit includes a second transistor element, and each of the first to third transistor elements has a first terminal, a second terminal, and a control terminal that controls conduction between the first and second terminals, the second switch circuit is configured by a series circuit of the first transistor element and the third transistor element, the control circuit is configured by a series circuit of the second transistor element and the first capacitor element, one end of the first switch circuit is connected to the data signal line, one end of the second switch circuit is connected to the voltage supply line, the other ends of the first and second switch circuits and the first terminal of the second transistor element are connected to the internal node, the control terminal of the first transistor element, the second terminal of the second transistor element, and one end of the first capacitor element are connected to each other, the control terminal of the second transistor element is connected to a first control line, the control terminal of the third transistor element is connected to a second control line, the other end of the first capacitor element is connected to a third control line, the data signal line is arranged for each of the columns one by one, the pixel circuits arranged in the same column have one ends of the first switch circuits connected to the common data signal line, the pixel circuits arranged in the same row or the same column have the control terminals of the second transistor elements connected to the common first control line, the pixel circuits arranged in the same row or the same column have the control terminals of the third transistor elements connected to the common second control line, the pixel circuits arranged in the same row or the same column have the other ends of the first capacitor elements connected to the common third control line, a data signal line drive circuit that independently drives the data signal lines and a control line drive circuit that independently drives the first to third control lines are arranged, when the first control line also serves as the voltage supply line or when the voltage supply line is an independent wire, the control line drive circuit drives the voltage supply line, and when the data signal line also serves as the voltage supply line, the data signal line drive circuit drives the voltage supply line, and after a predetermined delay time has elapsed after the control line drive circuit causes a variation in potential in the third control line, the control line drive circuit can cause a variation in potential having the same polarity in the second control line.

The display device according to the present invention has, in addition to the above configuration, a configuration in which the first switch circuit does not include a switch element except for the predetermined switch element, the predetermined switch element is a fourth transistor element having a first terminal, a second terminal, and a control terminal that controls conduction between the first and second terminals, and the control terminal is connected to a scanning signal line, the scanning signal line is arranged for each of the rows one by one, and the pixel circuits arranged in the same row are connected to the common scanning signal line, and a scanning signal line drive circuit that independently drives the scanning signal lines is arranged.

When the voltage supply line is an independent wire, the pixel circuits arranged in the same row or the same column may also have one ends of the second switch circuits connected to the common voltage supply line.

According to the present invention, there is provided a display device, in a self-refresh action for compensating for variations in voltage of the internal nodes at the same time by operating the second switch circuits and the control circuits in the plurality of pixel circuits, the scanning signal line drive circuit applies a predetermined voltage to the scanning signal lines connected to all the pixel circuits in the pixel circuit array to turn off the fourth transistor elements, the control line drive circuit applies a predetermined voltage to the first control line so that when a voltage state of binary pixel data held by the internal node is in a first voltage state, a current flowing from one end of the first capacitor element to the internal node is blocked by the second transistor element, and when the voltage state is in a second voltage state, the second transistor element is turned on, and applies a voltage pulse having a predetermined voltage amplitude to the second control line to give a change in voltage by a capacitive coupling through the first capacitor element to one end of the first capacitor element so that when the voltage of the internal node is in the first voltage state, the change in voltage is not suppressed and the first transistor element is turned on, and when the voltage of the internal node is in the second voltage state, the change in voltage is suppressed and the first transistor element is turned off, and the voltage pulse is given to the control terminal of the third transistor element through the delay circuit to turn on the third transistor element, when the voltage supply line also serves as the first control line or an independent signal line, the control line drive circuit supplies the voltage of the pixel data in the first voltage state to all the voltage supply lines connected to the plurality of pixel circuits targeted to the self-refresh action, and when the voltage supply line also serves as the data signal line, the data signal line drive circuit supplies the voltage of the pixel data in the first voltage state to all the voltage supply lines connected to the plurality of pixel circuits targeted to the self-refresh action.

When the control terminal of the third transistor element is connected to the third control line through a delay circuit, in place of the above configuration, it is preferable that the control line drive circuit applies a voltage pulse having a predetermined voltage amplitude to the second control line and the third control line to give a change in voltage by a capacitive coupling through the first capacitor element to one end of the first capacitor element, so that when the voltage of the internal node is in the first voltage state, the change in voltage is not suppressed and the first transistor element is turned on, and when the voltage of the internal node is in the second voltage state, the change in voltage is suppressed and the first transistor element is turned off, and the voltage pulse is given to the control terminal of the third transistor element through the delay circuit and the third transistor element is turned on.

When the control terminal of the third transistor element is connected to the third control line without passing through a delay circuit, in place of the above configuration, it is preferable that the control line drive circuit applies a voltage pulse having a predetermined voltage amplitude to the second control line to give a change in voltage by a capacitive coupling through the first capacitor element to one end of the first capacitor element, so that when the voltage of the internal node is in the first voltage state, the change in voltage is not suppressed and the first transistor element is turned on, and when the voltage of the internal node is in the second voltage state, the change in voltage is suppressed and the first transistor element is turned off, and, after a predetermined delay time has elapsed after the voltage pulse is applied to the second control line, the control line drive circuit applies a voltage pulse having a predetermined voltage amplitude to the third control line to give the voltage pulse to the control terminal of the third transistor element so as to turn on the third transistor element.

When the control terminal of the third transistor element is connected to the second control line through the delay circuit, as another characteristic feature, the display device according to the present invention shifts to a standby state immediately after the self-refresh action is ended, and, in the standby state, the control line drive circuit ends the application of the voltage pulse to the second control line to turn off the third transistor element.

When the control terminal of the third transistor element is connected to the third control line through the delay circuit or without passing through the delay circuit, the display device according to the present invention shifts to a standby state immediately after the self-refresh action is ended, and, in the standby state, the control line drive circuit ends the application of the voltage pulses to the second control line and the third control line to turn off the third transistor element.

In addition to the above characteristic features, the self-refresh action is preferably repeated through the standby state a period of which is 10 times longer than the period of the self-refresh action.

In the standby state, the data signal line drive circuit preferably applies a fixed voltage to the data signal line. At this time, as the fixed voltage, a voltage in the second voltage state can be applied.

In the configuration in which the control terminal of the third transistor element is connected to the second control line through the delay circuit and the first switch circuit configuring the pixel circuit does not include a switch element except for the fourth transistor element, it is preferable that the plurality of pixel circuits targeted by the self-refresh action are divided into a plurality of sections each having one or more columns, at least the second control lines are arranged so as to be driven for each of the sections, and the control line drive circuit, with respect to the section that is not targeted by the self-refresh action, applies a predetermined voltage to the second control lines to turn off the third transistor element or does not apply the voltage pulse to the second control line or the third control line connected to the other terminal of the first capacitor element, and sequentially switches the sections targeted by the self-refresh action to separately execute the self-refresh action for each of the sections.

On the other hand, in a configuration in which the control terminal of the third transistor element is connected to the third control line through the delay circuit or without passing through the delay circuit, it is preferable that at least the second control lines and the third control lines are arranged so as to be driven for each of the sections, and the control line drive circuit, with respect to the section that is not targeted by the self-refresh action, does not apply the voltage pulses to the second control line and the third control line, sequentially switches the sections targeted by the self-refresh action to separately execute the self-refresh action for each of the sections.

The pixel circuit includes a second capacitor element having one end connected to the internal node and the other end connected to a fourth control line, the pixel circuits arranged in the same row or the same column have the other ends of the second capacitor elements connected to the common fourth control line, the control line drive circuit independently drives the fourth control lines, and, when the voltage supply line also serves as the fourth control line, the control line drive circuit supplies the voltage of the pixel data in the first voltage state to all the voltage supply lines connected to the plurality of pixel circuits targeted by the self-refresh action.

The display device according to the present invention can include pixel circuits mounted on an amorphous silicon substrate.

With the configuration of the present invention, in addition to a normal writing action, an action (self-refresh action) that returns an absolute value of a voltage across both the terminals of the display element unit to a value in the immediately previous writing action without performing a writing action can be executed. In particular, according to the present invention, when a pulse voltage is applied once, only a pixel circuit having an internal node to be returned to a voltage state of a target gradation level among the plurality of pixel circuits can be automatically refreshed, and a self-refresh action can be performed in a situation in which voltage states at multi-value levels are held in the internal nodes.

When a plurality of pixel circuits are arranged, a normal writing action is generally executed for each row. For this reason, at the maximum, a driver circuit needs to be driven the number of times which is equal to the number of rows of the arranged pixel circuits. In contrast to this, according to the pixel circuit of the present invention, a self-refresh action is performed to make it possible to execute a refresh action to the plurality of arranged pixels at once for each of the held voltage states. For this reason, the number of times of driving of a driver circuit required from the start of the refresh action to the end thereof can be greatly reduced to make it possible to realize a low power consumption. Since a memory unit such as an SRAM need not be additionally arranged in the pixel circuit, an aperture ratio does not decrease unlike in the conventional art.

In particular, according to the configuration of the present invention, in the self-refresh action, on/off-control of the first transistor element and the third transistor element that configure the second switch circuit can be delayed and executed on purpose. This causes the following effect.

In the self-refresh action, a voltage is applied to the control terminal of the second transistor element so that when the internal node is in the first voltage state, a current flowing from one end of the first capacitor element to the internal node is blocked, and when the internal node is in the second voltage state, the second transistor element is turned on. In the above situation, a voltage pulse having a predetermined voltage amplitude is applied to the second control line to give a change in voltage by a capacitive coupling through the first capacitor element to one end of the first capacitor element, thereby giving a variation in potential to a node (output node of a control circuit) to which the control terminal of the first transistor element is connected.

In this case, when the internal node is in the first voltage state, the second transistor element blocks a current flowing from one end of the first capacitor element to the internal node. For this reason, when a pulse voltage is given to the second control line, a variation in potential depending on a rate of the capacity of the first capacitor element to a total of capacities being parasitic in the output node of the control circuit is reflected on the output node, thereby largely varying the potential of the same node. As a result, the first transistor element is turned on. On the other hand, when the internal node is in the second voltage state, the second transistor element is turned on. For this reason, even though a pulse voltage is given to the second control line, only a variation in potential depending on a ratio of a capacitance of the first capacitor element to a sum of a capacity being parasitic in the output node and a capacity being parasitic in the internal node is given to the output node, and the variation in potential of the output node considerably decreases in comparison with the case in the first voltage state. More specifically, the variation in potential caused by the pulse voltage is hardly reflected on the output node, and the first transistor element is turned off.

In fact, even though the internal node is in the second voltage state, the pulse voltage given to the second control line raises a potential at one end of the first capacitor element, i.e., a potential at the output node of the control circuit for a moment. However, even though the potential of the output node is raised, a current flowing toward the internal node through the second transistor element in an on state instantaneously flows, and both the nodes have the same potentials. For this reason, as a result, the potential of the output node hardly changes.

However, when an electronic mobility of the second transistor element is low, a predetermined period of time is required from when the potential of the output node is raised to when a current flows from the output node to the internal node and the potentials of both the nodes become equal to each other. Meanwhile, the output node is set to a high-potential state due to an influence of a pulse voltage given to the second control line. Thus, when a high potential is given to the control terminal of the third transistor element meanwhile, both the third transistor element and the first transistor element are turned on to turn on the second switch circuit. As a result, a voltage is given from the voltage supply line to the internal node through the second switch circuit, the potential of the internal node, i.e., a pixel potential disadvantageously changes.

As in the present invention, when the control terminal of the third transistor element is connected to the second control line or the third control line through the delay circuit, a period from when a pulse voltage is applied to the second control line to when the voltage is given to the control terminal of the third transistor element can be elongated. In this manner, even though the internal node is in the second voltage state, after a standby state is set until the potential of the output node is equal to the potential of the internal node, a voltage is given to the control terminal of the third transistor element, so that the third transistor element can be turned off, i.e., the second switch circuit can be turned off while the output node has a high potential. Thus, a voltage is not supplied from the voltage supply line to the internal node through the second switch circuit.

The same effect as described above can also be realized such that the control terminal of the third transistor element is connected to the third control line, and voltage application is performed to the third control line after a predetermined delay time has lapsed after the pulse voltage is applied to a second connection line.

DETAILED DESCRIPTION OF THE INVENTION

Figure 45:
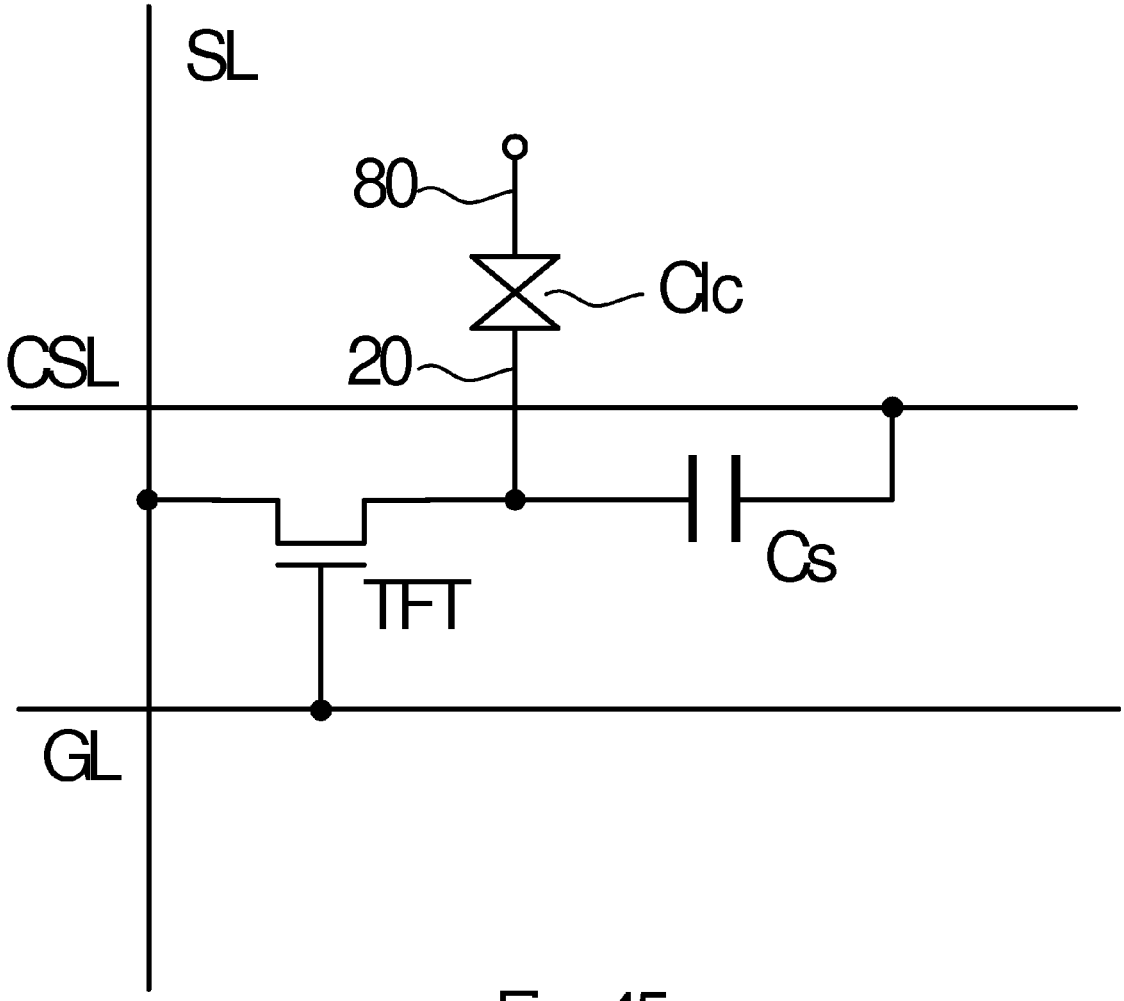
FIG. 45 is an equivalent circuit diagram of a pixel circuit in a general active-matrix type liquid crystal display device.
Figure 46:
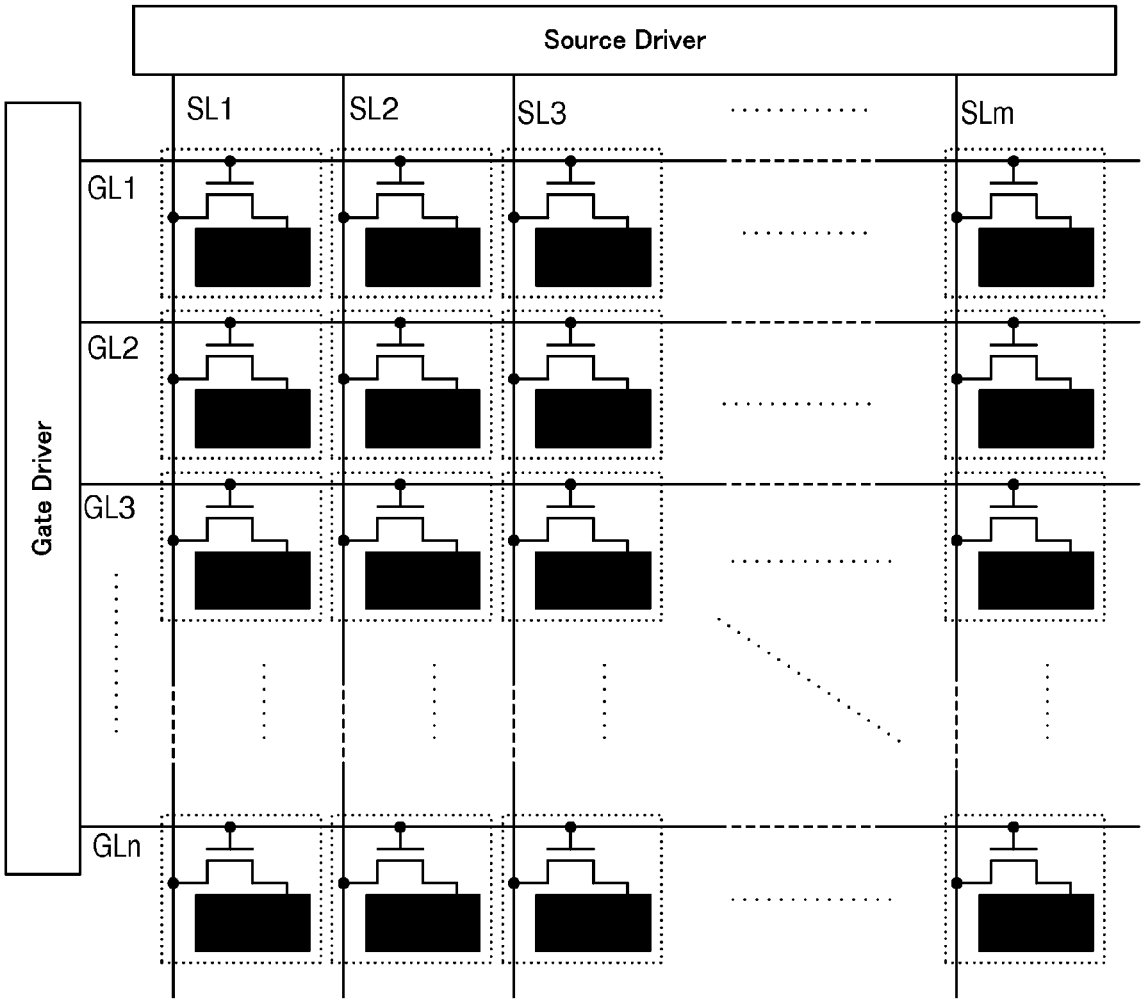
FIG. 46 is a block diagram showing a circuit arrangement of an active-matrix type liquid crystal display device having m×n pixels.

Embodiments of a pixel circuit and a display device of the present invention will be described below with reference to the accompanying drawings. The same reference numerals as in FIGS. 45 and 46 denote the same constituent elements in the embodiments.

[First Embodiment]

In the first embodiment, configurations of a display device of the present invention (to be simply referred to as a "display device" hereinafter) and a pixel circuit of the present invention (to be simply referred to as a "pixel circuit" hereinafter) will be described below.

<<Display Device>>

Figure 1:
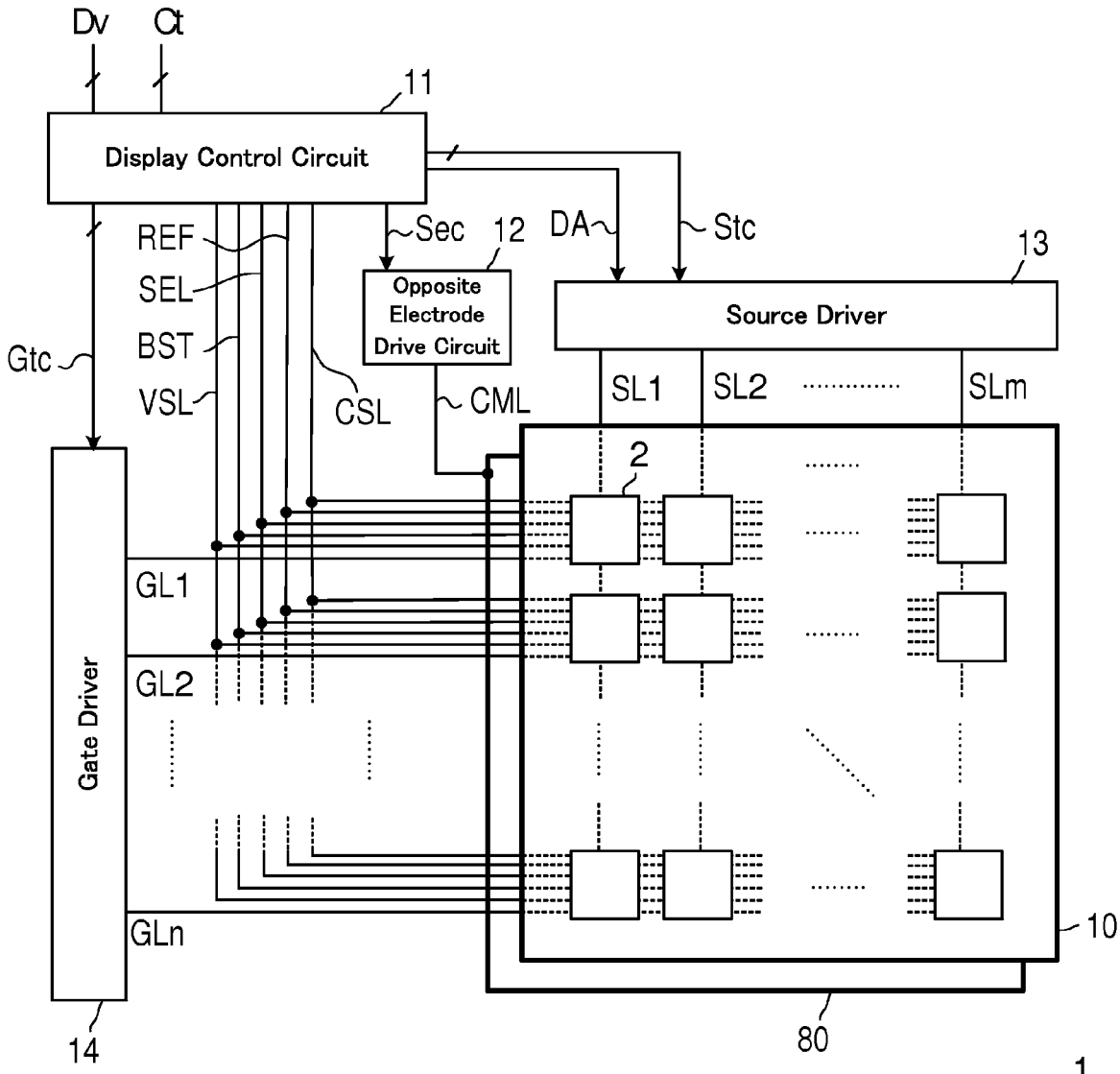
FIG. 1 is a block diagram showing an example of a schematic configuration of a display device according to the present invention.

FIG. 1 shows a schematic configuration of a display device 1. The display device 1 includes an active matrix substrate 10, a counter electrode 80, a display control circuit 11, a counter electrode drive circuit 12, a source driver 13, a gate driver 14, and various signal lines (will be described later). On the active matrix substrate 10, a plurality of pixel circuits 2 are arranged in row and column directions to form a pixel circuit array.

In FIG. 1, to avoid the drawings from being complex, the pixel circuits 2 are displayed as a block. In order to clarify that the various signal lines are formed on the active matrix substrate 10, for descriptive convenience, the active matrix substrate 10 is shown on the upper side of the counter electrode 80.

In the embodiment, the display device 1 has a configuration in which the same pixel circuits 2 are used to make it possible to perform screen display in two display modes including a normal display mode and an always-on display mode. The normal display mode is a display mode that displays a moving image or a still image in full color and uses a transmissive liquid crystal display using a back light. On the other hand, the always-on display mode of the embodiment is a display mode that performs two-tone (black and white) display in units of pixel circuits and allocates the three adjacent pixel circuits 2 to three primary colors (R, G, and B), respectively, to display eight colors. Furthermore, in the always-on display mode, a plurality of sets of three adjacent pixel circuits can also be combined to each other to increase the number of display colors by area coverage modulation. The always-on display mode according to the embodiment is a technique that can be used in transmissive liquid crystal display and reflective liquid crystal display.

In the following explanation, for descriptive convenience, a minimum display unit corresponding to one pixel circuit 2 is called a "pixel", and "pixel data" written in each of the pixel circuits serves as tone data of each color in color display in three primary colors (R, G, and B). When color display is to be performed by using, in addition to the three primary colors, black and white luminance data, the luminance data is also included in pixel data.

Figure 2:
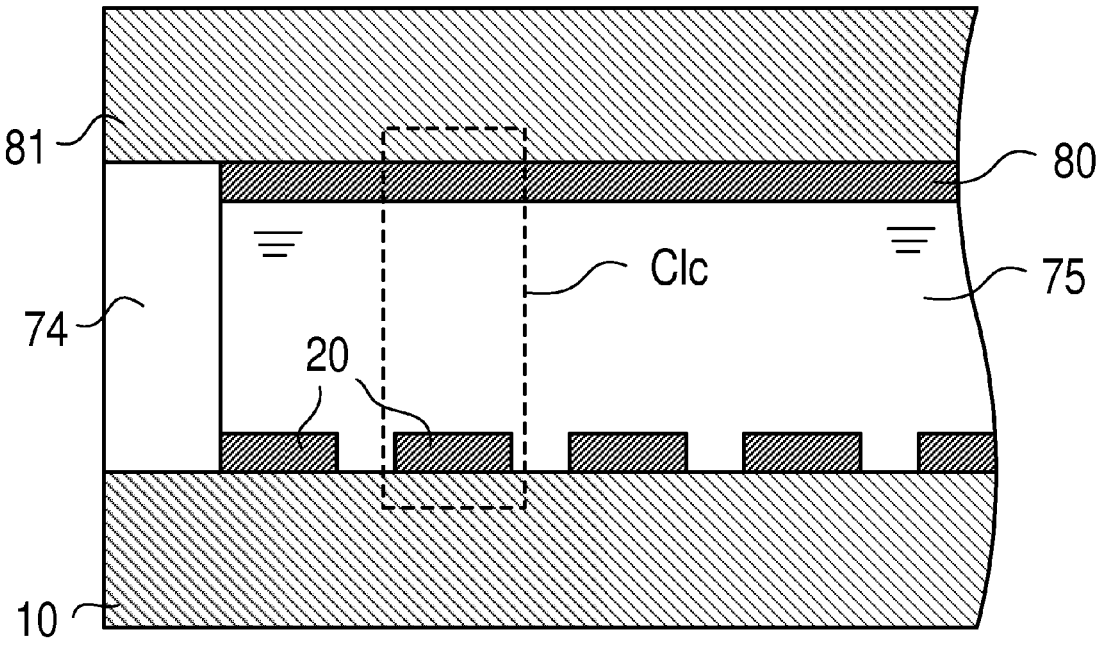
FIG. 2 is a schematic structural diagram of a partial section of a liquid crystal display device.

FIG. 2 is a schematic sectional structural diagram showing a relation between the active matrix substrate 10 and the counter electrode 80, and shows a structure of a display element unit 21 (see FIG. 6) serving as a constituent element of the pixel circuit 2. The active matrix substrate 10 is a light-transmitting transparent substrate made of, for example, glass or plastic.

As illustrated in FIG. 1, the pixel circuits 2 including signal lines are formed on the active matrix substrate 10. In FIG. 2, the pixel electrode 20 is illustrated as a representative of a constituent element of the pixel circuit 2. The pixel electrode 20 is made of a light-transmitting transparent conductive material, for example, ITO (indium tin oxide).

A light-transmitting counter substrate 81 is arranged so as to face the active matrix substrate 10, and a liquid crystal layer 75 is held in a gap between both the substrates. Deflection plates (not shown) are stuck to outer surfaces of both the substrates.

The liquid crystal layer 75 is sealed by a seal member 74 at the peripheral portions of both the substrates. On the counter substrate 81, the counter electrode 80 made of a light-transmitting transparent conductive material such as ITO is formed so as to face the pixel electrode 20. The counter electrode 80 is formed as a single film so as to spread on an almost entire surface of the counter substrate 81. In this case, a unit liquid crystal display element Clc (see FIG. 6) is formed by one pixel electrode 20, the counter electrode 80, and the liquid crystal layer 75 held therebetween.

A back light device (not shown) is arranged on a rear surface side of the active matrix substrate 10 to make it possible to emit light oriented from the active matrix substrate 10 to the counter substrate 81.

As shown in FIG. 1, a plurality of signal lines are formed in vertical and horizontal directions on the active matrix substrate 10. The plurality of pixel circuits 2 are formed in the form of a matrix at positions where m source lines (SL1, SL2, . . . , SLm) extending in the vertical direction (column direction) and n gate lines (GL1, GL2, . . . , GLn) extending in the horizontal direction (row direction) intersect with each other. Both reference symbols m and n denote natural numbers that are 2 or more. Each of the source lines is represented by a "source line SL", and each of the gate lines is represented by a "gate line GL".

In this case, the source line SL corresponds to a "data signal line", and the gate line GL corresponds to a "scanning signal lines". The source driver 13 corresponds to a "data signal line drive circuit", the gate driver 14 corresponds to a "scanning signal line drive circuit", the counter electrode drive circuit 12 corresponds to a "counter electrode voltage supply circuit", and a part of the display control circuit 11 corresponds to a "control line drive circuit".

In FIG. 1, the display control circuit 11 and the counter electrode drive circuit 12 are shown to be independent of the source driver 13 and the gate driver 14. However, in the drivers, the display control circuit 11 and the counter electrode drive circuit 12 may be included.

In the embodiment, as signal lines that drive the pixel circuits 2, in addition to the source line SL and the gate line GL described above, a reference line REF, a selecting line SEL, an auxiliary capacitive line CSL, a voltage supply line VSL, and a boost line BST are included.

Figure 3:
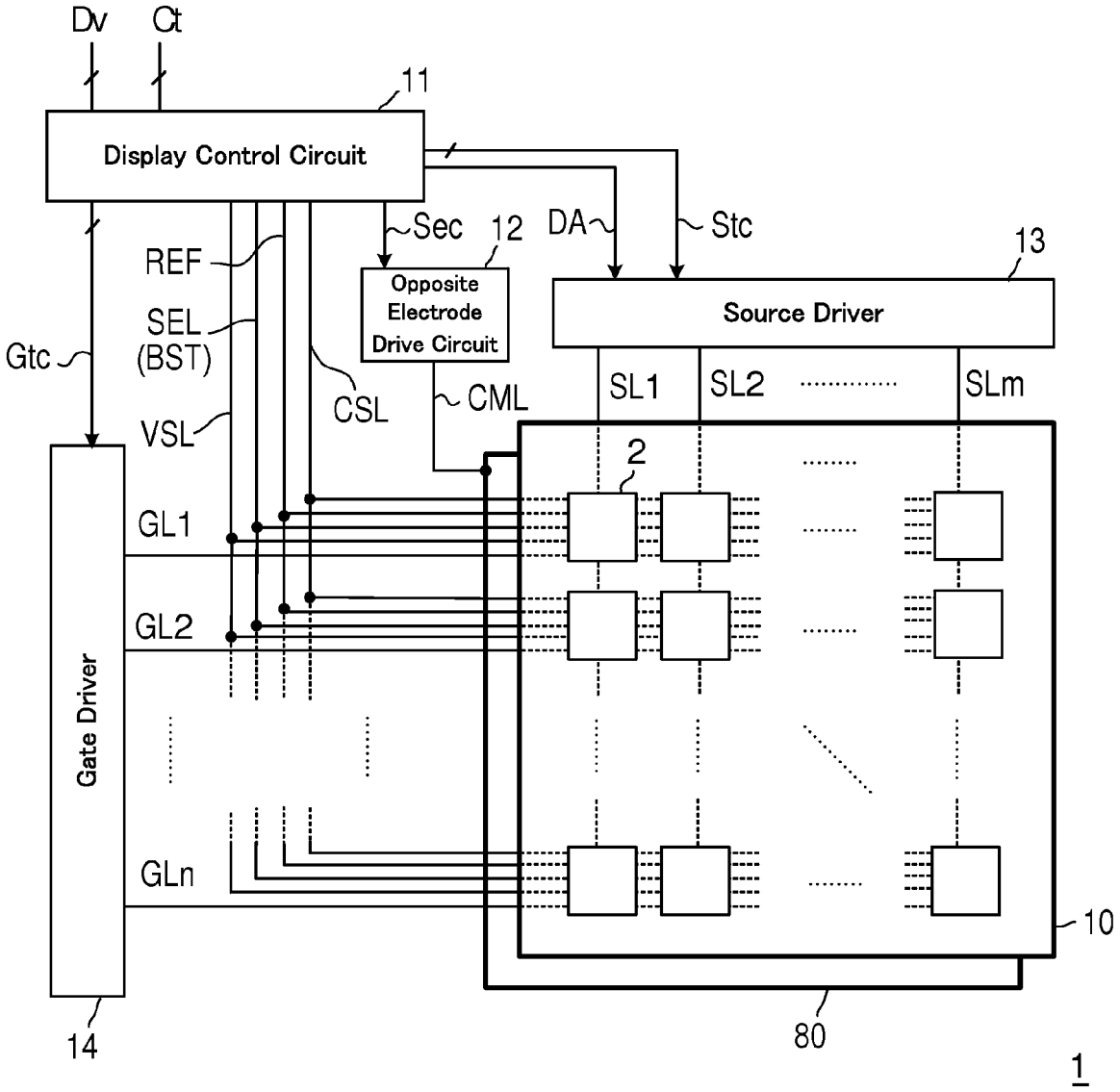
FIG. 3 is a block diagram showing an example of the schematic configuration of the display device according to the present invention.

The boost line BST can be arranged as a signal line different from the selecting line SEL, or the selecting line SEL can also serves as the boost line BST. When the selecting line SEL also serves as the boost line BST, the number of signal lines to be arranged on the active matrix substrate 10 can be reduced, and an aperture ratio of each pixel can be increased. FIG. 3 shows a configuration of a display device when the selecting line SEL also serves as the boost line BST.

Figure 4:
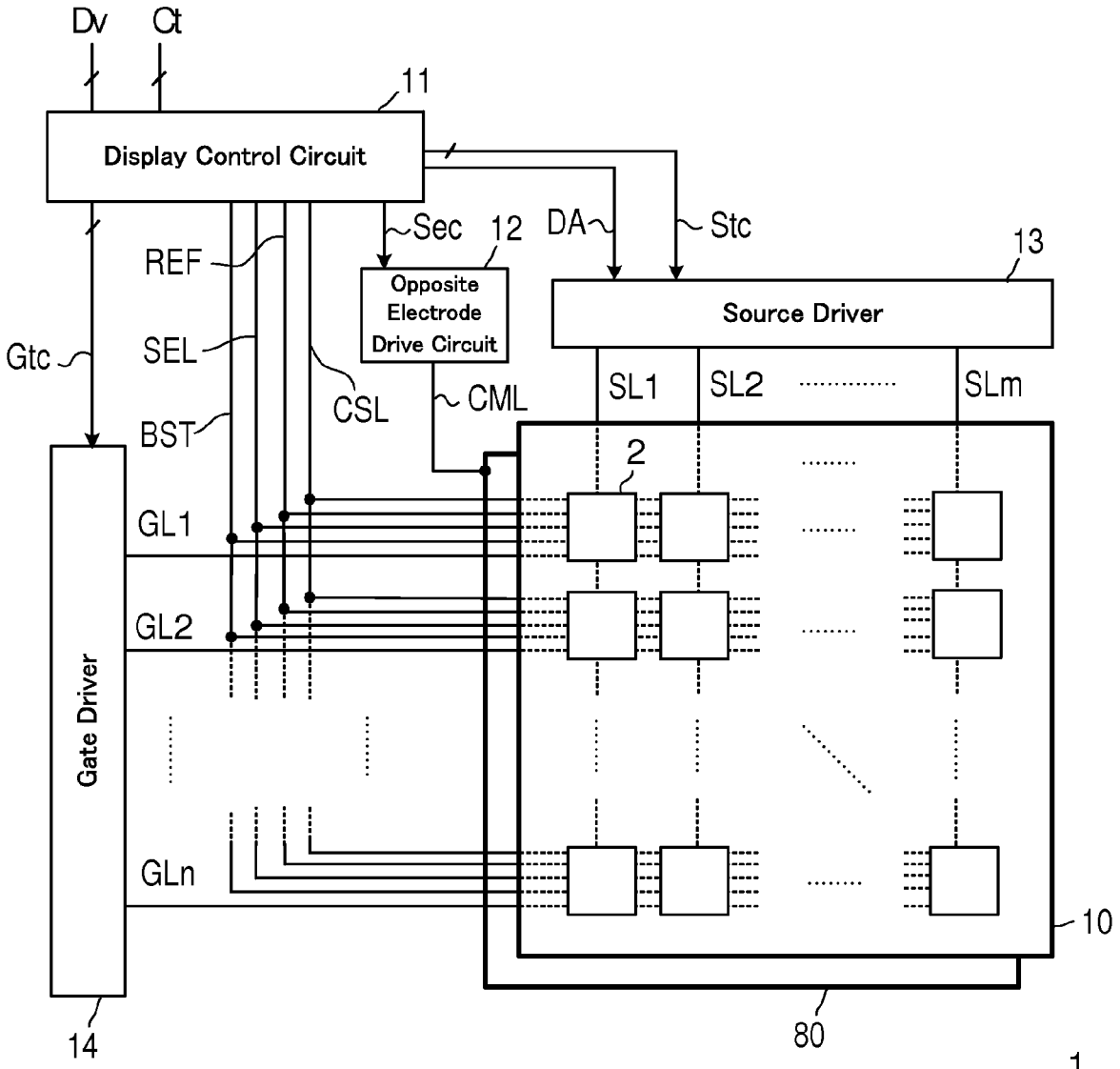
FIG. 4 is a block diagram showing an example of the schematic configuration of the display device according to the present invention.
Figure 5:
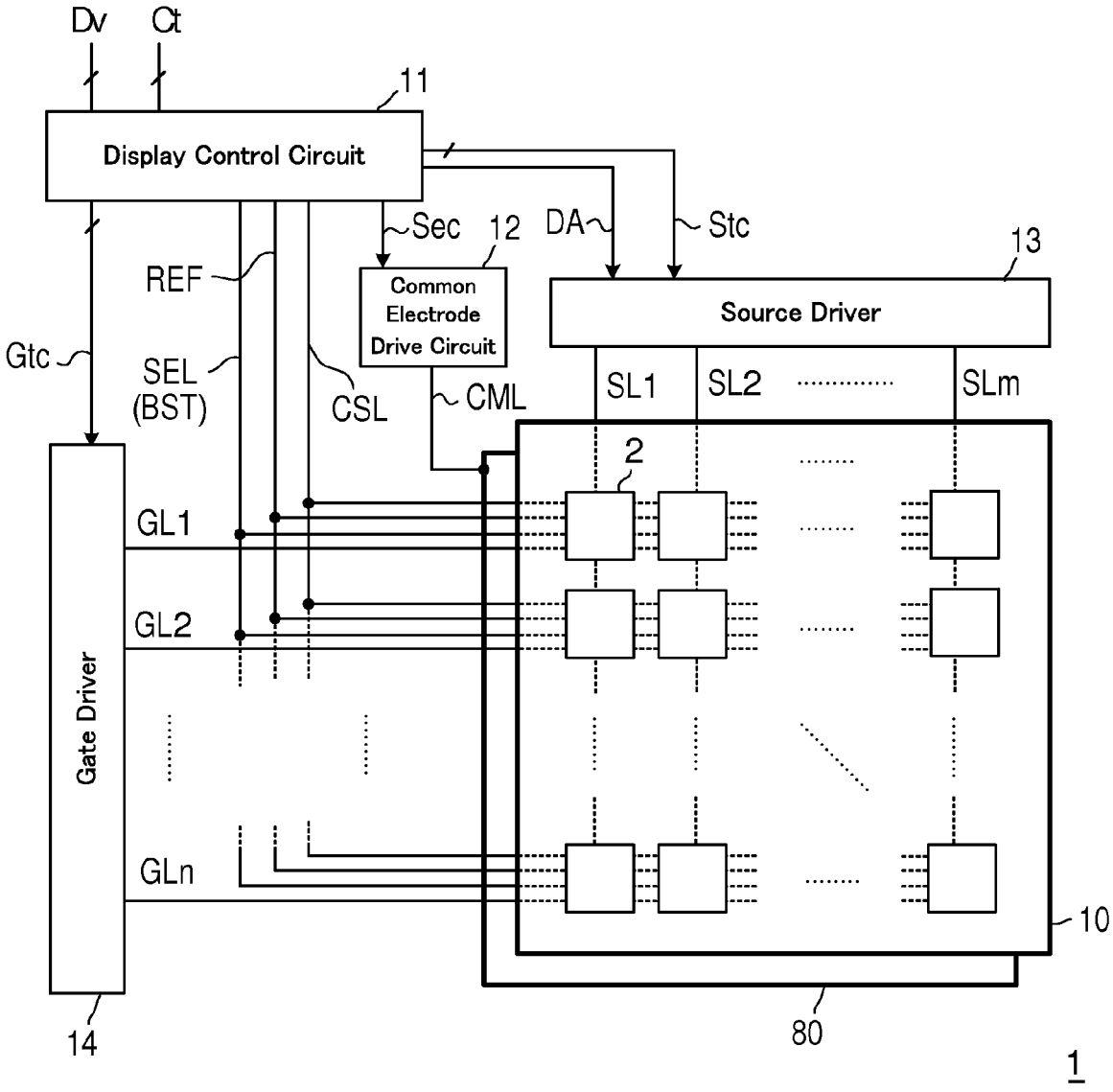
FIG. 5 is a block diagram showing an example of a schematic configuration of a display device according to the present invention.

Furthermore, a voltage supply line VSL can be arranged as an independent signal line as shown in FIGS. 1 and 3. Alternatively, the auxiliary capacitive line CSL or the reference line REF also serves as the voltage supply line VSL. FIGS. 4 and 5 shows configurations in which the configurations in FIGS. 1 and 3 are modified such that the auxiliary capacitive line CSL or the reference line REF also serves as the voltage supply line VSL. The source line SL can also serve as the voltage supply line VSL. The configuration of the display device 1 in this case is the same as that in FIG. 4 or FIG. 5.

As shown in FIG. 3 or 5, the selecting line SEL also serves as the boost line BST, or, as shown in FIG. 4 or 5, the auxiliary capacitive line CSL or the reference line REF also serves as the voltage supply line VSL to make it possible to reduce the number of signal lines to be arranged on the active matrix substrate 10 and to increase an aperture ratio of each pixel.

The reference line REF, the selecting line SEL, and the boost line BST correspond to a "first control line", a "second control line", and a "third control line", and are driven by the display control circuit 11. The auxiliary capacitive line CSL corresponds to a "fourth control line" or a "fixed voltage line", and is driven by the display control circuit 11 for example.

In FIG. 1 and FIGS. 3 to 5, the reference line REF, the selecting line SEL, and the auxiliary capacitive line CSL are arranged for each row to extend in the row direction, and wires of the rows are connected to each other at a peripheral portion of the pixel circuit array to form a single wire. However, the wires of the rows are independently driven, and a common voltage may be able to be applied depending on operating modes. Depending on a type of a circuit configuration of the pixel circuit 2 (will be described later), some or all of the reference line REF, the selecting line SEL, and the auxiliary capacitive line CSL can also be arranged for each column to extend in the column direction. Basically, the reference line REF, the selecting line SEL, and the auxiliary capacitive line CSL are used in common in the plurality of pixel circuits 2. When the boost line BST is arranged independently of the selecting line SEL, the boost line BST may be arranged by the same manner as that of the selecting line SEL.

The display control circuit 11 is a circuit that controls writing actions in a normal display mode and an always-on display mode (will be described later) and a self-refresh action in the always-on display mode.

In the writing action, the display control circuit 11 receives a data signal Dv representing an image to be displayed and a timing signal Ct from an external signal source, and, based on the signals Dv and Ct, as signals to display an image on the display element unit 21 (see FIG. 6) of the pixel circuit array, generates a digital image signal DA and a data-side timing control signal Stc given to the source driver 13, a scanning-side timing control signal Gtc given to the gate driver 14, a counter voltage control signal Sec given to the counter electrode drive circuit 12, and signal voltages applied to the reference line REF, the selecting line SEL, the auxiliary capacitive line CSL, the boost line BST, and the voltage supply line VSL, respectively.

The source driver 13 is a circuit that applies a source signal having a predetermined voltage amplitude at a predetermined timing to the source lines SL under the control of the display control circuit 11 in the writing action and the self-refresh action.

In the writing action, the source driver 13, based on the digital image signal DA and the data-side timing control signal Stc, generates a voltage matched with a voltage level of a counter voltage Vcom corresponding to a pixel value of one display line represented by the digital image signal DA as source signals Sc1, Sc2, . . . , Scm every one-horizontal period (to be also referred to as a "1H period"). The voltage is a multi-tone analog voltage in the normal display mode, and is a two-tone (binary) voltage in the always-on display mode. These source signals are applied to the source lines SL1, SL2, . . . , SLm, respectively.

In the self-refresh action, the source driver 13 performs the same voltage application to all the source lines SL connected to the target pixel circuit 2 at the same timing under the control of the display control circuit 11 (will be described in detail later).

The gate driver 14 is a circuit that applies a gate signal having a predetermined voltage amplitude to the gate lines GL at a predetermined timing under the control of the display control circuit 11 in the writing action and the self-refresh action. The gate driver 14, like the pixel circuit 2, may be formed on the active matrix substrate 10.

In the writing action, the gate driver 14 sequentially selects the gate lines GL1, GL2, . . . , GLn every almost one-horizontal period in each frame period of the digital image signal DA on the basis of the scanning-side timing control signal Gtc to write the source signals Sc1, Sc2, . . . , Scm in the pixel circuits 2.

In the self-refresh action, the gate driver 14 performs the same voltage application at the same timing to all the gate lines GL connected to the target pixel circuit 2 under the control of the display control circuit 11 (will be described in detail later).

The counter electrode drive circuit 12 applies the counter voltage Vcom to the counter electrode 80 through a counter electrode wire CML. In the embodiment, the counter electrode drive circuit 12 outputs the counter voltage Vcom in the normal display mode and the always-on display mode such that the level of the counter voltage Vcom is alternately switched between a predetermined high level (5 V) and a predetermined low level (0 V). In this manner, it is called "counter AC drive" that the counter electrode 80 is driven while switching the counter voltage Vcom between the high level and the low level.

The "counter AC drive" in the normal display mode switches the counter voltage Vcom between the high level and the low level every one-horizontal period and 1-frame period. That is, in a certain 1-frame period, in two sequential horizontal periods, a voltage polarity across the counter electrode 80 and the pixel electrode 20 changes. Even in the same one-horizontal period, in two sequential frame periods, a voltage polarity across the counter electrode 80 and the pixel electrode 20 changes.

On the other hand, in the always-on display mode, although the same voltage level is maintained in a 1-frame period, the voltage polarity across the counter electrode 80 and the pixel electrode 20 changes in two sequential writing actions.

When a voltage having the same polarity is continuously applied across the counter electrode 80 and the pixel electrode 20, a display screen burns in (surface burn-in). For this reason, the polarity inverting action is required. However, when the "counter AC drive" is employed, an amplitude of a voltage applied to the pixel electrode 20 in the polarity inverting action can be reduced.

<<Pixel Circuit>>

A configuration of the pixel circuit 2 will be described below with reference to FIGS. 6 to 30.

Figure 6:
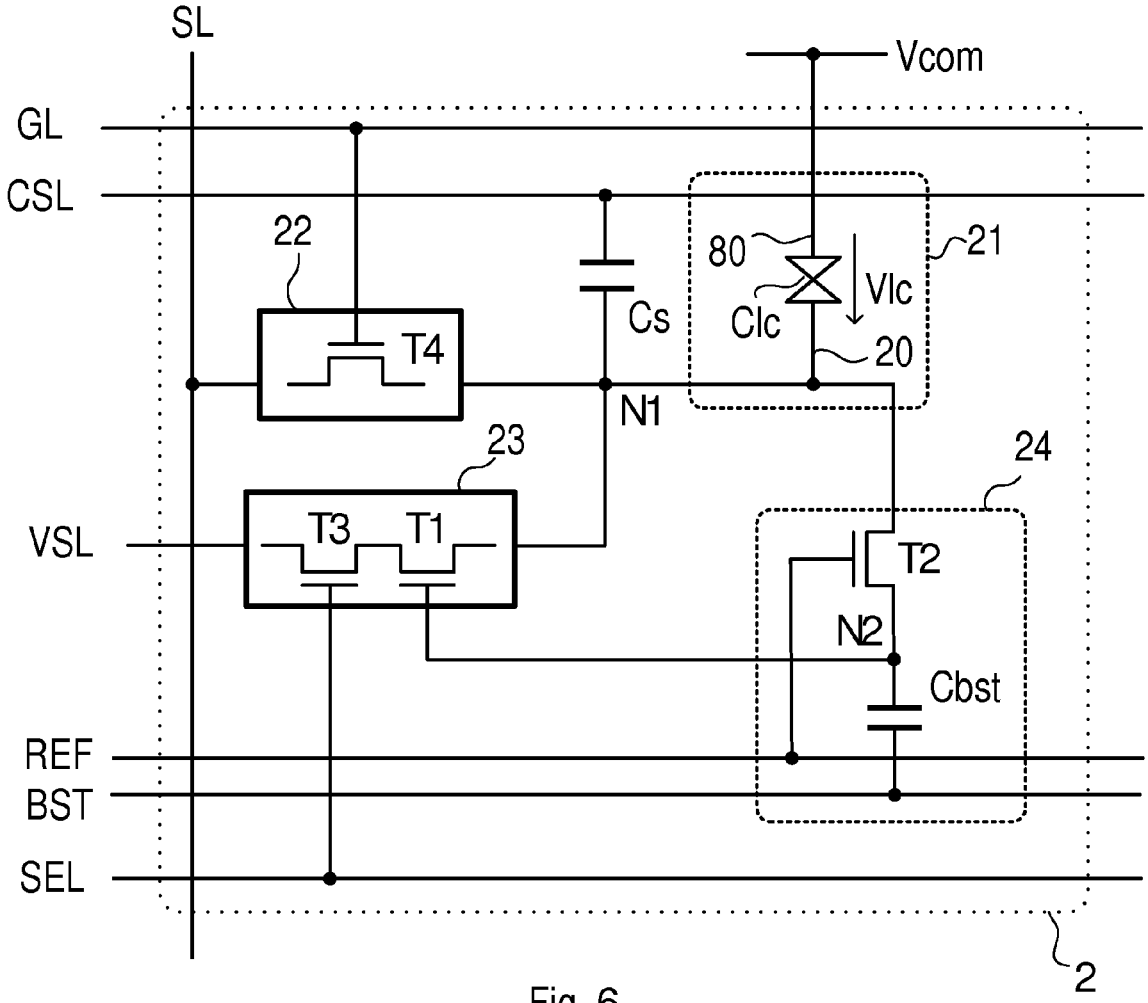
FIG. 6 is a circuit diagram showing a basic circuit configuration of the pixel circuit of the present invention.
Figure 7:
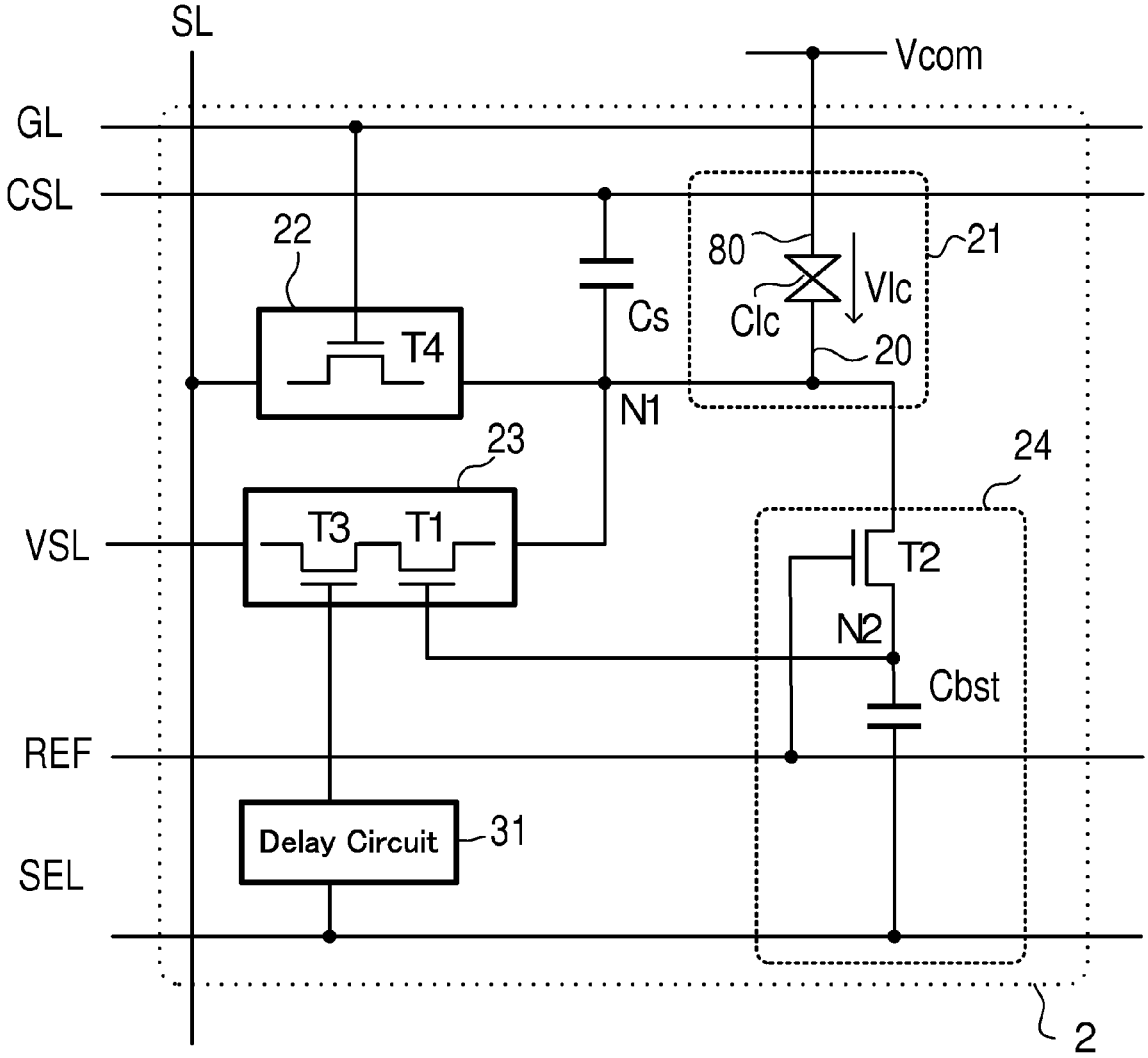
FIG. 7 is a circuit diagram showing another basic circuit configuration of the pixel circuit of the present invention.

FIGS. 6 and 7 show a basic circuit configuration of the pixel circuit 2 of the present invention. The pixel circuit 2, being common in all circuit configurations, includes a display element unit 21 including the unit liquid crystal display element Clc, a first switch circuit 22, a second switch circuit 23, a control circuit 24, and an auxiliary capacitor element Cs. The auxiliary capacitor element Cs corresponds to a "second capacitor element".

FIG. 6 corresponds to a basic configuration of each pixel circuit belonging to a group X (will be described later), and FIG. 7 corresponds to a basic configuration of each pixel circuit belonging to a group Y (will be described later). Since the unit liquid crystal display element Clc has been described with reference to FIG. 2, an explanation thereof will be omitted.

The pixel electrode 20 is connected to one terminals of the first switch circuit 22, the second switch circuit 23, and the control circuit 24 to form an internal node N1. The internal node N1 holds a voltage of pixel data supplied from the source line SL in the writing action.

The auxiliary capacitor element Cs has one terminal connected to the internal node N1 and the other terminal connected to the auxiliary capacitive line CSL. The auxiliary capacitor element Cs is additionally arranged to make it possible to cause the internal node N1 to stably hold the voltage of the pixel data.

The first switch circuit 22 has one terminal on which the internal node N1 is not configured and that is connected to the source line SL. The first switch circuit 22 includes a transistor T4 that functions as a switch element. The transistor T4 means the transistor having a control terminal connected to the gate line and corresponds to a "fourth transistor". In at least an off state of the transistor T4, the first switch circuit 22 is in an off state, and conduction between the source line SL and the internal node N1 is interrupted.

The second switch circuit 23 has one terminal on which the internal node N1 is not configured and that is connected to the voltage supply line VSL. The second switch circuit 23 includes a series circuit of a transistor T1 and a transistor T3. The transistor T1 means a transistor having a control terminal that is connected to an output node N2 of the control circuit 24, and corresponds to a "first transistor element". The transistor T3 means a transistor having a control terminal that is connected to the selecting line SEL, and corresponds to a "third transistor element". When both the transistor T1 and the transistor T3 are turned on, a second switch circuit 23 is turned on, and a conducting state between the voltage supply line VSL and the internal node N1 is set.

The control circuit 24 includes a series circuit of the transistor T2 and a boost capacitor element Cbst. A first terminal of the transistor T2 is connected to the internal node N1, and a control terminal thereof is connected to the reference line REF. The second terminal of the transistor T2 is connected to the first terminal of the boost capacitor element Cbst and the control terminal of the transistor T1 to form an output node N2. The second terminal of the boost capacitor element Cbst is connected to the boost line BST (group X) as shown in FIG. 6 or connected to the selecting line SEL (group Y) as shown in FIG. 7.

One end of the auxiliary capacitor element Cs and one end of the liquid crystal capacitor element Clc are connected to the internal node N1. In order to avoid reference numerals from being complicated, an electrostatic capacity (called an "auxiliary capacity") of the auxiliary capacitor element is expressed by Cs, and an electrostatic capacity (called a "liquid crystal capacity") of a liquid crystal capacitor element is expressed by Clc. At this time, a full capacity being parasitic in the internal node N1, i.e., a pixel capacity Cp in which pixel data is to be written and held is approximately expressed by a sum of the liquid crystal capacity Clc and the auxiliary capacity Cs ($Cp \cong Clc+Cs$).

At this time, the boost capacitor element Cbst is set so as to establish $Cbst \ll Cp$ when the electrostatic capacity (called a "boost capacity") of the element is described as Cbst.

The output node N2 holds a voltage depending on a voltage level of the internal node N1 when the transistor T2 is turned on, and holds the initial hold voltage when the transistor T2 is turned off even though the voltage level of the internal node N1 changes. Depending on the hold voltage of the output node N2, the transistor T1 of the second switch circuit 23 is on/off-controlled.

All the transistors T1 to T4 of four types are thin film transistors formed on the active matrix substrate 10. One of the first and second terminals corresponds to a drain electrode, the other corresponds to a source electrode, and the control terminal corresponds to a gate electrode. Furthermore, each of the transistors T1 to T4 may be configured by a single transistor element. When a request to suppress a leakage current in an off state is strong, the plurality of transistors may be connected in series with each other to share the control terminal. In the following explanation of action of the pixel circuit 2, as all the transistors T1 to T4, N-channel type amorphous silicon TFTs each having a threshold voltage of about 2 V are supposed.

The pixel circuit 2, as will be described later, may have various circuit configurations. However, the circuit configurations may be patterned as follows.

1) With respect to the configuration of the first switch circuit 22, two patterns, i.e., a pattern in which the first switch circuit 22 is configured by only the transistor T4 and a pattern in which the first switch circuit 22 is configured by a series circuit of the transistor T4 and another transistor element are possible. In the latter, as another transistor element configuring the series circuit, the transistor T3 in the second switch circuit 23 can be used, or another transistor element having the control terminal connected to the control terminal of the transistor T3 in the second switch circuit 23 can also be used.

2) With respect to a signal line connected to a second terminal of the boost capacitor element Cbst, two patterns, i.e., a pattern in which the signal line is connected to the boost line BST and a pattern in which the signal line is connected to the selecting line SEL are possible. In the latter, the selecting line SEL also serves as the boost line BST. As described above, the former corresponds to FIG. 6 (group X), and the latter corresponds to FIG. 7 (group Y).

3) With respect to the voltage supply line VSL, four patterns, i.e., a pattern in which the voltage supply line VSL also serves as the reference line REF, a pattern in which the voltage supply line VSL also serves as the auxiliary capacitive line CSL, a pattern in which the voltage supply line VSL also serves as the source line SL, and a pattern in which an independent signal line is used are possible.

In the following, the pixel circuits 2 will be organized in units of types based on the 1) to 3). More specifically, the pixel circuits 2 are classified into two groups (X, Y) depending on whether the signal line connected to the second terminal of the boost capacitor element Cbst is the boost line BST or the selecting line SEL, and combinations of configurations of the first switch circuits 22 and the configurations of the voltage supply lines VSL are classified into eight types for each of the groups.

More specifically, cases in each of which the first switch circuit 22 is configured by only the transistor T4 are defined as the first to fourth types, and cases in each of which the first switch circuit 22 is configured by a series circuit of the transistor T4 and another transistor element are defined as the fifth to eighth types. Of the types, each of the first and fifth types has a configuration in which the voltage supply line VSL also serves as the reference line REF, each of the second and sixth types has a configuration in which the voltage supply line VSL also serves as the auxiliary capacitive line CSL, each of the third and seventh types has a configuration in which the voltage supply line VSL also serves as the source line SL, and each of the fourth and eighth types has a configuration in which the voltage supply line VSL is configured by an independent signal line.

Even pixel circuits of the same type belonging to the same group may have a plurality of modified patterns depending on a change of an arrangement position of the transistor T3 in the second switch circuit 23.

As will be described later, the pixel circuit of the present invention is configured to provide a time lag between a timing at which a voltage is applied to the second terminal of the boost capacitor element Cbst and a timing at which a voltage is applied to the control terminal of the transistor T3. More specifically, when the boost line BST is connected to the second terminal of the boost capacitor element Cbst, i.e., when a line different from the selecting line SEL connected to the control terminal of the transistor T3 is connected thereto, a voltage application timing to the boost line BST can be made different from a voltage application timing to the selecting line SEL. On the other hand, when the selecting line SEL is connected to the second terminal of the boost capacitor element Cbst, i.e., when the same signal line as the signal line connected to the control terminal of the transistor T3 is connected thereto, the control terminal of the transistor T3 is connected to the selecting line SEL through a delay circuit 31.

As shown in FIG. 7, when the selecting line SEL is connected to the second terminal of the boost capacitor element Cbst, the delay circuit 31 is arranged. On the other hand, in the configuration shown in FIG. 6 in which the boost line BST is arranged independently of the selecting line SEL, as described above, the voltage application timings to both the lines are made different from each other as described above. For this reason, the delay circuit 31 is not always required. Thus, FIG. 6 shows a configuration in which the delay circuit 31 is not arranged. As a matter of course, the delay circuit 31 may be arranged in the configuration in FIG. 6.

<1. Group X>

A pixel circuit in which the boost line BST is connected to the second terminal of the boost capacitor element Cbst and that belongs to the group X will be described first. In this case, as described above, it is assumed that a voltage application timing to the boost line BST can be made different from the voltage application timing to the selecting line SEL.

At this time, as described above, depending on the configurations of the voltage supply line VSL and the first switch circuit 22, pixel circuits 2A to 2H of the first to eighth types shown in FIGS. 8 to 21 are supposed.

Figure 8:
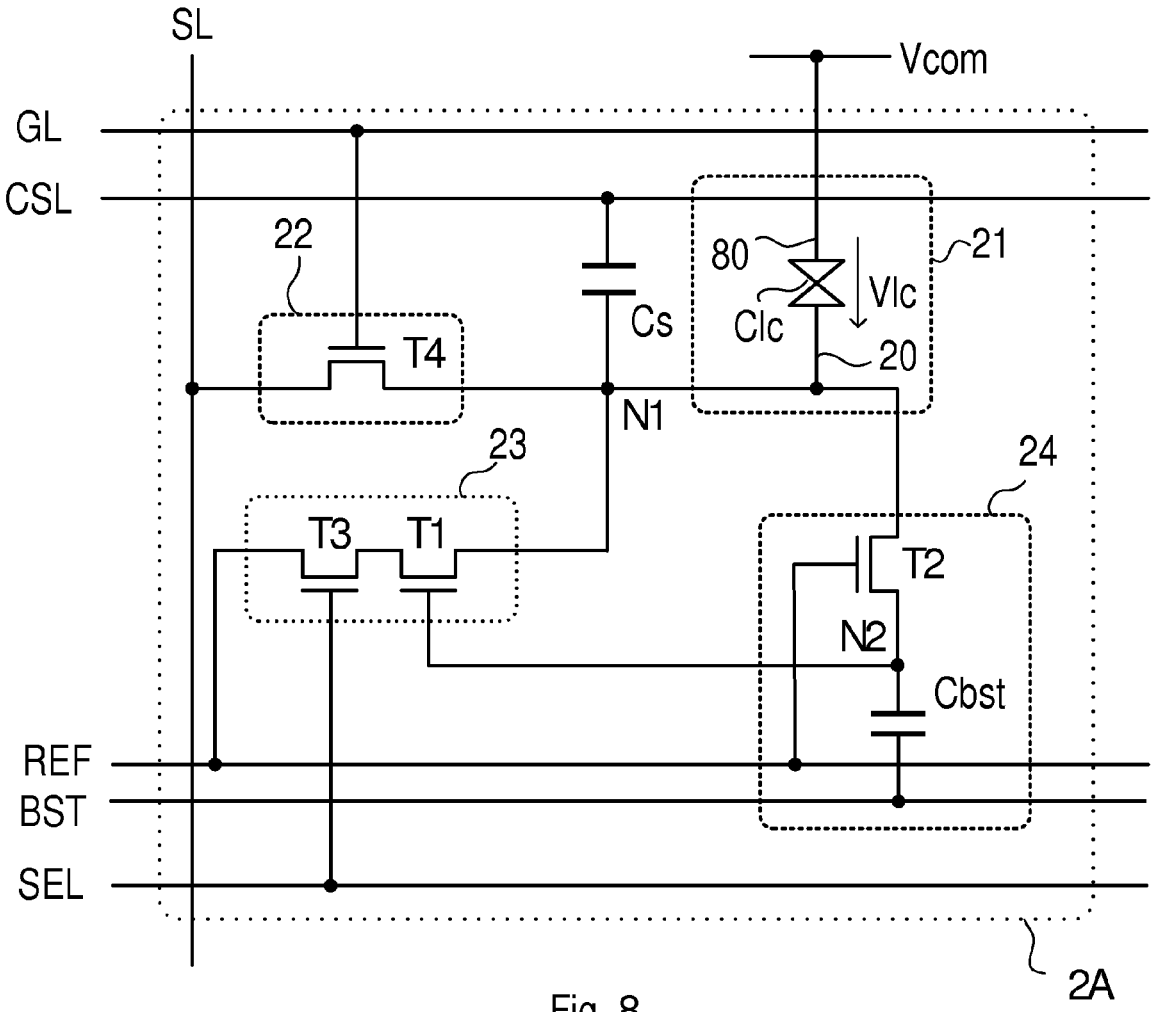
FIG. 8 is a circuit diagram showing a circuit configuration of a first type belonging to a group X of the pixel circuit of the present invention.

In the pixel circuit 2A of the first type shown in FIG. 8, the first switch circuit 22 is configured by only the transistor T4, and the reference line REF also serves as the voltage supply line VSL. The reference line REF extends in a horizontal direction (row direction) in parallel with, for example, the gate line GL. However, the reference line REF may extend in a vertical direction (column direction) in parallel with the source line SL.

Figure 9:
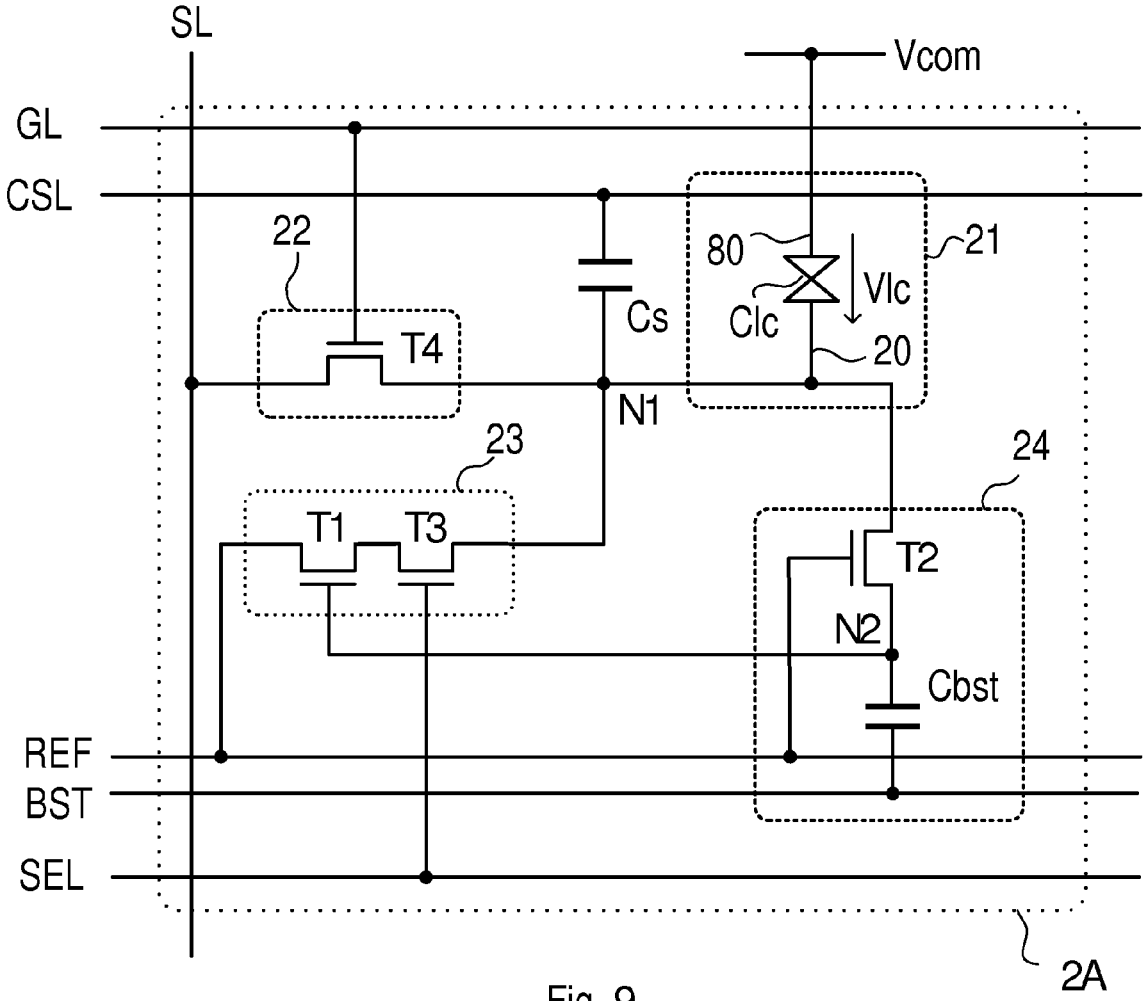
FIG. 9 is a circuit diagram showing another circuit configuration of the first type belonging to the group X of the pixel circuit of the present invention.
Figure 10:
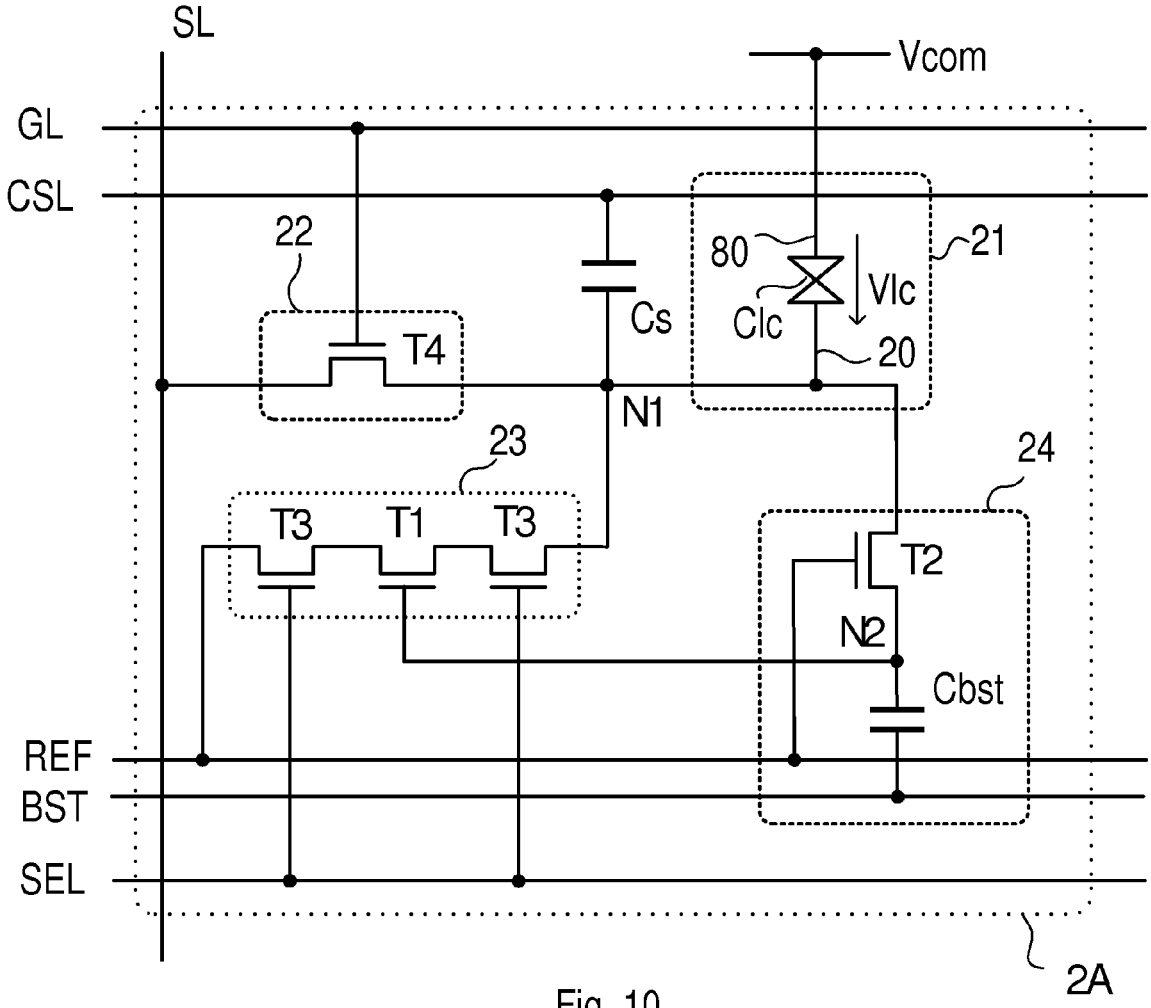
FIG. 10 is a circuit diagram showing still another circuit configuration of the first type belonging to the group X of the pixel circuit of the present invention.

In this case, in FIG. 8, the second switch circuit 23 is configured by a series circuit of the transistor T1 and the transistor T3 and has, as an example, a configuration in which the first terminal of the transistor T1 is connected to the internal node N1, the second terminal of the transistor T1 is connected to the first terminal of the transistor T3, and the second terminal of the transistor T3 is connected to the source line SL. However, the arrangements of the transistor T1 and the transistor T3 of the series circuit may be replaced with each other, and a circuit configuration in which the transistor T1 is interposed between the two transistors T3 may be used. The two modified circuit configurations are shown in FIG. 9 and FIG. 10.

Figure 11:
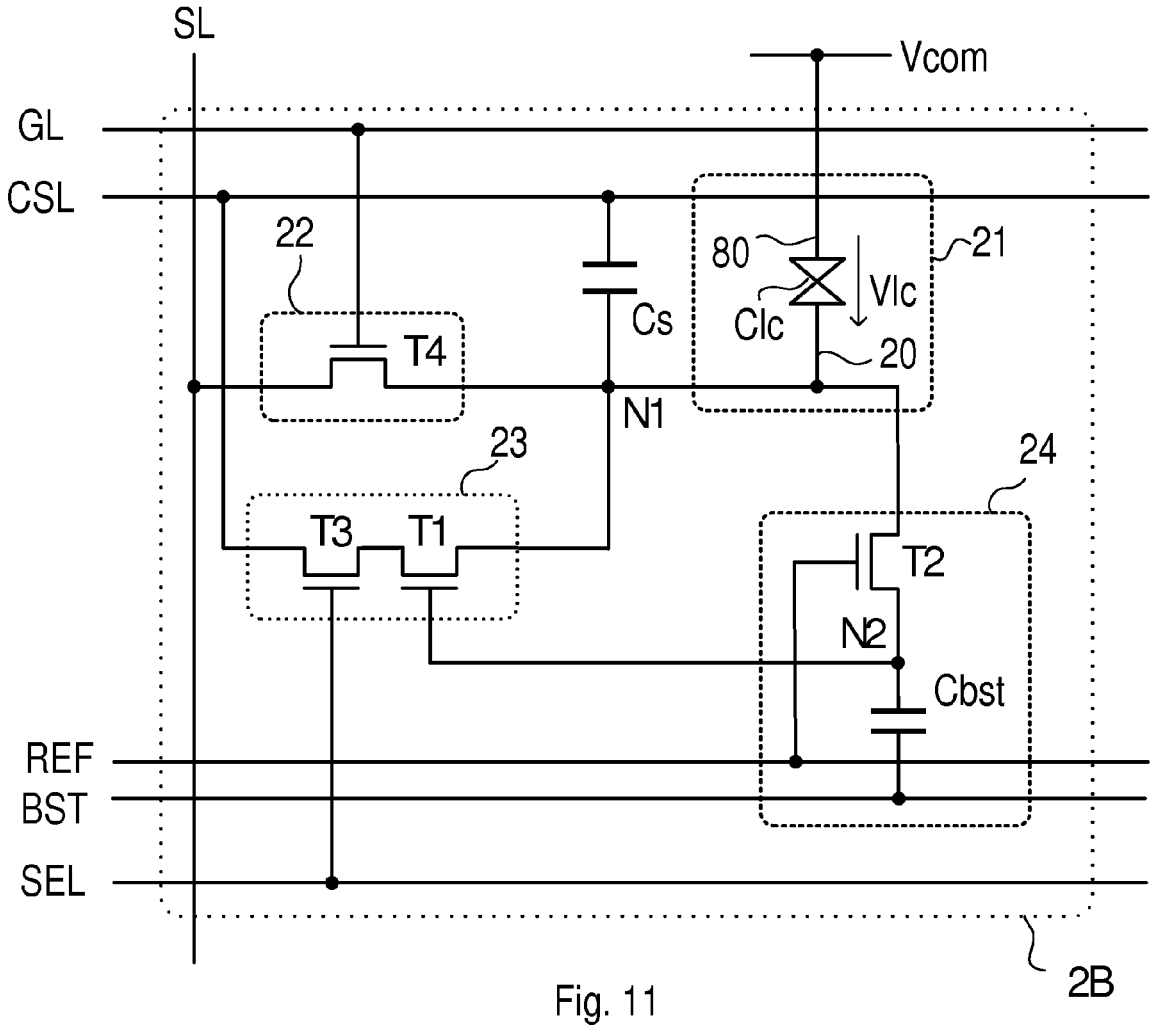
FIG. 11 is a circuit diagram showing a circuit configuration of a second type belonging to the group X of the pixel circuit of the present invention.

In the pixel circuit 2B of the second type shown in FIG. 11, the first switch circuit 22 is configured by only the transistor T4, and the auxiliary capacitive line CSL also serves as the voltage supply line VSL. The auxiliary capacitive line CSL extends in a horizontal direction (row direction) in parallel with, for example, the gate line GL. However, the auxiliary capacitive line CSL may extend in a vertical direction (column direction) in parallel with the source line SL.

Figure 12:
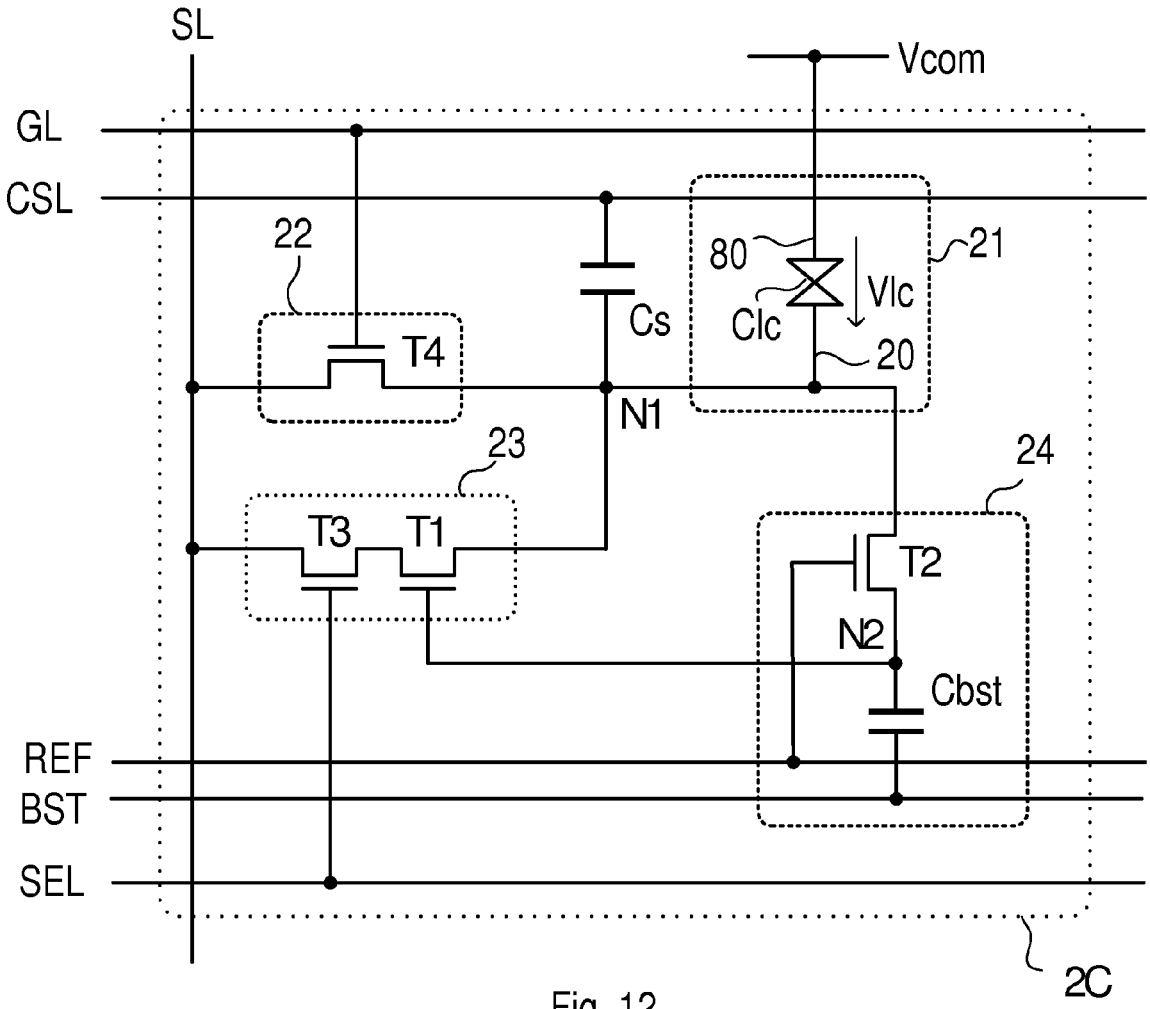
FIG. 12 is a circuit diagram showing a circuit configuration of a third type belonging to the group X of the pixel circuit of the present invention.

In the pixel circuit 2C of the third type shown in FIG. 12, the first switch circuit 22 is configured by only the transistor T4, and the source line SL also serves as the voltage supply line VSL.

Figure 13:
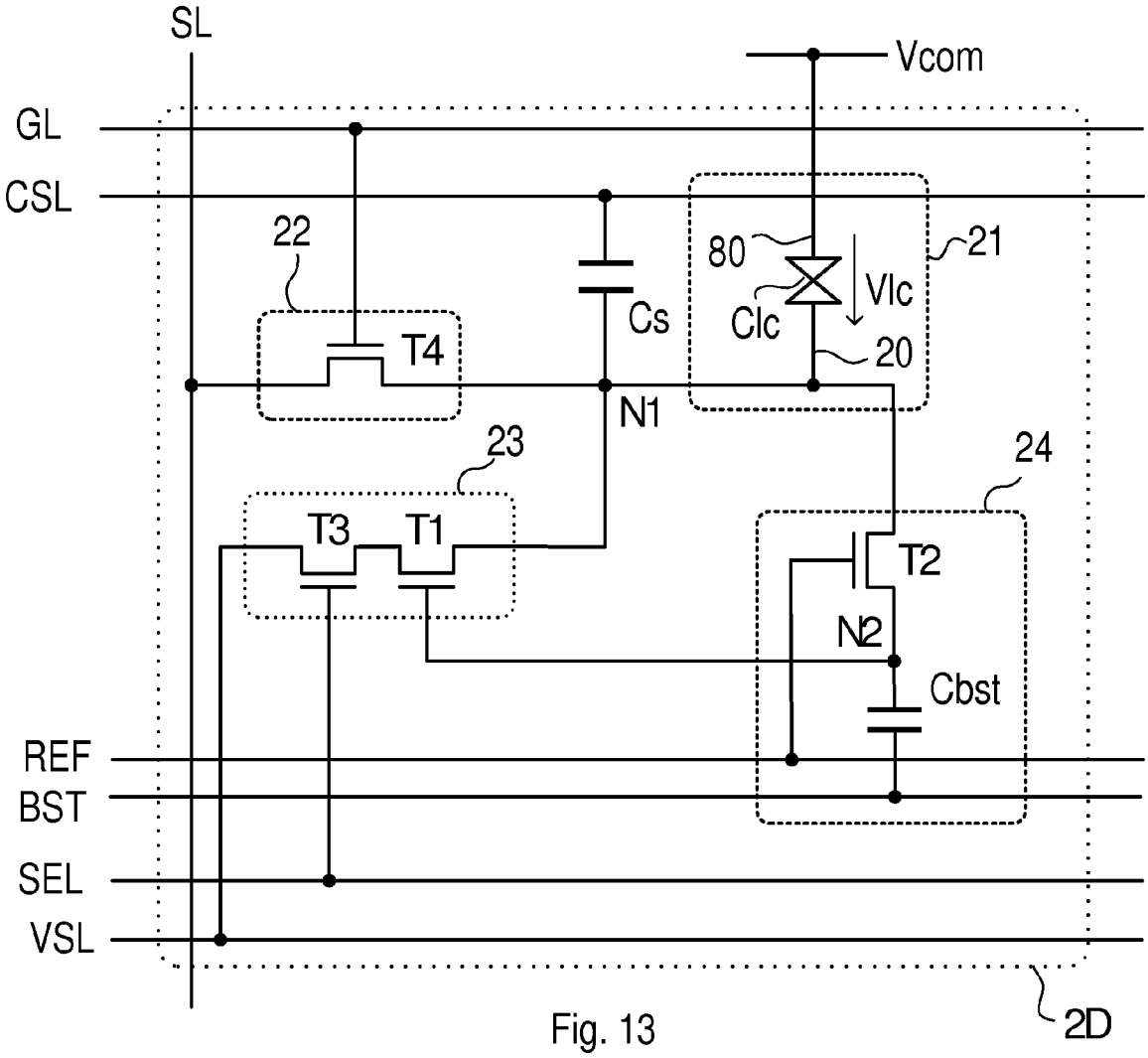
FIG. 13 is a circuit diagram showing a circuit configuration of a fourth type belonging to the group X of the pixel circuit of the present invention.

In the pixel circuit 2D of the fourth type shown in FIG. 13, the first switch circuit 22 is configured by only the transistor T4, and the voltage supply line VSL is configured by an independent signal line. In FIG. 13, the voltage supply line VSL extends in a horizontal direction (row direction) in parallel with, for example, the gate line GL. However, the voltage supply line VSL may extend in a vertical direction (column direction) in parallel with the source line SL.

Even in the second to fourth types, as in the first type, as shown in FIG. 9 or 10, a modified circuit depending on the configuration of the second switch circuit 23 can be realized.

Figure 14:
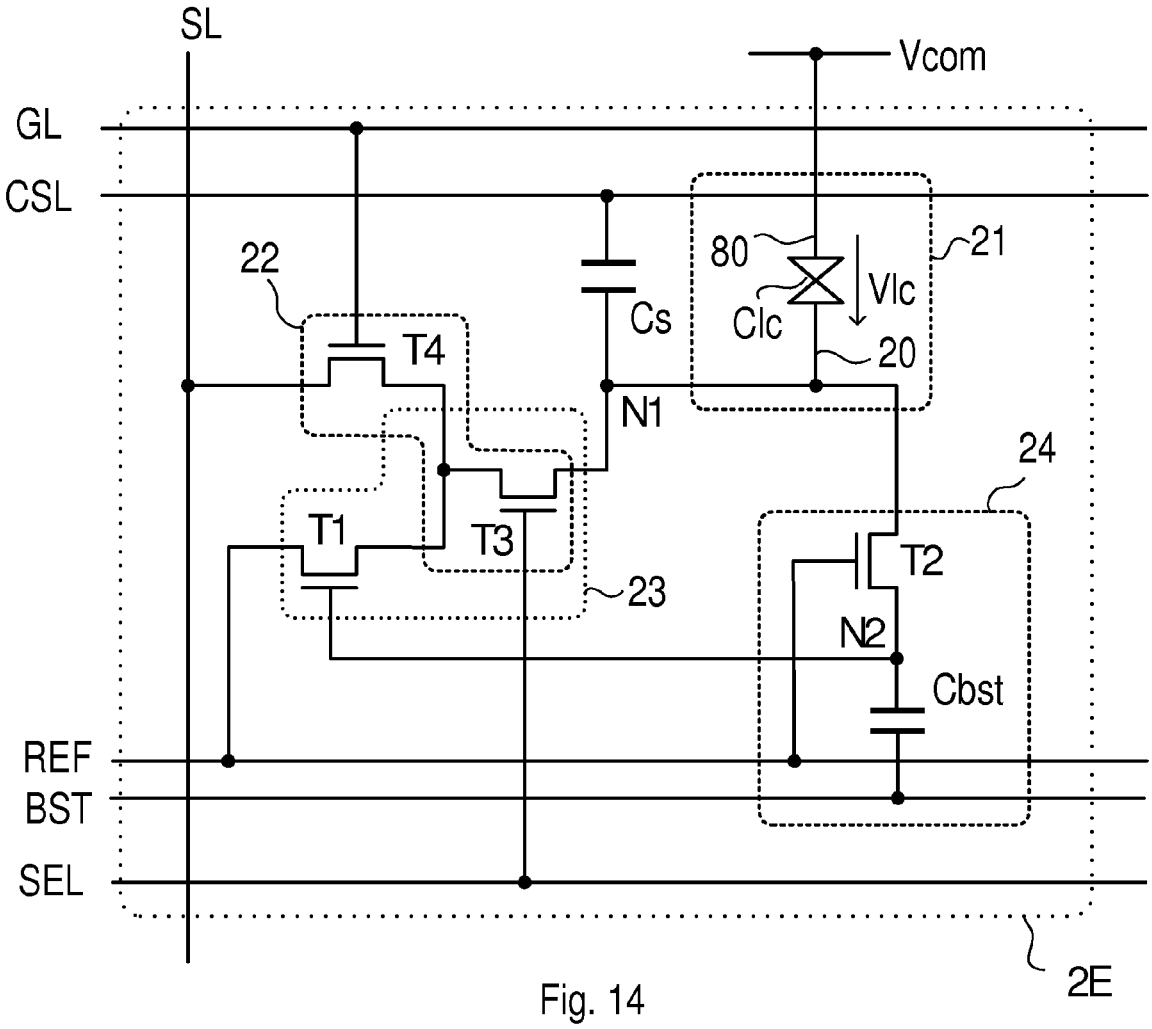
FIG. 14 is a circuit diagram showing a circuit configuration of a fifth type belonging to the group X of the pixel circuit of the present invention.

The pixel circuit 2E of the fifth type shown in FIG. 14 is similar to the pixel circuit 2A of the first type shown in FIG. 9 except that the first switch circuit 22 is configured by a series circuit of the transistor T4 and another transistor element.

In FIG. 14, as the transistor element configuring the first switch circuit 22 except for the transistor T4, a transistor in the second switch circuit 23 is also used. More specifically, the first switch circuit 22 is configured by a series circuit of the transistor T4 and the transistor T3, and the second switch circuit 23 is configured by a series circuit of the transistor T1 and the transistor T3. The first terminal of the transistor T3 is connected to the internal node N1, the second terminal of the transistor T3 is connected to the first terminal of the transistor T1 and the first terminal of the transistor T4, the second terminal of the transistor T4 is connected to the source line SL, and the second terminal of the transistor T1 is connected to the reference line REF.

More specifically, in the pixel circuit 2E of the fifth type, the conducting state of the first switch circuit 22 is controlled by, in addition to the gate line GL, the selecting line SEL.

Figure 15:
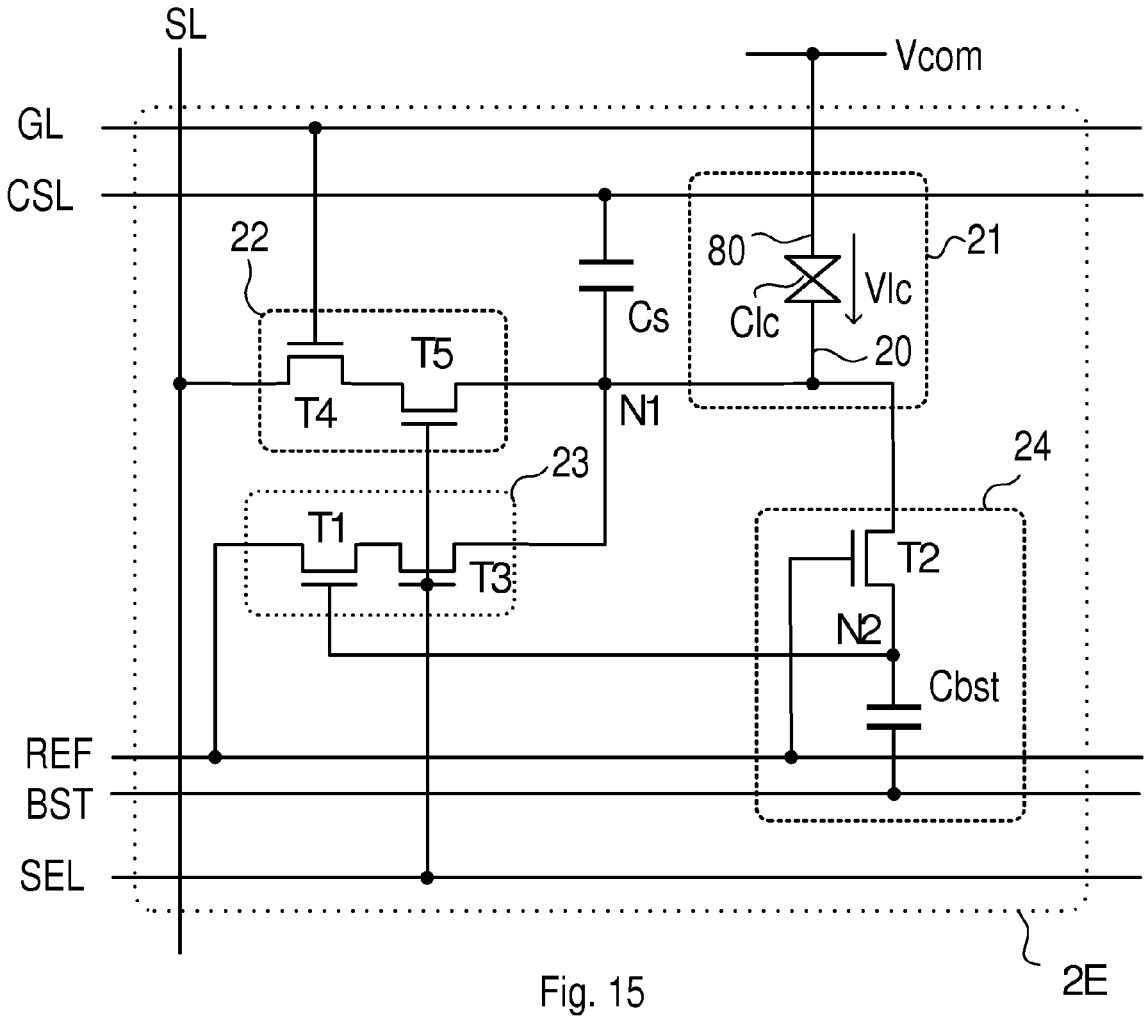
FIG. 15 is a circuit diagram showing another circuit configuration of the fifth type belonging to the group X of the pixel circuit of the present invention.

As a modification of the fifth type, as shown in FIG. 15, a configuration using, as the transistor element configuring the first switch circuit 22 except for the transistor T4, the transistor T5 having the control terminal connected to the control terminal of the transistor T3 in the second switch circuit 23 can also be realized. The transistor T5 corresponds to a "fifth transistor element."

In the pixel circuit 2E shown in FIG. 15, since the control terminals of the transistor T5 and the transistor T3 are connected to each other, the transistor T5 is on/off-controlled by the selecting line SEL like the transistor T3. The configuration is similar to the configuration shown in FIG. 14 in that the transistor element configuring the first switch circuit 22 except for the transistor T4 is on/off-controlled by the selecting line SEL.

Figure 16:
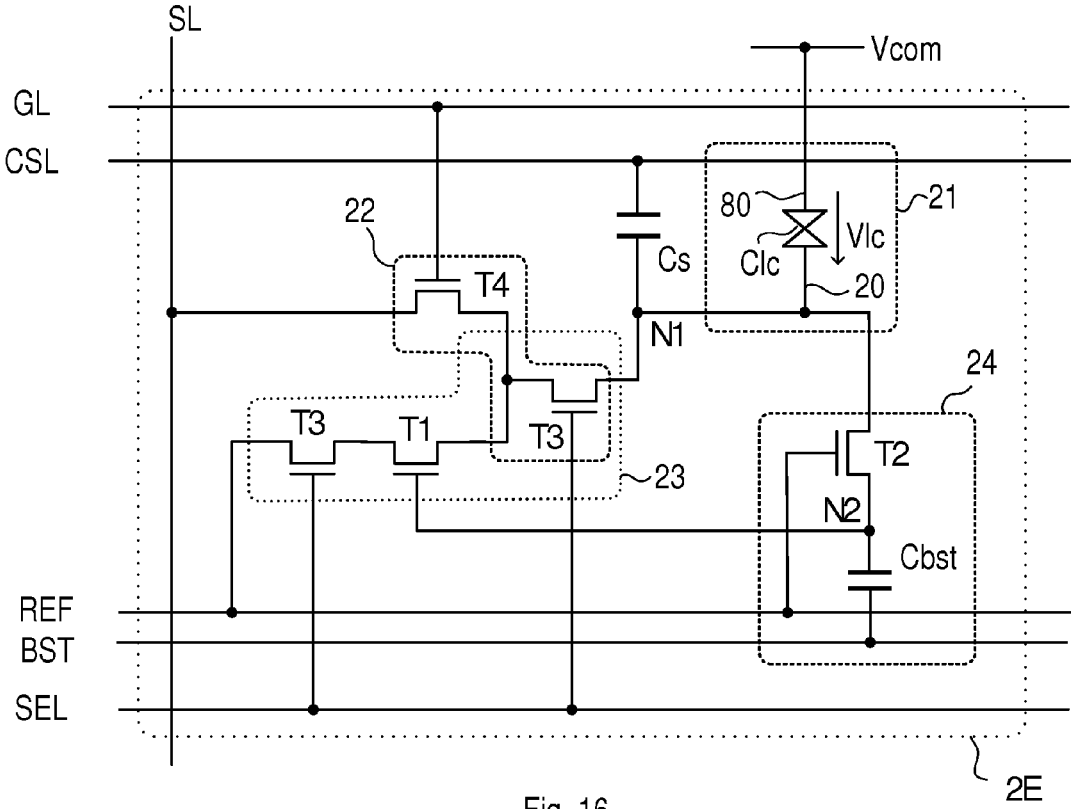
FIG. 16 is a circuit diagram showing still another circuit configuration of the fifth type belonging to the group X of the pixel circuit of the present invention.

In the fifth type, the transistor T3 is shared by the first switch circuit 22 and the second switch circuit 23. For this reason, as shown in FIG. 13, the transistor T3 in the second switch circuit 23 must be arranged on the internal node N1 side, and the transistor T3 must be arranged on the reference line REF side. More specifically, the arrangements of the transistors T1 and T3 cannot be replaced with each other as shown in FIG. 8. On the other hand, as shown in FIG. 10, the transistor T1 can be sandwiched by the transistors T3. A modification obtained in this case is shown in FIG. 16.

Figure 17:
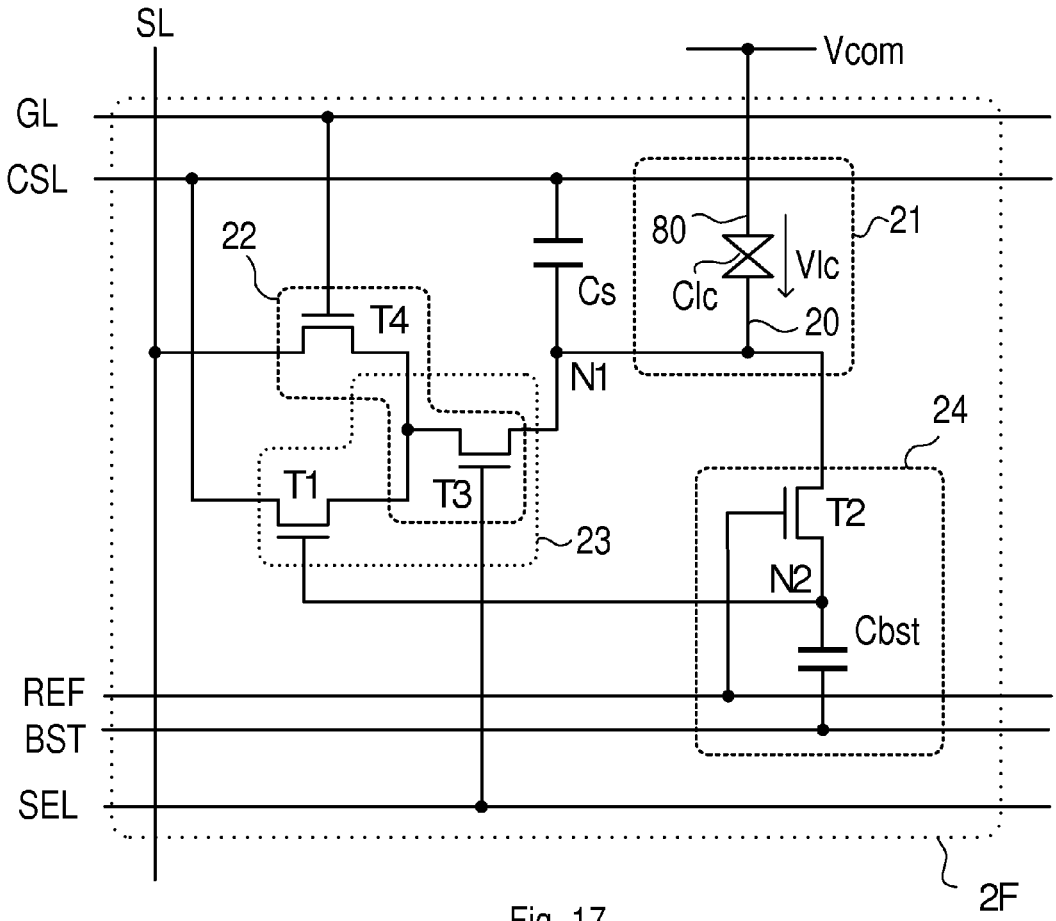
FIG. 17 is a circuit diagram showing a circuit configuration of a sixth type belonging to the group X of the pixel circuit of the present invention.

A pixel circuit 2F of a sixth type shown in FIG. 17 has a configuration in which the first switch circuit 22 is configured by a series circuit of the transistor T4 and the transistor T3 in the pixel circuit 2B of the second type. As in the pixel circuit 2E of the fifth type shown in FIG. 14, since the transistor T3 must be arranged on the internal node N1 side in the second switch circuit 23, the arrangements of the transistors T1 and T3 in FIG. 11 are replaced with each other.

Figure 18:
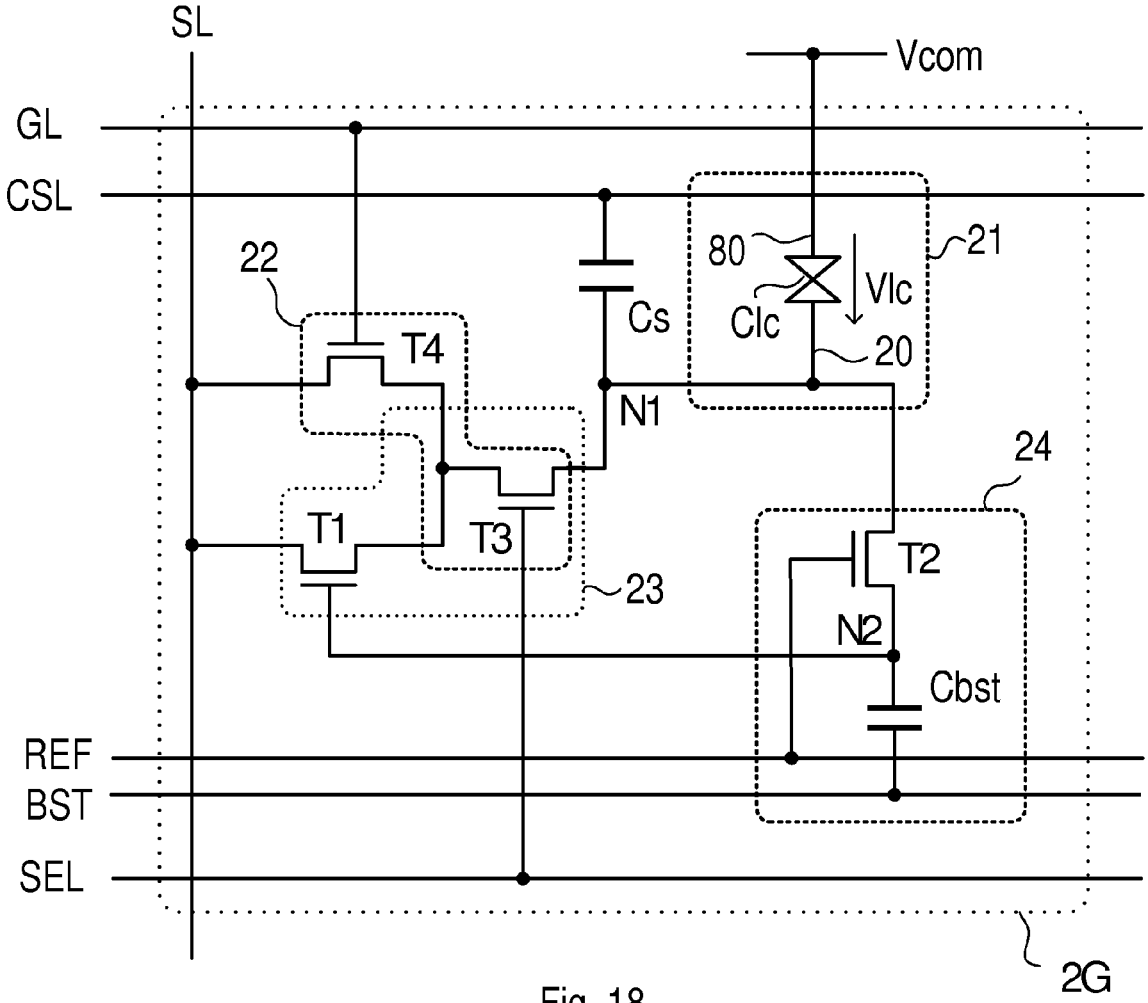
FIG. 18 is a circuit diagram showing a circuit configuration of a seventh type belonging to the group X of the pixel circuit of the present invention.
Figure 19:
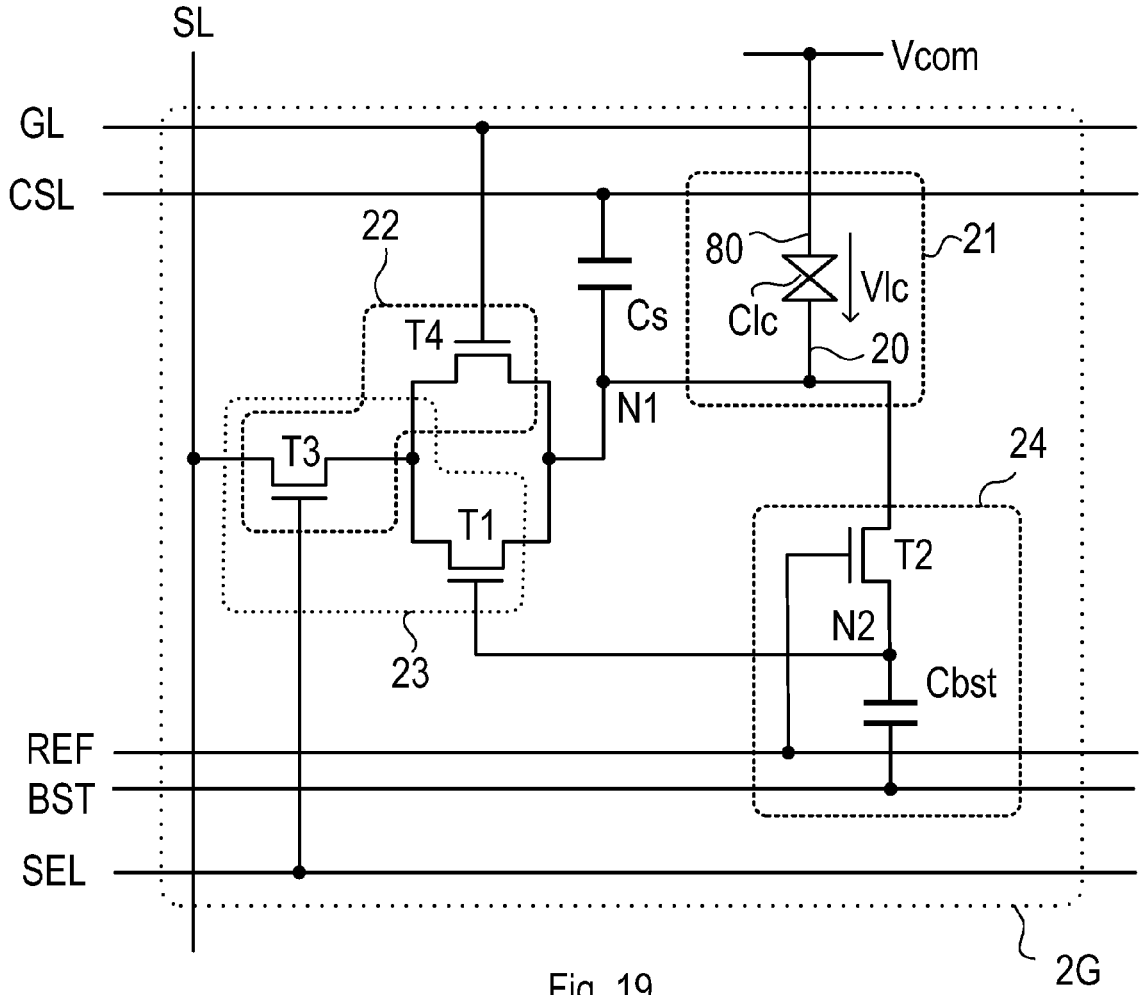
FIG. 19 is a circuit diagram showing a circuit configuration of the seventh type belonging to the group X of the pixel circuit of the present invention.
Figure 20:
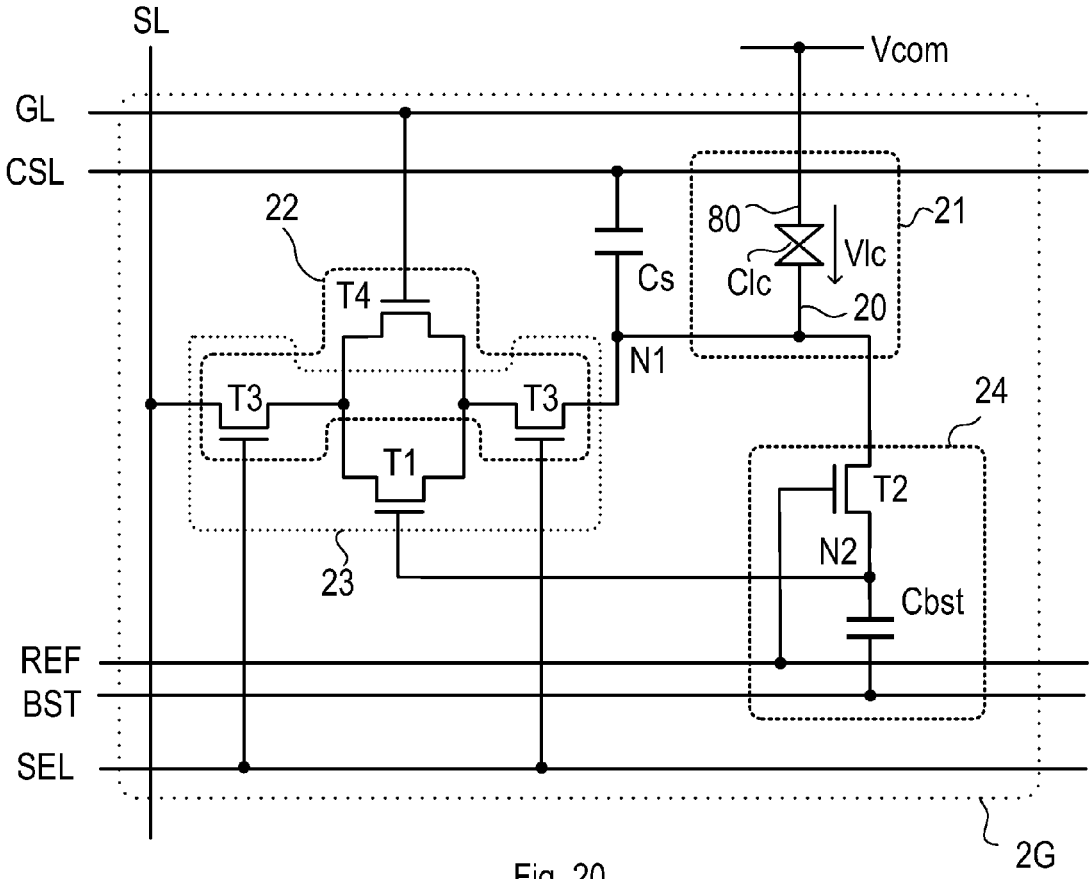
FIG. 20 is a circuit diagram showing a circuit configuration of the seventh type belonging to the group X of the pixel circuit Of the present invention.

A pixel circuit 2G of a seventh type shown in FIGS. 18 and 19 has a configuration in which the first switch circuit 22 is configured by a series circuit of the transistor T4 and the transistor T3 in the pixel circuit 2C of the third type. In the seventh type, since each of the first switch circuit 22 and the second switch circuit 23 has one end connected to the internal node N1 and the other end connected to the source line SL, as shown in FIG. 18 and FIG. 19, the arrangements of the transistor elements T1 and T3 in the second switch circuit 23 can be replaced with each other. Furthermore, a modified circuit as shown in FIG. 20 can also be used.

Figure 21:
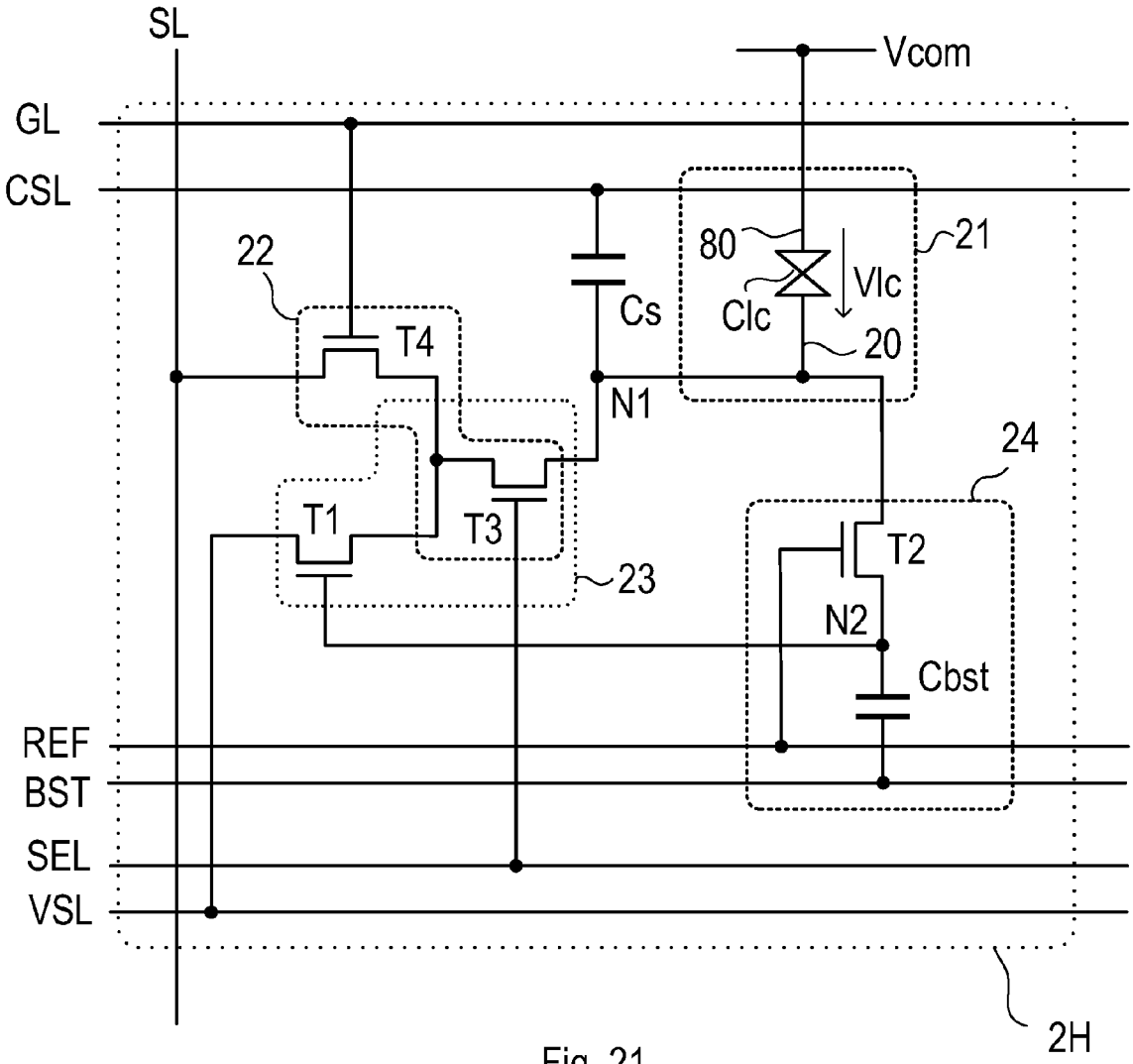
FIG. 21 is a circuit diagram showing a circuit configuration of an eighth type belonging to the group X of the pixel circuit of the present invention.

A pixel circuit 211 of an eighth type shown in FIG. 21 has a configuration in which the first switch circuit 22 is configured by a series circuit of the transistor T4 and the transistor T3 in the pixel circuit 2D of the fourth type. As in the pixel circuits of the fifth and sixth types, since the transistor T3 must be arranged on the internal node N1 side in the second switch circuit 23, the arrangements of the transistors T1 and T3 in FIG. 13 are replaced with each other.

Also in the sixth to eighth types, a modified circuit of the fifth type as shown in FIGS. 15 and 16 can be realized.

<2. Group Y>

A pixel circuit in which the selecting line SEL is connected to the second terminal of the boost capacitor element Cbst and that belongs to the group Y will be described below.

As described above, the pixel circuits belonging to the first to eighth types of the group Y are different from the pixel circuits belonging to the first to eighth types of the group X in only that the selecting line SEL also serves as the boost line BST by connecting the selecting line SEL to the control terminal of the transistor T3 through the delay circuit 31. Circuit diagrams of the pixel circuits 2*a* to 2*h* are shown in FIGS. 22 to 29.

In order to discriminate the pixel circuits of the groups X and Y, the reference symbols 2*a* to 2*h* of the pixel circuits of the group Y are expressed by using lower-case alphabets. For the descriptive convenience in the second embodiment, a node connected to the control terminal of the transistor T3 is described as N3.

In examples shown in FIGS. 22 to 29, the delay circuit 31 is configured by delay transistors TD1 and TD2 each having a first terminal, a second terminal, and a control terminal. The first terminal of the delay transistor TD1 is connected to the control terminal of the transistor T3, and the second terminal and the control terminal are connected to the selecting line SEL. The first terminal of the delay transistor TD2 is connected to the control terminal of the transistor T3, the second terminal is connected to the selecting line SEL, and the control terminal is connected to the reference line REF at a high voltage. The delay transistor TD1 corresponds to a "first delay transistor", and the delay transistor TD2 corresponds to a "second delay transistor".

In this case, the delay transistors TD1 and TD2 are formed on an amorphous silicon substrate. Since amorphous silicon has a very low electronic mobility (that is thousand times lower than that of polysilicon), and a predetermined period of time is taken until the delay transistor TD1 is turned on after a voltage is applied to the selecting line SEL. Thus, in application of a voltage to the selecting line SEL, when the delay transistor TD2 is turned off in a direction from the selecting line SEL to the control terminal of the transistor T3 in advance, a timing at which the voltage is applied to the control terminal of the transistor T3 can be delayed for a predetermined period of time from a timing at which a voltage is applied to the selecting line SEL.

As will be described later in the second embodiment, in a self-refresh action, when the potential of the output node N2 is higher than that of the internal node N1 in a state in which a high-level voltage is applied to the control terminal of the transistor T2, the delay circuit 31 may delay the timing for a time required to make the potentials of both the nodes about equal to each other. The time corresponds approximately to a time required to cause electrons to flow from one terminal of the transistor T2 in an on state to the other terminal. On the other hand, a delay time (time required from when a pulse voltage is applied to the selecting line SEL to when the pulse voltage is applied to the control terminal of the transistor T3) generated by the delay circuit 31 is almost equal to a time required to cause electrons to flow from one terminal of the delay transistor TD1 in an on state to the other terminal. For this reason, when the transistor T2 and the delay transistor TD1 are made of the same material (amorphous TFT), a necessary and sufficient delay time can be secured by a simple circuit.

When the voltage application to the selecting line SEL is completed, a predetermined voltage is given to the reference line REF upon completion of the voltage application to cause the voltage given to the control terminal of the transistor T3 to flow into the selecting line SEL through the delay transistor TD2. In this manner, the potential of the control terminal of the transistor T3 also decreases to return to the state obtained before the pulse voltage is applied to the selecting line SEL.

Figure 30:
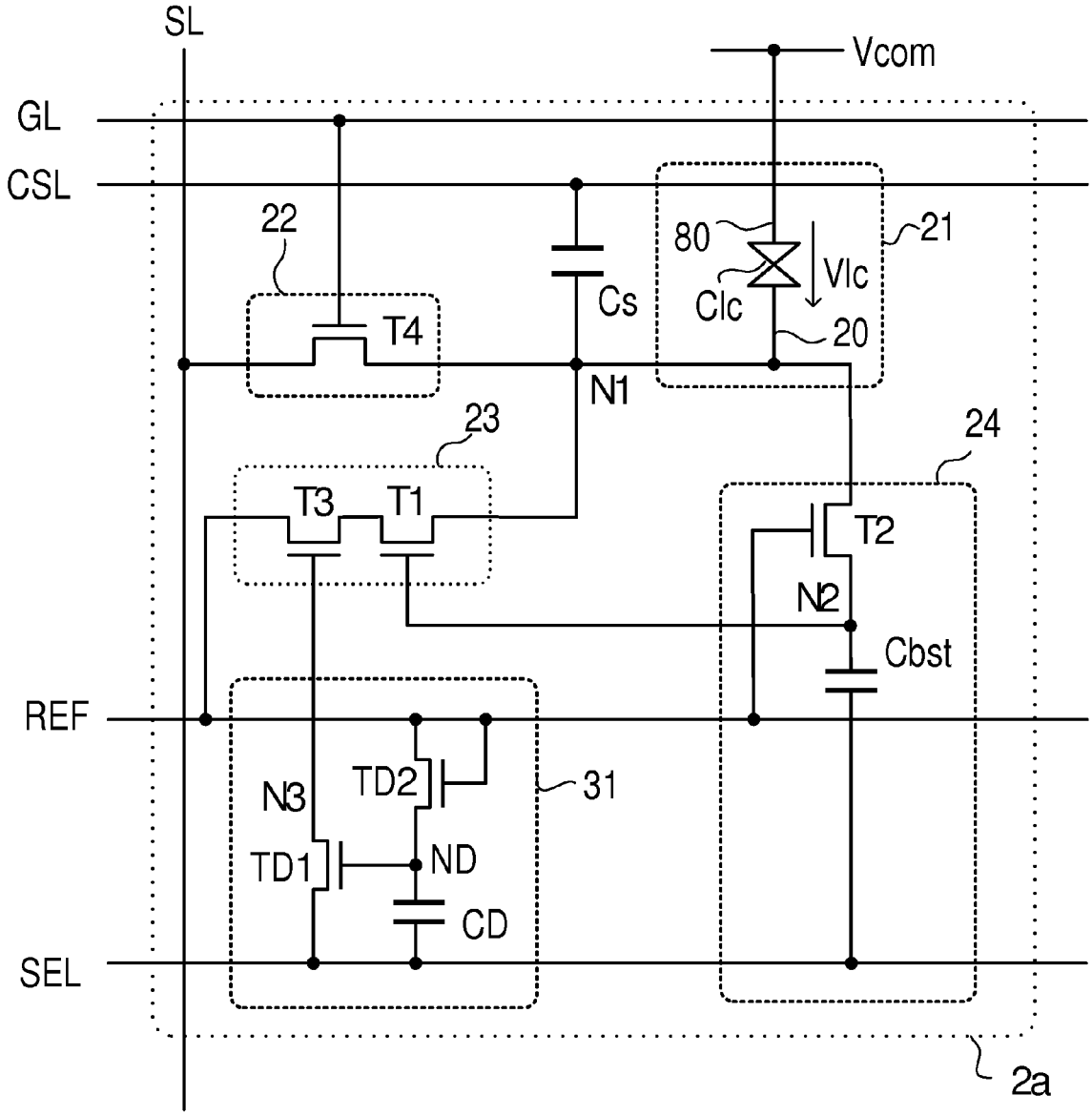
FIG. 30 is a circuit diagram showing another circuit configuration of a first type belonging to the group Y of the pixel circuit of the present invention.

The delay circuit 31 can employ not only the configurations shown in FIGS. 22 to 29 but also another configuration. FIG. 30 shows one configuration by using a pixel circuit 2*a* of the first type of the group Y as an example. When a pulse voltage is applied to the selecting line SEL, the potential of a node ND is raised through the delay capacitor element CD. When a predetermined range of potential is given to the node ND before the pulse voltage is applied, the potential raising causes the delay transistor TD1 to turn on, and a pulse voltage is given to the control terminal of the transistor T3 through the delay transistor TD1 in late.

In the configuration, when the pulse voltage application to the selecting line SEL is completed, the potential of the node ND decreases, and the delay transistor TD1 is turned off. On the other hand, when a predetermined voltage is given to the reference line REF in advance, a voltage that is higher than or equal to a threshold voltage is generated between the source and the gate of the delay transistor TD2. For this reason, the delay transistor TD2 is turned on. In this manner, the voltage given to the control terminal of the transistor T3 flows into the selecting line SEL through the delay transistor TD2. Thus, the potential of the control terminal of the transistor T3 decreases to return to a state obtained before the pulse voltage is applied to the selecting line SEL.

In the following description, the delay transistors TD1 and TD2 have threshold voltages of 2 V like the transistors T1 to T4.

[Second Embodiment]

In the second embodiment, self-refresh actions performed by the pixel circuits of the first to eighth types of the groups X and Y described above will be described with reference to the accompanying drawings.

The self-refresh action is an action in an always-on display mode, and is an action in which the first switch circuit 22, the second switch circuit 23, and the control circuit 24 are operated by a predetermined sequence in the plurality of pixel circuits 2 to recover potentials of the pixel electrodes 20 (or potentials of the internal nodes N1) to a potential written by an immediately previous writing action at the same time in a lump. The self-refresh action is an action being unique to the present invention and performed by the pixel circuits. The self-refresh action can achieve a very low power consumption in comparison with an "external refresh action" that performs a normal writing action as in the conventional technique to recover the potential of the pixel electrode 20. The term "the same time" in the phrase "at the same time in a lump" is "the same time" having a time range of a series of self-refresh actions.

In the conventional technique, the writing action is performed to perform an action (external polarity inverting action) that inverts only a polarity of a liquid crystal voltage Vcl applied across the pixel electrode 20 and the counter electrode 80 while maintaining an absolute value of the liquid crystal voltage Vcl. When the external polarity inverting action is performed, the polarity is inverted, and the absolute value of the liquid crystal voltage Vcl is also updated to an absolute value in an immediately previous writing state. More specifically, polarity inversion and refreshing are simultaneously performed. For this reason, although it is not general that a refresh action is executed by the writing action in order to update only the absolute value of the liquid crystal voltage Vcl without inverting the polarity, in the following explanation, for descriptive convenience, in terms of comparison with the self-refresh action, it is assumed that such refresh action is called an "external refresh action".

Also, when the refresh action is executed by the external polarity inverting action, the writing action is still performed. More specifically, in comparison with the conventional method, a very low power consumption can also be achieved by the self-refresh action according to the embodiment.

Voltages are applied to all the gate lines GL, the source lines SL, the selecting lines SEL, the reference lines REF, the auxiliary capacitive lines CSL, and the boost lines BST that are connected to the pixel circuit 2 targeted by the self-refresh action, and the counter electrode 80 at the same timing. When the voltage supply line VSL is arranged as an independent signal line, voltage application to the voltage supply line VSL is performed at the same timing. At the same timing, the same voltage is applied to all the gate lines GL, the same voltage is applied to all the reference lines REF, the same voltage is applied to all the auxiliary capacitive lines CSL, and the same voltage is applied to all the boost lines BST. When the voltage supply lines VSL are arranged as independent signal lines, the same voltage is applied to all the voltage supply lines VSL. The timing control of the voltage applications is performed by the display control circuit 11, and each of the voltage applications is performed by the display control circuit 11, the counter electrode drive circuit 12, the source driver 13, and the gate driver 14.

In the always-on display mode according to the embodiment, since two-tone (binary) pixel data is held in units of pixel circuits, a potential VN1 held in the pixel electrode 20 (internal node N1) exhibits two voltage states including a first voltage state and a second voltage state. In the embodiment, like the counter voltage Vcom described above, the first voltage state and the second voltage state will be explained as a high level (5 V) and a low level (0 V), respectively.

In a state immediately previous to the execution of the self-refresh action, it is supposed that a pixel in which the pixel electrode 20 is written with a high-level voltage and a pixel in which the pixel electrode 20 is written with a low-level voltage are mixed. However, according to the self-refresh action of the embodiment, even though the pixel electrode 20 is written with any one of high-level and low-level voltages, a voltage applying process based on the same sequence is performed to make it possible to execute a refresh action to all the pixel circuits. The contents will be described below with reference to a timing chart and a circuit diagram.

In the following description, a case in which a voltage in the first voltage state (high-level voltage) is written in an immediately previous writing action and the high-level voltage is recovered is called a "case H", and a case in which the second voltage state (low-level voltages) is written in the immediately previous writing action and the low-level voltage is recovered is called a "case L".

<1. Group X>

A self-refresh action for each pixel circuit in which the boost line BST is connected to the second terminal of the boost capacitor element Cbst and that belongs to the group X will be described first.

(First Type)

Figure 31:
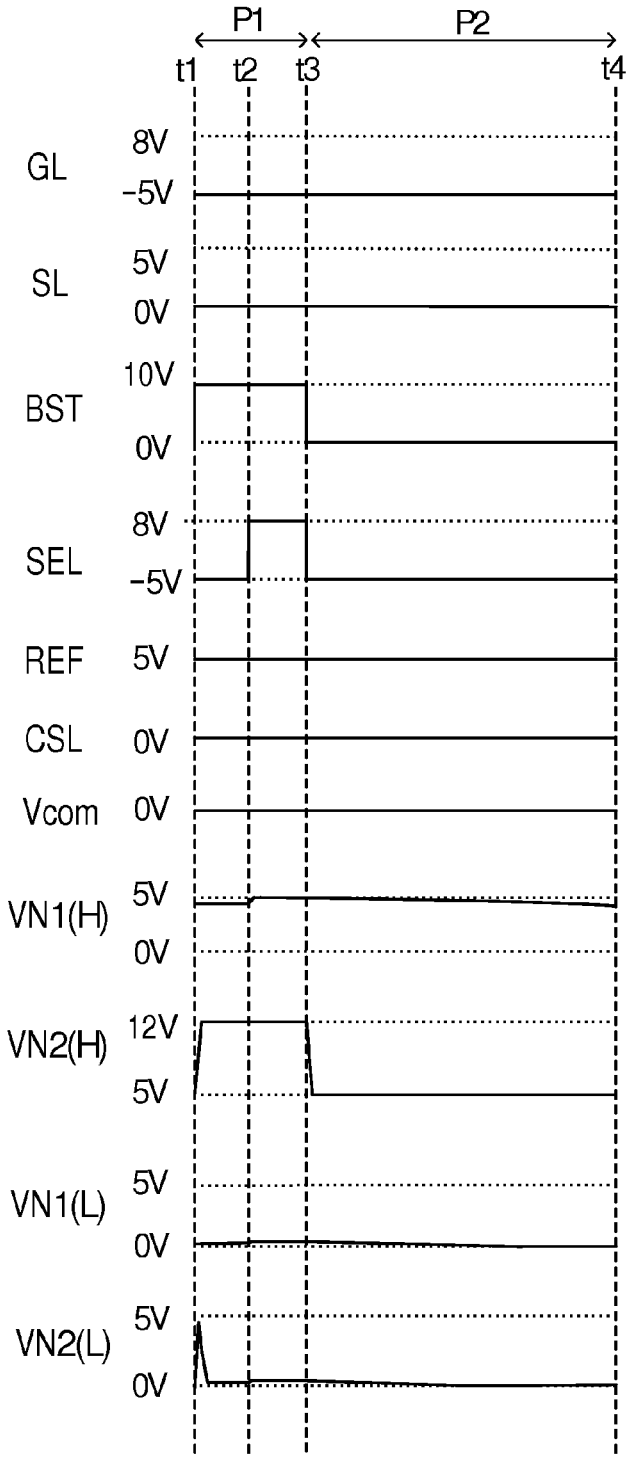
FIG. 31 is a timing chart of a self-refresh action performed by the pixel circuits of the first and fifth types of the group X.

FIG. 31 shows a timing chart of a self-refresh action in the pixel circuit 2A of the first type. As shown in FIG. 31, the self-refresh action is divided into two phases P1 and P2 depending on whether a pulse voltage is applied to the boost line BST.

In the phase P1, after application of a pulse voltage to the boot line BST is started (time t1), and a pulse voltage is slightly belatedly applied to the selecting line SEL (time t2). Start time of the phase P2 is represented by t3.

FIG. 31 shows voltage waveforms of all the gate lines GL, the source lines SL, the selecting lines SEL, the reference lines REF, the auxiliary capacitive lines CSL, and the boost lines BST that are connected to the pixel circuit 2A targeted by the self-refresh action, and a voltage waveform of the counter voltage Vcom. In the embodiment, all the pixel circuits of the pixel circuit array are targeted by the self-refresh action.

Furthermore, in FIG. 31, waveforms showing changes of potentials (pixel voltages) VN1 of the internal nodes N1 and potentials VN2 of the output node N2 in the cases H and L and ON/OFF states of the transistors T1 to T4 are shown. In FIG. 31, a corresponding case is specified by a symbol in parentheses. For example, reference symbol VN1 (H) denotes a waveform showing a change of a potential VN1 in the case H.

It is assumed that, before time (t1) at which the self-refresh action is started, high-level writing is performed in the case H, and low-level writing is performed in the case L.

When a time has elapsed after the writing action is executed, the potential VN1 of the internal node N1 varies with generation of leakage currents of the transistors in the pixel circuit. In the case H, the VN1 is 5 V immediately after the writing action. However, the value decreases to a value lower than the initial value with time. This is because a leakage current mainly flows toward a low potential (for example, ground line) through a transistor in an OFF state.

In the case L, immediately after the writing action, the potential VN1 is at 0 V. However, the potential may slightly increase with time. This is because a writing voltage is applied to the source line SL in a writing action in another pixel circuit, for example, to cause a leakage current to flow from the source line SL to the internal node N1 through a turned-off transistor even in a non-selected pixel circuit.

In FIG. 31, at time t1, the VN1 (H) is shown as a potential slightly lower than 5 V, and the VN1 (L) is shown as a potential slightly higher than 0 V. These potentials are set in consideration of the potential variations described above.

Voltage levels applied to the lines in units of phases will be described below.

<<Phase P1>>

In a phase P1 started from time t1, a voltage is applied to a gate line GL1 such that the transistor T4 is completely turned off. The voltage is set to −5 V.

A voltage (5 V) corresponding to the first voltage state is applied to the reference line REF. The voltage is a voltage value such that the transistor T2 is turned off when the voltage state of the internal node N1 is at a high level (case H) and the transistor T2 is turned on when the voltage state is at a low level (case L).

A voltage (0 V) corresponding to the second voltage state is applied to the source line SL.

The counter voltage Vcom applied to the counter electrode 80 and a voltage applied to the auxiliary capacitive line CSL are set to 0 V. The above description means that the voltage is not limited to 0 V but still kept at a voltage value obtained at a point of time before time t1.

As will be described later in the third embodiment, since the transistor T2 is turned on in the writing action, the nodes N1 and N2 are set to high-level potentials (5 V) in the case H in which high-level writing is performed, and the nodes N1 and N2 are set to low-level potentials (0 V) in the case L in which low-level writing is performed.

Upon completion of the writing action, the transistor T2 is turned off. However, since the node N1 is disconnected from the source line SL, the potentials of the nodes N1 and N2 are still held. More specifically, the potentials of the nodes N1 and N2 immediately before time t1 are approximately 5 V in the case H and are approximately 0 V in the case L. The word "approximately" is a description given in consideration of a variation in potential by generation of a leakage current.

When a voltage of 5 V is applied to the reference line REF at time t1, the nodes N1 and N2 are approximately 5 V in the case H. For this reason, a voltage Vgs between the gate and the source of the transistor T2 approximately becomes 0 V and is lower than a threshold voltage of 2 V, so that the transistor T2 is turned off. In contrast to this, in the case L, since the nodes N1 and N2 configuring the drain or the source of the transistor T2 are approximately set to 0 V, the voltage Vgs between the gate and the source of the transistor T2 approximately becomes 5 V and is higher than a threshold voltage of 2 V, so that the transistor T2 is turned on.

Specifically, in the case H, the transistor T2 needs not be completely in an off state, and electricity needs only be prevented from being conducted at least from the node N2 to the node N1.

To the boost line BST, a high-level voltage is applied such that the transistor T1 is turned on when the voltage state of the node N1 is a high level (case H) and the transistor T1 is turned off when the voltage state is a low level (case L).

The boost line BST is connected to one end of the boost capacitor element Cbst. For this reason, when a high-voltage level is applied to the boost line BST, the potential of the other end of the boost capacitor element Cbst, i.e., the potential of the output node N2 is raised. In this manner, it will be called "boost rising" that the voltage applied to the boost line BST is increased to raise the potential of the output node N2.

As described above, in the case H, the transistor T2 is in an off state at time t1 in the case H. For this reason, a variation in potential of the node N2 caused by boost rising is determined by a ratio of a boost capacity Cbst to a full capacity parasitic in the node N2. As an example, when the ratio is 0.7, a potential of one electrode of a boost capacitor element increases by ΔVbst, and a potential of the other electrode, i.e., the potential of the node N2, consequently increases by about 0.7 ΔVbst.

Since the internal node potential VN1 (H) approximately exhibits 5 V at time t1, when a potential that is higher than the potential VN1 by a threshold voltage of 2 V or more is applied to the gate of the transistor T1, i.e., the output node N2, the transistor T1 is turned on. In the embodiment, a voltage applied to the boost line BST at time t1 is set to 10 V. In this case, the output node N2 consequently increases by 7 V. At a point of time immediately before time t1, since the potential VN2 (H) of the output node N2 exhibits a potential (5 V) almost equal to that of the VN1 (H), the node N2 exhibits about 12 V by boost rising. Thus, since a potential difference that is equal to or higher than a threshold voltage is generated between the gate of the transistor T1 and the node N1, the transistor T1 is turned on.

On the other hand, in the case L, the transistor T2 is turned on at time t1. More specifically, unlike in the case H, the output node N2 and the internal node N1 are electrically connected to each other. In this case, a variation of the potential VN2 (L) of the output node N2 caused by boost rising is influenced by, in addition to a boost capacity Cbst and a full parasitic capacity of the node N2, a full parasitic capacity of the internal node N1.

One end of the auxiliary capacitor element Cs and one end of the liquid crystal capacitor element Clc are connected to the internal node N1, and a full capacity Cp being parasitic in the internal node N1 is approximately expressed by a sum of the liquid crystal capacity Clc and the auxiliary capacity Cs as described above. The boost capacity Cbst has a value that is considerably smaller than that of a liquid crystal capacity Cp. Therefore, a ratio of the boost capacity to the total of capacities is very low, for example, a value of about 0.01 or less. In this case, when a potential of one electrode of the boost capacitor element increases by ΔVbst, a potential of the other electrode, i.e., the potential of the output node N2 increases by only about 0.01ΔVbst at most. More specifically, even though ΔVbst=10 V, the potential VN2 (L) of the output node N2 hardly theoretically increases.

However, in fact, as shown in FIG. 31, it is supposed that the potential VN2 (L) varies in a predetermined short period of time after time t1 at which a pulse voltage application to the boost line BST is started. This is because the transistor T2 in the pixel circuit 2*a* is configured by an amorphous silicon TFT having a low electron mobility. This point will be described in comparison with a case in which the transistor T2 is formed by a polysilicon TFT having a high electron mobility.

When a pulse voltage is applied to the boost line BST when the internal node N1 is in the second voltage state, even though the transistor T2 is a polysilicon TFT or an amorphous silicon TFT, the potential VN2 of the output node is raised for a very short period of time.

However, when the transistor T2 is formed by a polysilicon having a high electron mobility, a current instantaneously flows from the output node N2 the potential of which is raised to the internal node N1 through the transistor T2 to set both the nodes at the same potential. For this reason, as a result, the potential VN2 of the output node hardly changes from the potential before the pulse voltage is applied.

In contrast to this, when the transistor T2 is formed by an amorphous silicon having a low electron mobility, after the potential VN2 of the output node is raised, a predetermined period of time is required until a current flows from the output node N2 to the internal node N1 to set both the nodes at the same potential. Meanwhile, the potential VN2 of the output node is increased by an influence of the pulse voltage given to the boost line BST. Thereafter, when a predetermined period of time has elapsed, the potential decreases to the potential VN1 (L) of the internal node again to return to the state obtained before the pulse voltage is applied. The potential VN2 (L) in FIG. 31 changes such that the potential VN2 (L) rises from time t1 and then returns to the state before the pulse voltage is applied again for the above described reason.

The conducting state of the transistor T1 is influenced by the potential VN2 of the output node N2. In the case H, since the potential VN2 (H) is a high potential for a period from times t1 to t2 as described above, the transistor T1 is continuously kept in an on state. On the other hand, in the case L, the transistor T1 may be possibly turned on while the potential VN2 (L) rises. However, thereafter, since the potential VN2 (L) returns to the state before the pulse voltage is applied, the transistor T1 exhibits an off state. In this manner, in order to suggest that the transistor T1 is not always continuously in an off state in a period from times t1 to t2 and may exhibits an on state for a certain period, in FIG. 31, T1(L) is described as "(OFF)" in parentheses to discriminate it from the off state simply described as "OFF".

Thereafter, a pulse voltage is given to the selecting line SEL at time t2. This voltage value may be a value required to turn on the transistor T3. The voltage is set to 8 V.

Time t2 must be at least later than time at which the potential VN2 of the output node N2 in the case L returns to a potential (about 0 V in this case) before the pulse voltage is applied to the boost line BST. A time required from when the pulse voltage is applied to the boost line BST to when the potential VN2 (L) returns to about 0 V corresponds to a time required from when the potential of the output node N2 increases to when the output node N2 and the internal node N1 have almost the same potential. This almost corresponds to a time required for electrons to move between the source and the drain of the transistor T2. Thus, a time τ1 required for electrons to move between the source and the drain is measured in advance by using a transistor formed by the same material (amorphous silicon) as that of the transistor T2, and time at which at least the time τ1 or more has elapsed from time t1 may be set as time t2.

When a voltage of 8 V is given to the selecting line SEL at time t2, the transistor T3 is turned on in both the cases H and L. In this case, in the case H, since the transistor T1 is also turned on, the second switch circuit 23 is turned on. Thus, 5 V is supplied from the reference line REF to the internal node N1 through the second switch circuit 23, and the potential VN1 of the internal node N1 returns to the first voltage state. This represents that, in FIG. 31, the potential VN1 (H) returns to 5 V when a short period of time has elapsed from time t2.

On the other hand, in the case L, since the VN2 (L) is in a low-potential state at a point of time t2, the transistor T1 is in an off state. Thus, the second switch circuit 23 is in an off state, and the voltage of 5 V applied to the reference line REF is not given to the node N1 through the second switch circuit 23. More specifically, the potential VN1 (L) of the node N1 still exhibits a value at a level almost equal to that at time t1, i.e., approximately 0 V.

As described above, in the phase P1, a refresh action is automatically selectively performed to the internal node N1 (H) in which writing was performed in the first voltage state.

In place of the timing chart in FIG. 31, when the timing of application of a pulse voltage to the selecting line SEL is set to the same as that of application to the boost line BST, the second switch circuit 23 is turned on while the potential VN2 (L) is a high potential in the case L, and a voltage of 5 V may be supplied from the reference line REF to the internal node N1. At this time, the potential VN1 (L) of the internal node changes from the second voltage state to the first voltage state to influence a liquid crystal display. When the electron mobility of the transistor T2 is low and it takes a while for the potential VN2 of the output node and the potential VN1 of the internal node to be almost equal to each other, as in the embodiment, the start of pulse voltage application to the selecting line SEL must be delayed by a predetermined period of time from the start of the pulse voltage application to the boost line BST (from t1 to t2). In each of the pixel circuits of the group X, this is realized by shifting the voltage application timings themselves.

<<Phase P2>>

In the phase P2 started from time t2, voltages applied to the gate line GL, the source line SL, the reference line REF, and the auxiliary capacitive line CSL and the counter voltage Vcom are set to the same values as those in the phase P1.

A voltage that turns off the transistor T3 is applied to the selecting line SEL. The voltage is set to −5 V. In this manner, the second switch circuit 23 is turned off.

A voltage applied to the boost line BST is decreased to a voltage in a state before boost rising is performed. The voltage is set to 0 V. When the voltage of the boost line BST decreases, a potential of the node N1 is dropped (VN2 (H)).

Also in the phase P2, the transistor T2 is in an on state in the case L. For this reason, the voltage of the boost line BST decreases, the potential VN2 (L) of the node N2 is hardly influenced and kept at almost 0 V. The node N1 and the node N2 exhibit the same potential.

In the phase P2, the same voltage state is maintained for a time considerably longer than that in the phase P1. Meanwhile, a low-level voltage (0 V) is applied to the source line SL. For this reason, by a leakage current generated through the transistor T4 meanwhile, the internal node potential VN1 (L) in the case L changes with time so as to approximate 0 V. More specifically, at a point of time immediately before time t1, even though a potential VN1 (L) of the internal node N1 in the case L is higher than 0 V, the potential changes toward 0 V in the period of the phase P2.

On the other hand, in the case H, the internal node potential VN1 (H) returns to 5 V by the phase P1. However, due to the presence of a leakage current thereafter, the potential gradually decreases with time.

As described above, in the phase P2, an action that causes the potential of the node N1 in which writing was performed in the second voltage state to be gradually close to 0 V is performed. A kind of indirect refresh action to the internal node N1 in which writing was performed in the second voltage state is performed.

Thereafter, the phases P1 and P2 are repeated to make it possible to return the potentials of the internal nodes N1 in both the cases H and L, i.e., pixel voltages to those in the immediately previous writing state.

As in the conventional technique, when a refresh action is to be performed by writing performed by voltage application through the source line SL, the gate lines GL need to be vertically scanned one by one. For this reason, a high-level voltage needs to be applied to the gate lines GL the number of times which is the number (n) of the gate lines. Since a potential having the same level as a potential level written in the immediately previous writing action needs to be applied to the source lines SL, charging or discharging actions need to be performed to each of the source lines SL up to n times.

In contrast to this, according to the embodiment, a pulse voltage is applied to each of the selecting line SEL and the boost line BST once while a predetermined voltage (5 V) is given to the reference line REF. Thereafter, when a low-level potential is only maintained, the internal node potential VN1 (potential of the pixel electrode 20) can be returned to the potential state in the writing action for all the pixels. More specifically, in a 1-frame period, in order to return the internal node potential VN1 of each of the pixels, the number of times of change of an applied voltage applied to each of the lines is only two (times t1 to t2 and times t2 to t3). Meanwhile, a low-level voltage need only be applied to all the gate lines GL.

Thus, according to the self-refresh action of the embodiment, in comparison with a normal external refresh action, the number of times of voltage application to the gate lines GL and the number of times of voltage application to the source lines SL can be considerably reduced. Furthermore, the control contents can also be simplified. For this reason, power consumptions of the gate driver 14 and the source driver 13 can be considerably reduced.

(Second Type)

Figure 32:
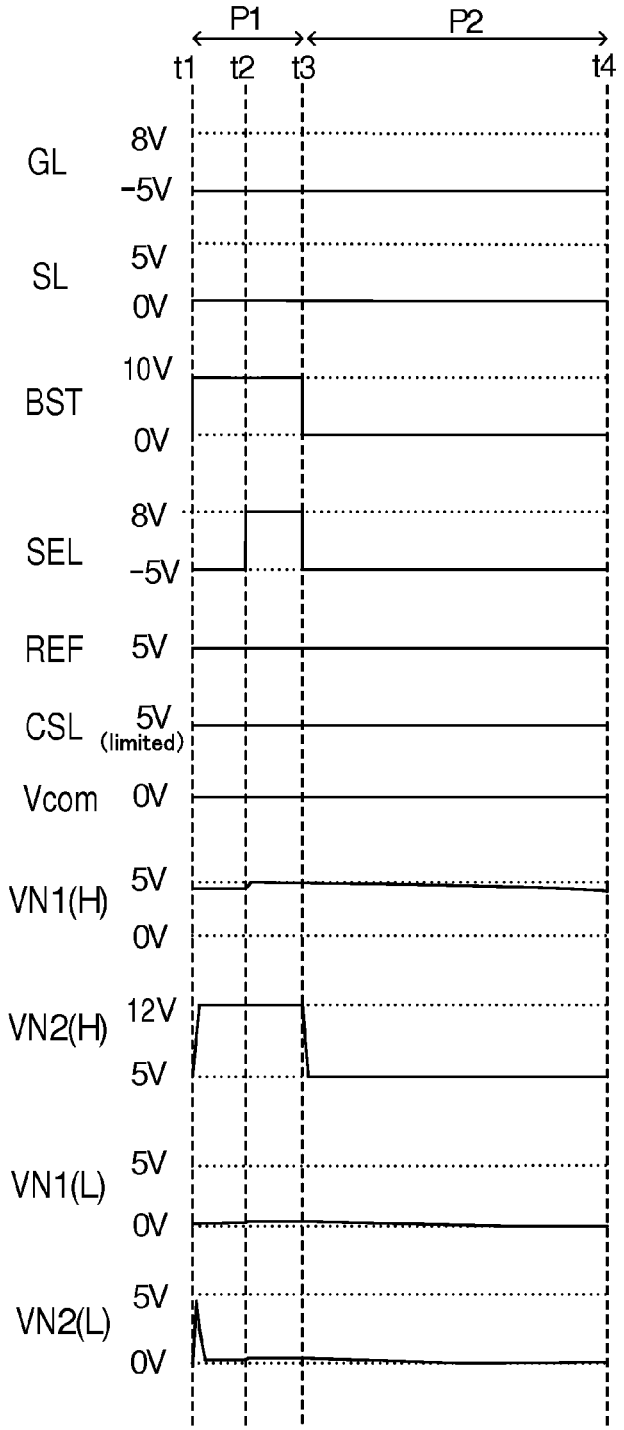
FIG. 32 is a timing chart of a self-refresh action performed by the pixel circuits of the second and sixth types of the group X.

The pixel circuit 2B of the second type shown in FIG. 11 has a configuration in which the auxiliary capacitive line CSL also serves as the voltage supply line VSL. For this reason, the second type is different from the first type in that a high-level voltage (5 V) in the first voltage state is applied to the auxiliary capacitive line CSL in the phase P1. FIG. 32 shows a timing chart of a self-refresh action state in the pixel circuit of the second type.

In the second type, as will be described later, in a writing action in an always-on display mode, a voltage applied to the auxiliary capacitive line CSL is fixed to any one of the first voltage state (5 V) and the second voltage state (0 V). In the type, a self-refresh action can be executed when a voltage of 5 V is applied to the auxiliary capacitive line CSL in writing. At this time, also in the self-refresh action, an applied voltage (5 V) to the auxiliary capacitive line CSL is fixed. The other configurations are the same as those in the first type shown in FIG. 31. In FIG. 32, "5 V (limited)" is expressed in a column for the applied voltage to the auxiliary capacitive line CSL to clearly show that 0 V cannot be employed as the applied voltage to the auxiliary capacitive line CSL.

In the configuration described above, in the case H, since both the transistors T1 and T3 are turned on from times t2 to t3, the voltage (5 V) in the first voltage state is given from the auxiliary capacitive line CSL to the internal node N1 through the second switch circuit 23 to perform a refresh action. In the case L, since the transistor T1 is in an off state from times t2 to t3, the second switch circuit 23 is in an off state. In this manner, the low-level voltage of the internal node N1 is maintained.

(Third Type)

Figure 33:
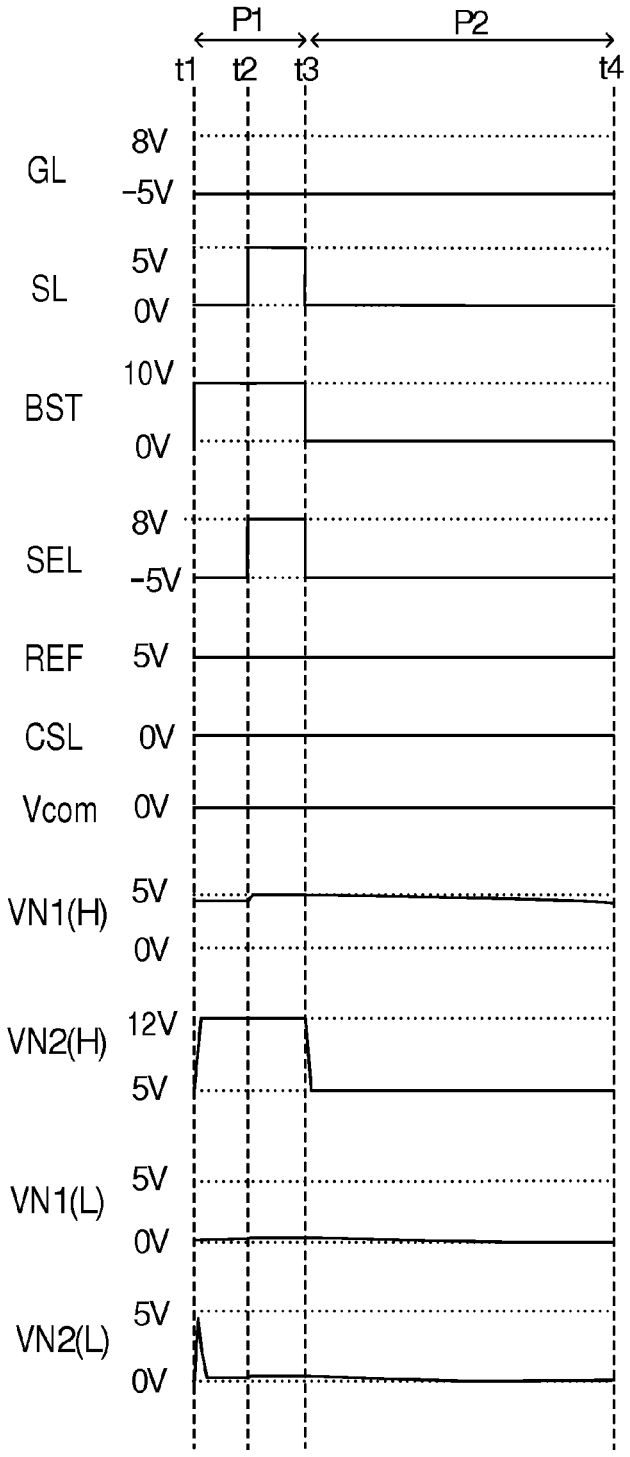
FIG. 33 is a timing chart of a self-refresh action performed by the pixel circuits of the third and seventh types of the group X.

The pixel circuit 2C of the third type shown in FIG. 12 has a configuration in which the source line SL also serves as the voltage supply line VSL. For this reason, the third type is different from the first type in that a high-level voltage (5 V) in the first voltage state is applied to the source line SL from times t2 to t3. FIG. 33 shows a timing chart of a self-refresh action state in the pixel circuit of the third type.

In FIG. 12, although 5 V is supplied to the source line SL in only the period from times t2 to t3, 5 V may be given to the source line SL from times t1 to t3.

In the case H, since both the transistors T1 and T3 are turned on from times t2 to t3, the voltage (5 V) in the first voltage state is given from the source line SL to the internal node N1 through the second switch circuit 23 to perform a refresh action. In the case L, since the transistor T1 is in an off state from times t2 to t3, the second switch circuit 23 is in an off state. In this manner, the low-level voltage of the internal node N1 is maintained.

(Fourth Type)

Figure 34:
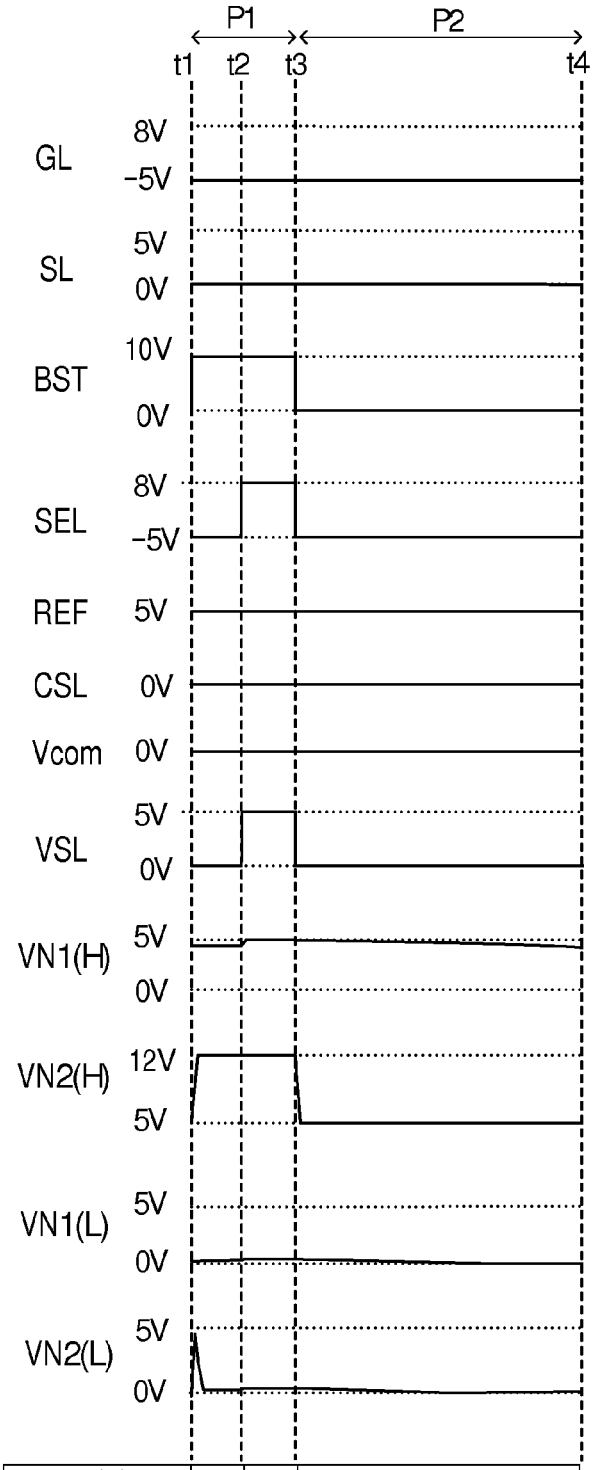
FIG. 34 is a timing chart of a self-refresh action performed by the pixel circuits of the fourth and eighth types of the group X.

The pixel circuit 2D of the fourth type shown in FIG. 13 has a configuration in which another signal line does not serves as the voltage supply line VSL and the voltage supply line VSL is independently arranged. For this reason, the fourth type is different from the first type in that a high-level voltage (5 V) in the first voltage state is applied to the voltage supply line VSL from times t2 to t3 and a low-level voltage (0 V) in the second voltage state is applied in the phase P2. FIG. 34 shows a timing chart of a self-refresh action state in the pixel circuit of the fourth type.

In FIG. 34, although 5 V is supplied to the voltage supply line VSL in only the period from times t2 to t3, 5 V may be given to the voltage supply line VSL from times t1 to t3. Furthermore, 5 V may be continuously supplied to the voltage supply line VSL from times t1 to t4.

In the case H, since both the transistors T1 and T3 are turned on from times t2 to t3, the voltage (5 V) in the first voltage state is given from the voltage supply line VSL to the internal node N1 through the second switch circuit 23 to perform a refresh action. In the case L, since the transistor T1 is in an off state from times t2 to t3, the second switch circuit 23 is in an off state. In this manner, the low-level voltage of the internal node N1 is maintained.

(Fifth Type)

The pixel circuit 2E of the fifth type shown in FIG. 14 is similar to the pixel circuit 2A of the first type in that the reference line REF also serves as the voltage supply line VSL. More specifically, in the period from times t2 to t3 in the phase P1, in the case H, 5 V is given from the reference line REF to the internal node N1 through the second switch circuit 23 to execute a refresh action. On the other hand, in the case L, in the period from times t2 to t3, the transistor T1 is turned off to turn off the second switch circuit 23, and 5 V is prevented from being supplied from the reference line REF to the internal node N1.

In the fifth type, the transistor T3 also configures one element of the first switch circuit 22. However, the transistor T4 is turned off in the phase P1 to make it possible to turn off the first switch circuit 22. For this reason, the transistor T3 is turned on without a problem. This is also applied to a modification of the pixel circuit of the fifth type shown in FIGS. 15 and 16.

Based on the above circumstances, the pixel circuit 2E of the fifth type can execute a self-refresh action by the same voltage applying method as that in the pixel circuit 2A of the first type shown in the timing chart of FIG. 31.

(Sixth Type)

The pixel circuit 2F of the sixth type shown in FIG. 17 is similar to the pixel circuit 2B of the second type in that the auxiliary capacitive line CSL also serves as the voltage supply line VSL. A different point between the pixel circuits of the second type and the sixth type is the same as a different point between the pixel circuits of the first type and the fifth type.

Thus, according to the same theory as that in the fifth type, the pixel circuit 2F of the sixth type can execute a self-refresh action by the same voltage applying method as that in the pixel circuit 2B of the second type shown in the timing chart of FIG. 32.

(Seventh Type)

The pixel circuit 2G of the seventh type shown in FIG. 18 is similar to the pixel circuit 2C of the third type in that the source line SL also serves as the voltage supply line VSL. A different point between the pixel circuits of the third type and the seventh type is the same as a different point between the pixel circuits of the first type and the fifth type.

Thus, according to the same theory as that in the fifth type, the pixel circuit 2F of the seventh type can execute a self-refresh action by the same voltage applying method as that in the pixel circuit 2C of the third type shown in the timing chart of FIG. 33. This is similarly applied to the circuit configurations in FIG. 19 and FIG. 20.

(Eighth Type)

The pixel circuit 2H of the eighth type shown in FIG. 21 is similar to the pixel circuit 2D of the fourth type in that the voltage supply line VSL is configured by an independent signal line. A different point between the pixel circuits of the fourth type and the eighth type is the same as a different point between the pixel circuits of the first type and the fifth type.

Thus, according to the same theory as that in the fourth type, the pixel circuit 2H of the eighth type can execute a self-refresh action by the same voltage applying method as that in the pixel circuit 2D of the fourth type shown in the timing chart of FIG. 34.

<2. Group Y>

A self-refresh action will be described below with respect to each pixel circuit that belongs to a group Y and have a configuration in which the selecting line SEL is connected to the second terminal of the boost capacitor element Cbst and the control terminal of the transistor T3 is connected to the selecting line SEL through the delay circuit 31.

In the timing charts of the self-refresh actions in the pixel circuits of the group X shown in FIGS. 31 to 34, after a pulse voltage is applied to the boost line BST, a pulse voltage is applied to the selecting line SEL after the potential VN2 (L) reliably returns to a low potential. This is a method that can be realized only when the boost line BST and the selecting line SEL are different signal lines.

In the group Y, both the second terminal of the boost capacitor element Cbst and the control terminal of the transistor T3 are connected to the selecting line SEL. Thus, a timing at which the potential VN2 of the output node increases by boost rising and a timing at which the transistor T3 is turned on cannot be realized by shifting a voltage application timing to the signal line. For this reason, as described above, in each of the pixel circuits of the group Y, the delay circuit 31 is arranged between the selecting line SEL and the transistor T3, and a predetermined delay time is required, after a pulse voltage is applied to the selecting line SEL, until the pulse voltage is given to the control terminal of the transistor T3.

More specifically, time at which a pulse voltage for "boost rising" is applied to the selecting line SEL is defined as t1, and time at which the voltage is supplied to the control terminal of the transistor T3 through the delay circuit 31 and a potential of the node N3 (node formed by the control terminal of the transistor T3) increases to a level required to turn on the transistor T3 is defined as t2. In this case, it can be understood that a self-refresh action can be realized by the same theory as that of the group X.

Figure 35:
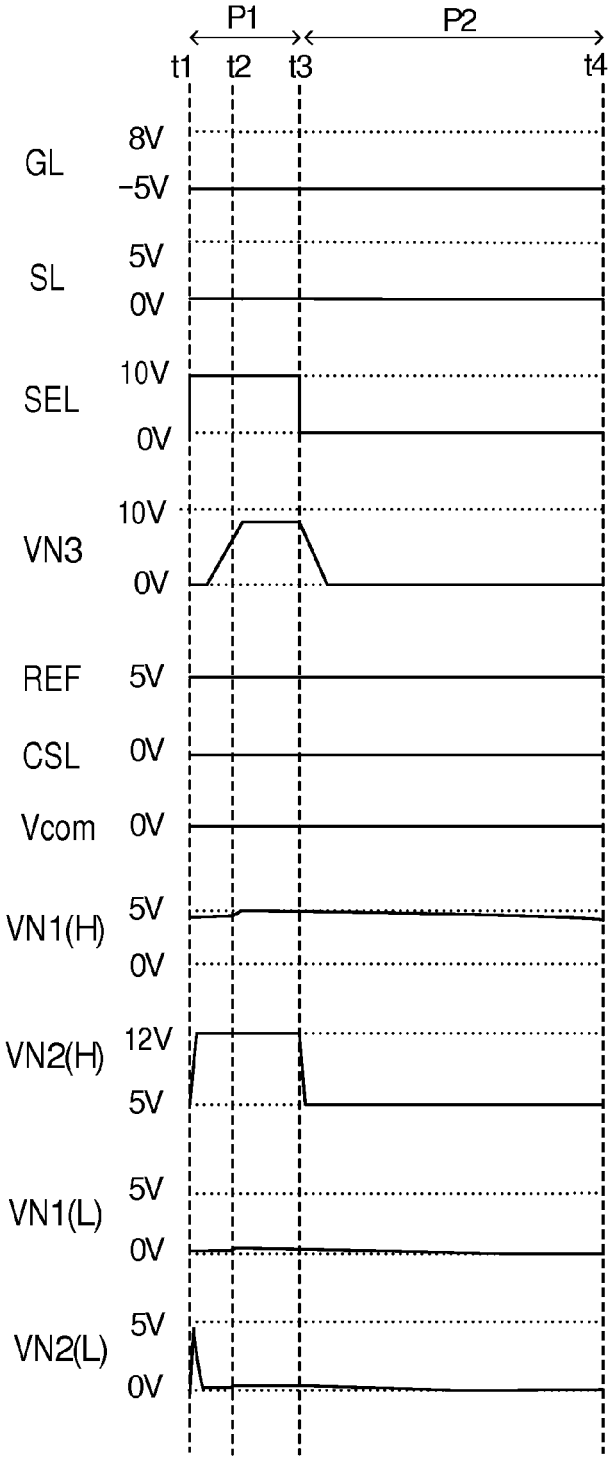
FIG. 35 is a timing chart of a self-refresh action performed by the pixel circuits of the first and fifth types of the group Y.

FIG. 35 shows a timing chart in the pixel circuit 2*a* of the first type. In comparison with the group X, FIG. 35 shows a potential of the node N3 with respect to a change of the potential VN3. In the group X, since the selecting line SEL is directly connected to the control terminal of the transistor T3, a change in potential of the control terminal of the transistor T3 directly corresponds to a change of an applied voltage to the selecting line SEL.

In FIG. 35, it is assumed that the applied voltage to the selecting line SEL increases from 0 V to 10 V at time t1. This intends to make the amplitude equal to the amplitude (10 V) of an applied voltage to the boost line BST in the group X for comparison. However, the amplitude needs not be always set to 10 V as a matter of course. As in the group X, before time t1, and after time t3, in order to reliably turn off the transistor T3, a negative voltage (−5 V) may be applied to the selecting line SEL. However, in this case, at a point of time between time t2 and time t3, in order to turn on the transistor T3, at least a voltage of about 7 V must be applied. In this case, boost rising for the output node N1 is larger than that in the group X.

At time t1, 10 V is applied to the selecting line SEL. At this time, since 5 V is given from the reference line REF to the control terminal of the delay transistor TD2, a current flows from the selecting line SEL to the node N3 through the TD2, so that the potential VN3 of the node N3 begins to increase. However, since the delay transistor TD2 is an amorphous TFT having a low electron mobility, the potential of the node N3 begins to gradually increase shortly after time t1.

Since the delay transistor TD 1 forms a diode connection in a direction from the selecting line SEL to the node N3, the potential of the node N3 also increases through the delay transistor TD1. When the potential of the node N3 becomes 3 V or more, the delay transistor TD2 is cut off, and a voltage is supplied from the selecting line SEL mainly through the transistor TD1. Since the delay transistor TD1 is an amorphous TFT having a low electron mobility, a predetermined period of time is required until a current flowing from the selecting line SEL to the node N3 through the transistor TD1 is generated.

In this manner, the potential of the node N3 is gradually increased after a delay of a predetermined period of time from time t1, and exceeds a potential required to turn on the transistor T3 at a certain time t2. Thereafter, when the potential of the node N3 reaches a potential lower than the applied voltage to the selecting line SEL by a threshold voltage of the delay transistor TD1, the potential is maintained.

In the group Y, since one end of the boost capacitor element Cbst is connected to the selecting line SEL, when a pulse voltage is applied to the selecting line SEL at time t1, boost rising occurs for the output node N2. In the case H, since the transistor T2 is turned off, the potential VN2 (H) is raised, and the potential is maintained. On the other hand, in the case L, after the potential VN2 (L) is temporarily increased due to the low mobility of the transistor T2, the potential decreases to the same potential (almost 0 V) as that of the internal node N1 through the transistor T2 in an on state, and the value is held. Since manners of variations of the potentials VN2 (H) and the VN2 (L) are not different from those in the group X, a detailed description thereof will be omitted.

More specifically, after at least a time required for the potential VN2 (L) to decrease to a potential level at which the transistor T1 is turned off has elapsed after time t1, when the transistor T3 is turned on, the transistors T1 and T3 are not simultaneously turned on in the case L. Thus, when a time (time from t1 to t2) required for the potential VN3 to increase to a potential required to turn on the transistor T3 is secured to be longer than the time required for the potential VN2 (L) to decrease to the voltage level at which the transistor T1 is turned off, the same voltage state as that in the group X can be realized. A required time between time t1 and time t2 can be adjusted by design values of the delay transistors TD1 and TD2.

Figure 36:
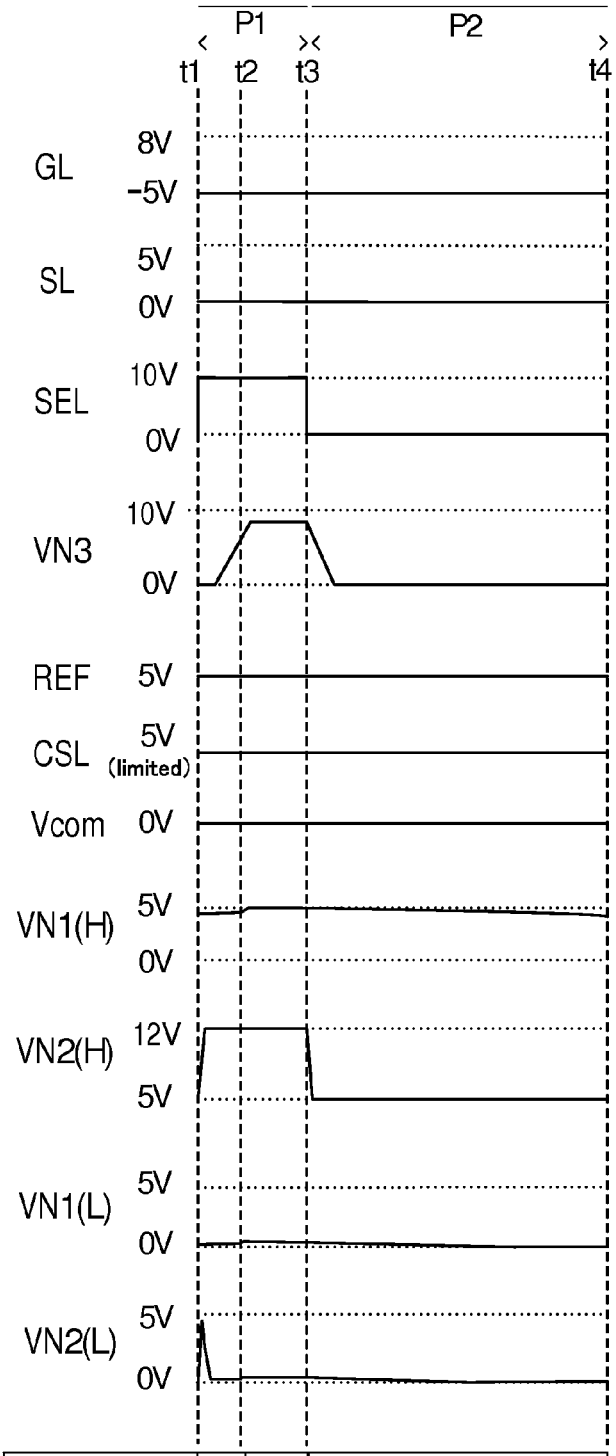
FIG. 36 is a timing chart of a self-refresh action performed by the pixel circuits of the second and sixth types of the group Y.
Figure 37:
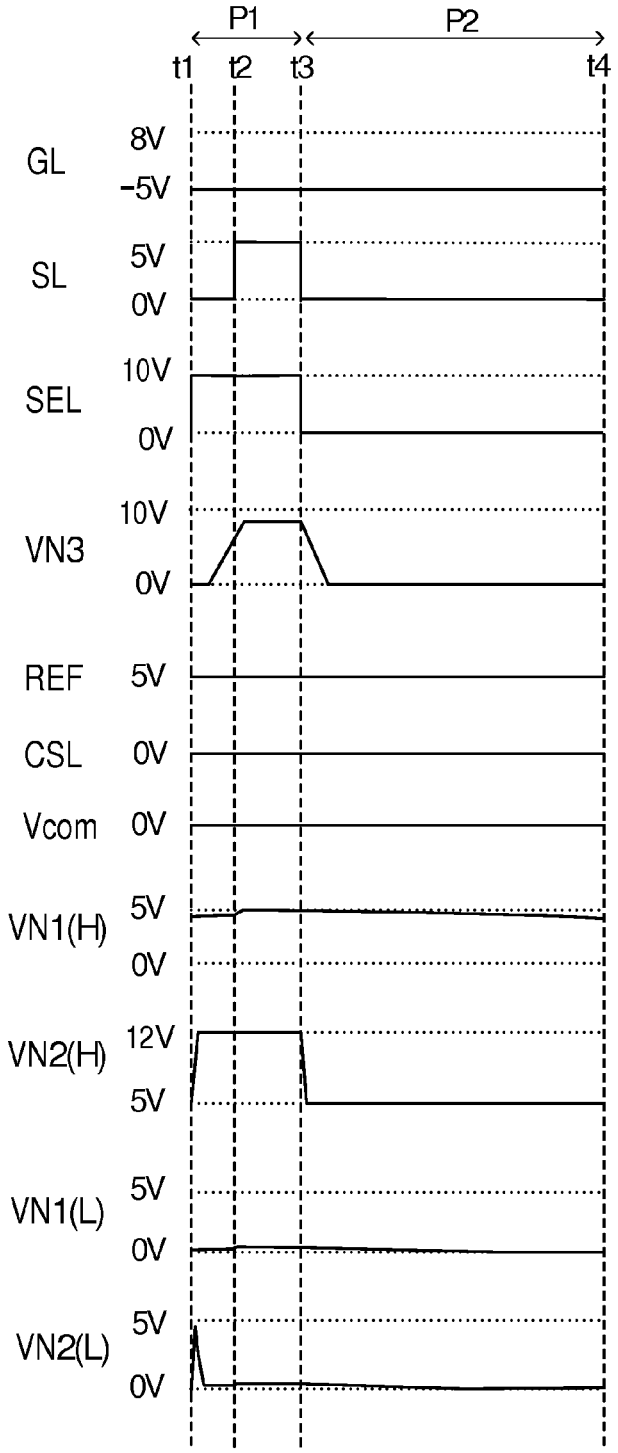
FIG. 37 is a timing chart of a self-refresh action performed by the pixel circuits of the third and seventh types of the group Y.
Figure 38:
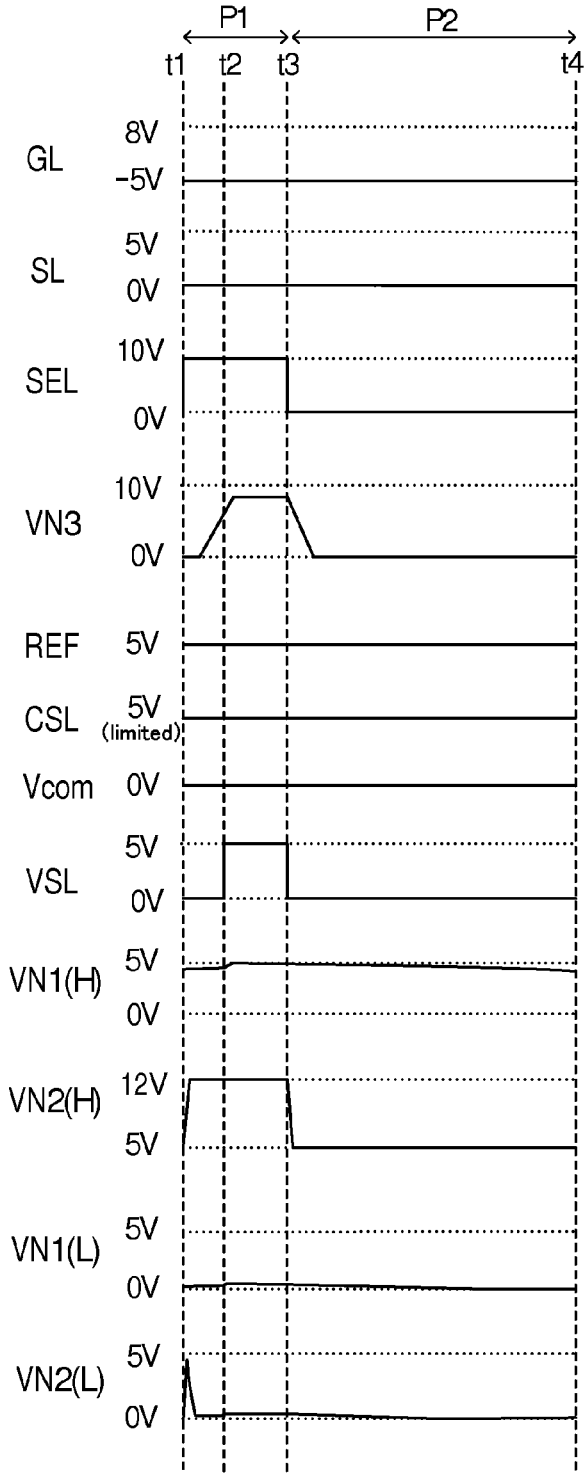
FIG. 38 is a timing chart of a self-refresh action performed by the pixel circuits of the fourth and eighth types of the group Y.

As described above, when the delay circuit 31 is arranged, time t1 at which the pulse voltage is applied to the selecting line SEL and time t2 at which a potential required to turn on the transistor T3 is supplied to the node N3 (control terminal of the transistor T3) can be made different from each other on purpose. In this manner, the same effect as that in the group X can be obtained. Since the second to eighth types can be explained by the same principle as that in the first type, only timing charts are shown, and description thereof will be omitted. FIGS. 36 to 38 show timing charts in the pixel circuits of the second to fourth types.

At this time, in the third type (FIG. 37), as described in the group X, a timing at which 5 V is supplied to the source line SL may be set to times t1 to t3. At this time, in the fourth type (FIG. 38), as described in the group X, a timing at which 5 V is supplied to the voltage supply line VSL may be set to times t1 to t3 or may be set to times t1 to t4.

The timing charts of the fifth to eighth types are the same as the timing charts of the first to fourth types, respectively, for the same reason as described in the group X, i.e., correspond to FIGS. 35 to 38, respectively.

In the case of the delay circuit 31 as shown in FIG. 30, a self-refresh action can be executed by the same voltage applying method as described above. A pixel circuit 2*a* of the first type shown in FIG. 30 will be exemplified.

As in the timing chart shown in FIG. 35, 5 V is applied to the reference line REF. Since the delay transistor TD2 has the first terminal (terminal on the opposite side of a node ND) and the control terminal that are connected to the reference line REF, a diode connection extending from the reference line REF to the node ND is formed, the voltage is decreased by the threshold voltage of the delay transistor TD2, and a potential of about 3V is given to the node ND.

A pulse voltage of 10 V is applied to the selecting line SEL at time t1. At this time, as described above, the potential of the node N2 is raised, and the potential of the node ND is also raised through a delay capacitor element CD. If a ratio of the capacity of the delay capacity element CD to a full capacity being parasitic in the nodes ND is about 0.8, the potential of the node ND increases by about 8 V and is a potential of about 11 V.

In this manner, the delay transistor TD1 having the control terminal connected to the node ND begins to be turned on. However, as described above, since the delay transistor TD1 is configured by an amorphous TFT having a low electron mobility, the voltage of the selecting line SEL is not immediately supplied to the node N3. More specifically, the potential VN3 of the node N3 is increased with time, and, when certain time t2 is passed, the potential reaches a potential level at which the transistor T3 can be turned on. Thereafter, when the potential of the node N3 that is equal to the potential of the node ND reaches a potential decreased by the threshold voltage of the delay transistor TD1, the potential is maintained.

Figure 22:
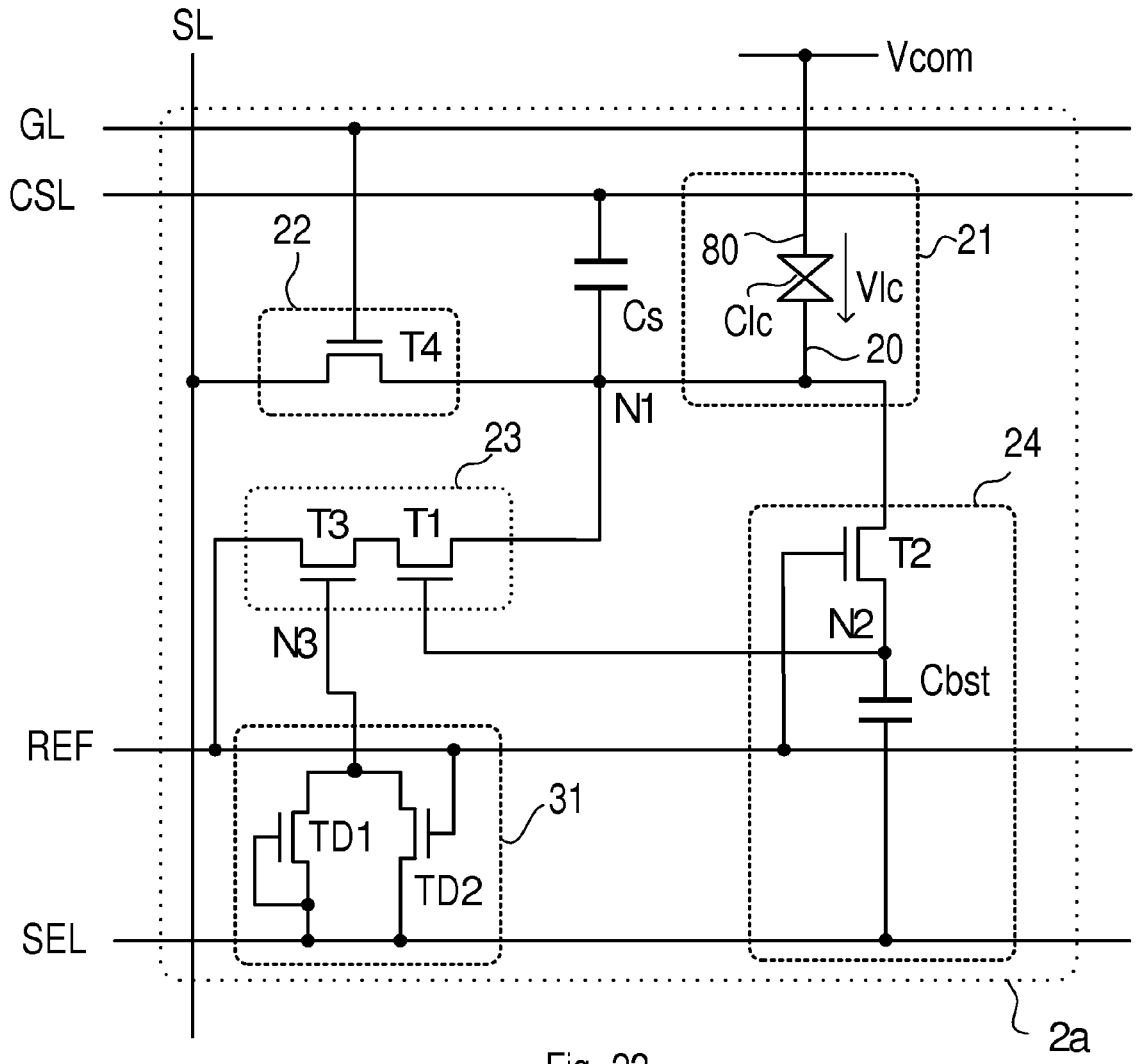
FIG. 22 is a circuit diagram showing a circuit configuration of a first type belonging to a group Y of the pixel circuit of the present invention.
Figure 23:
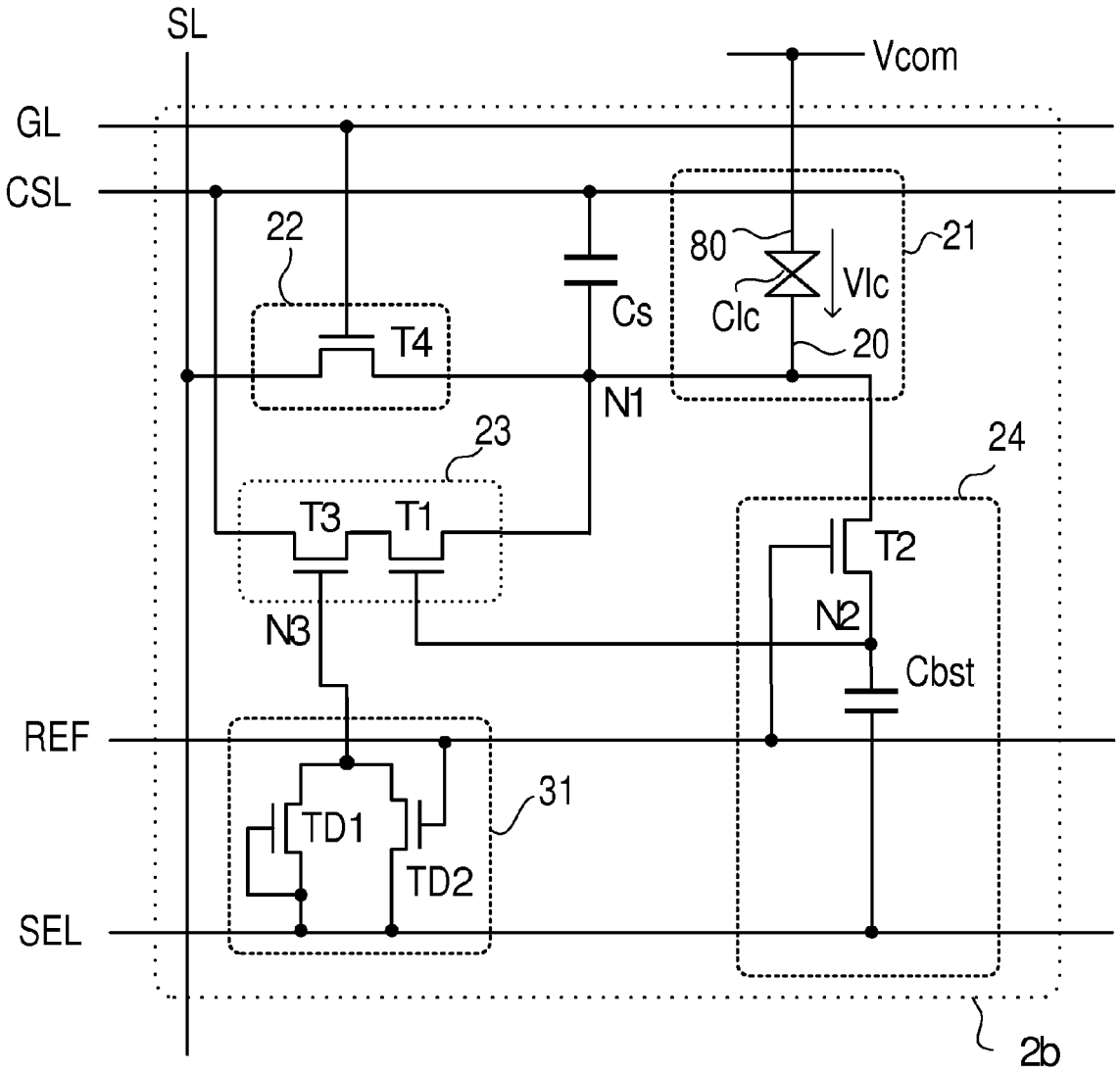
FIG. 23 is a circuit diagram showing a circuit configuration of a second type belonging to the group Y of the pixel circuit of the present invention.
Figure 24:
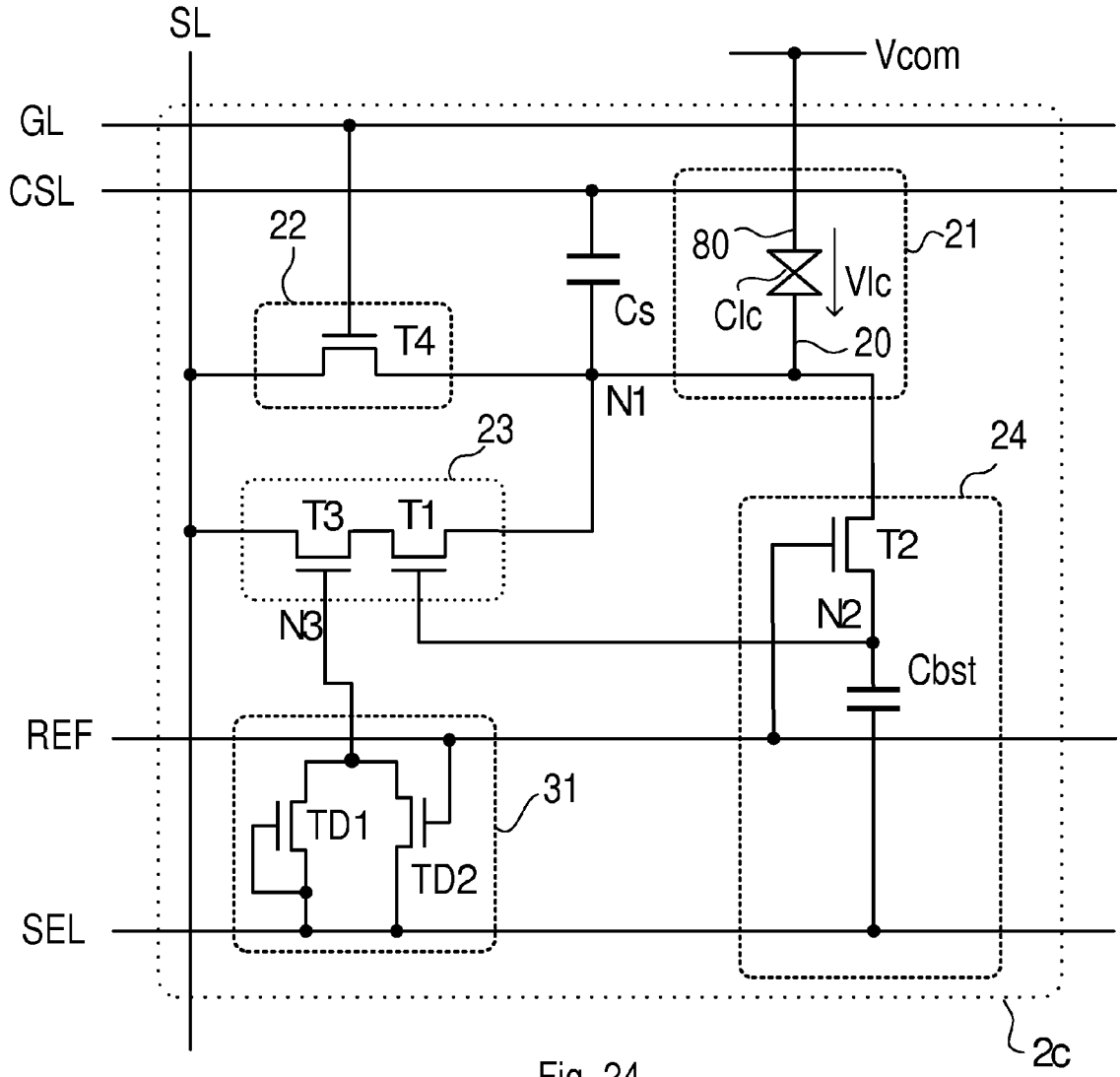
FIG. 24 is a circuit diagram showing a circuit configuration of a third type belonging to the group Y of the pixel circuit of the present invention.
Figure 25:
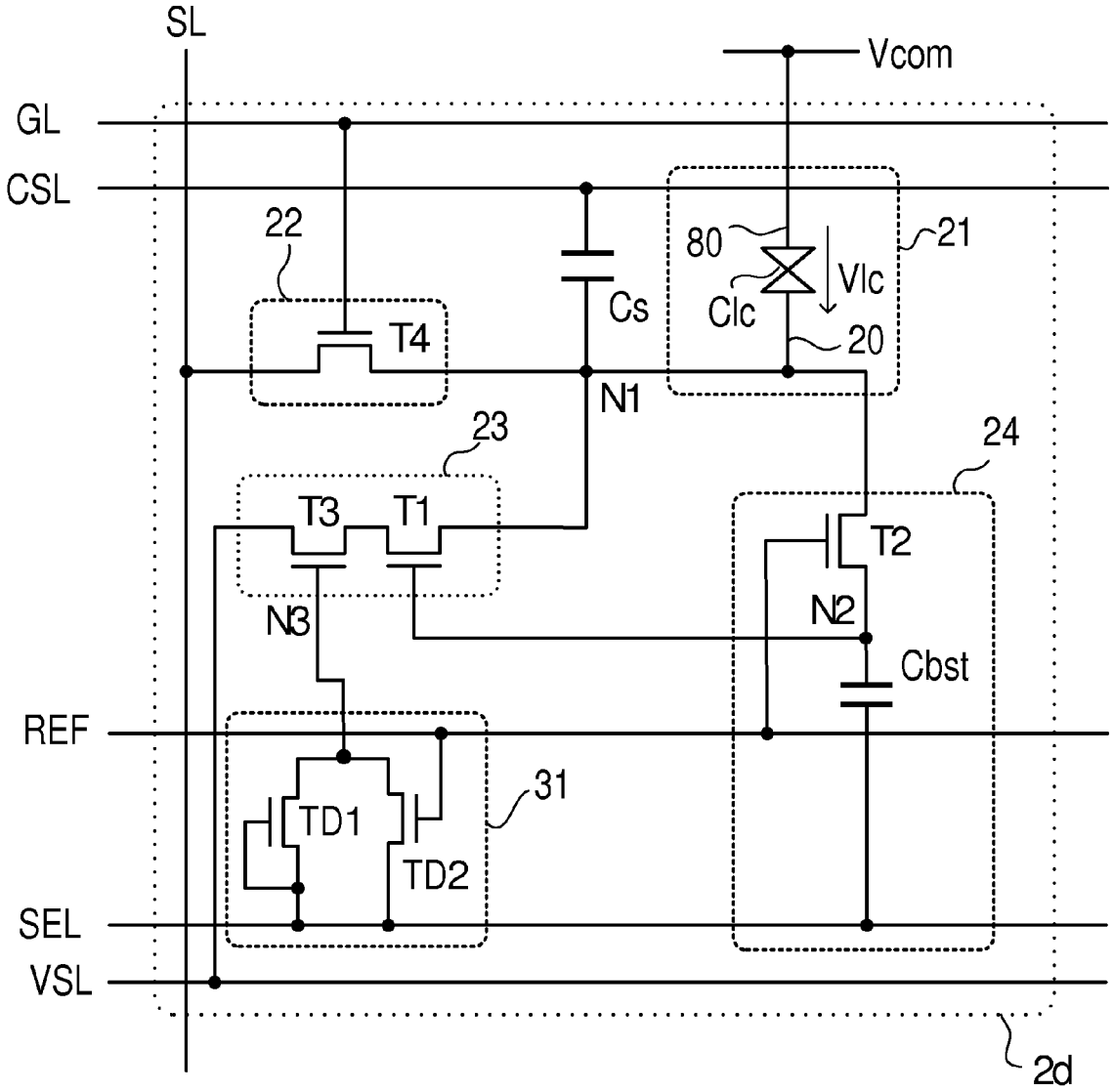
FIG. 25 is a circuit diagram showing a circuit configuration of a fourth type belonging to the group Y of the pixel circuit of the present invention.
Figure 26:
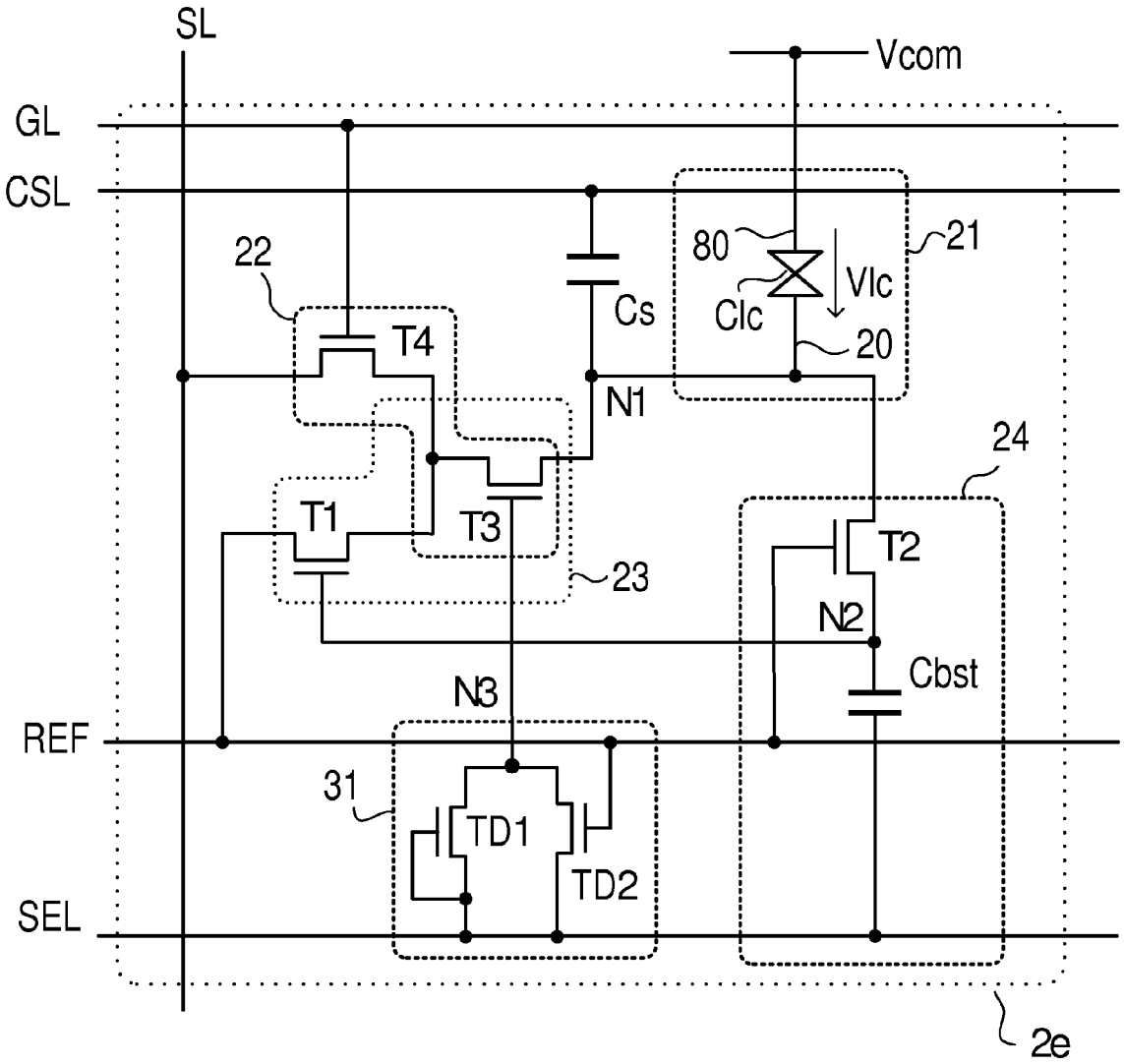
FIG. 26 is a circuit diagram showing a circuit configuration of a fifth type belonging to the group Y of the pixel circuit of the present invention.
Figure 27:
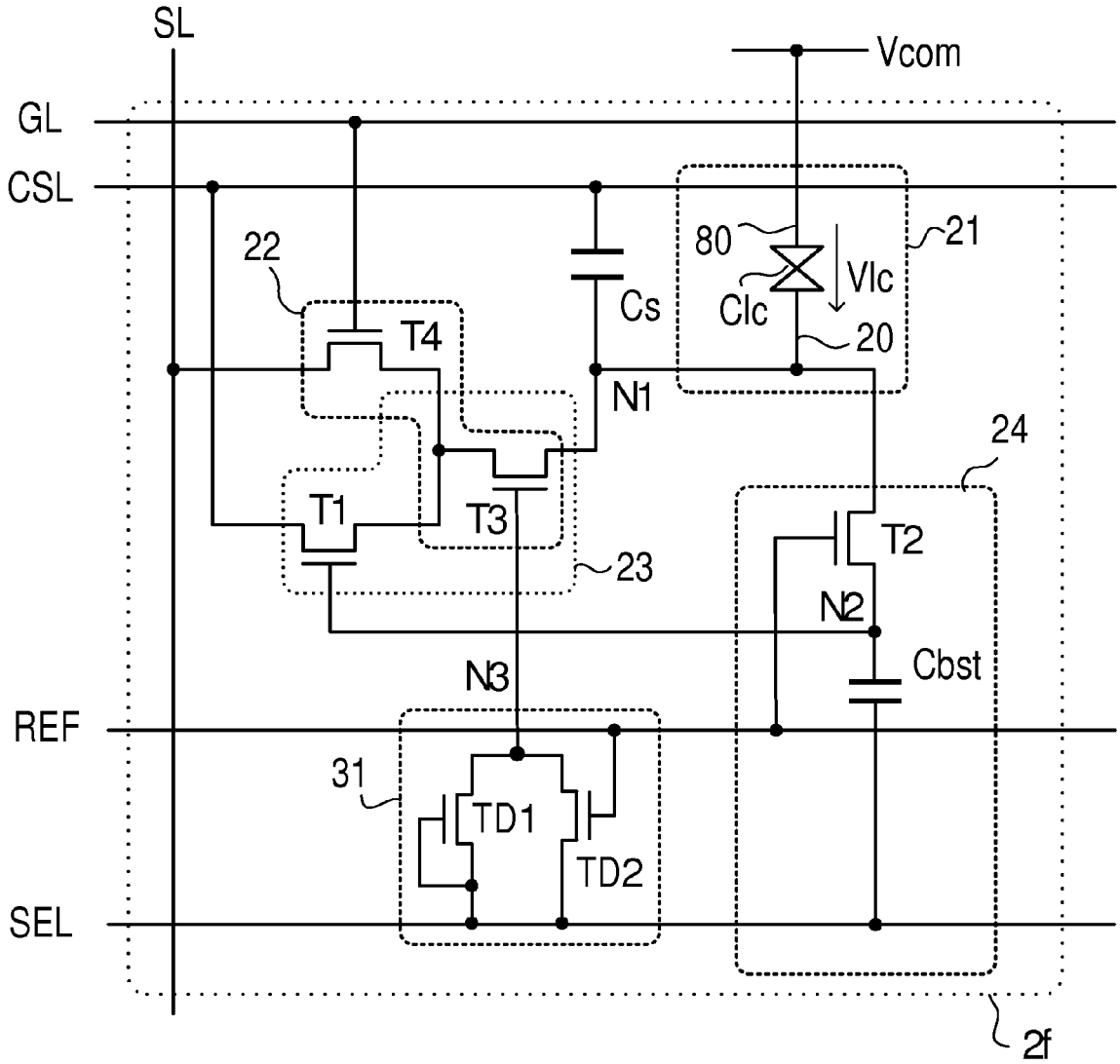
FIG. 27 is a circuit diagram showing a circuit configuration of a sixth type belonging to the group Y of the pixel circuit of the present invention.
Figure 28:
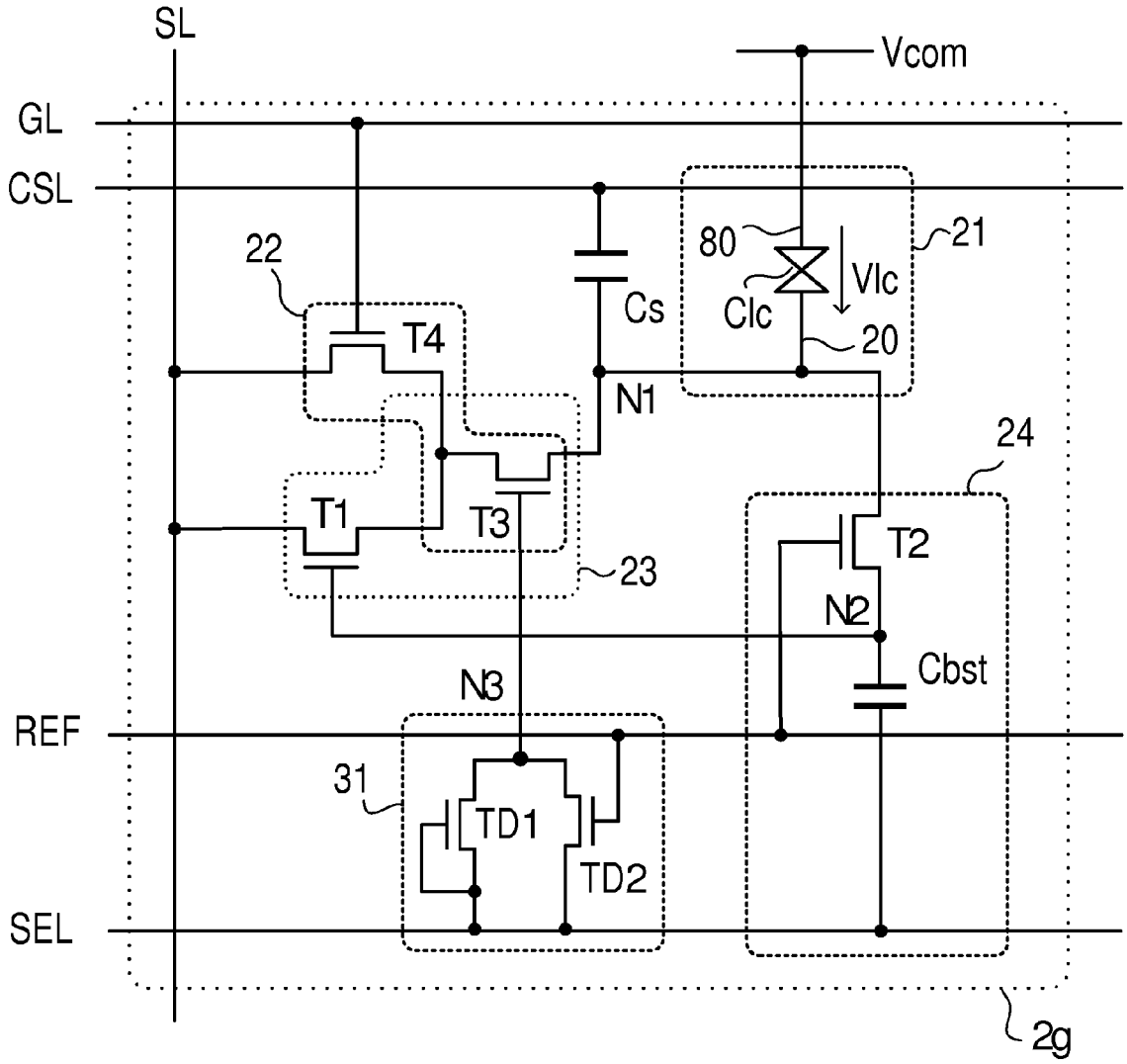
FIG. 28 is a circuit diagram showing a circuit configuration of a seventh type belonging to the group Y of the pixel circuit of the present invention.
Figure 29:
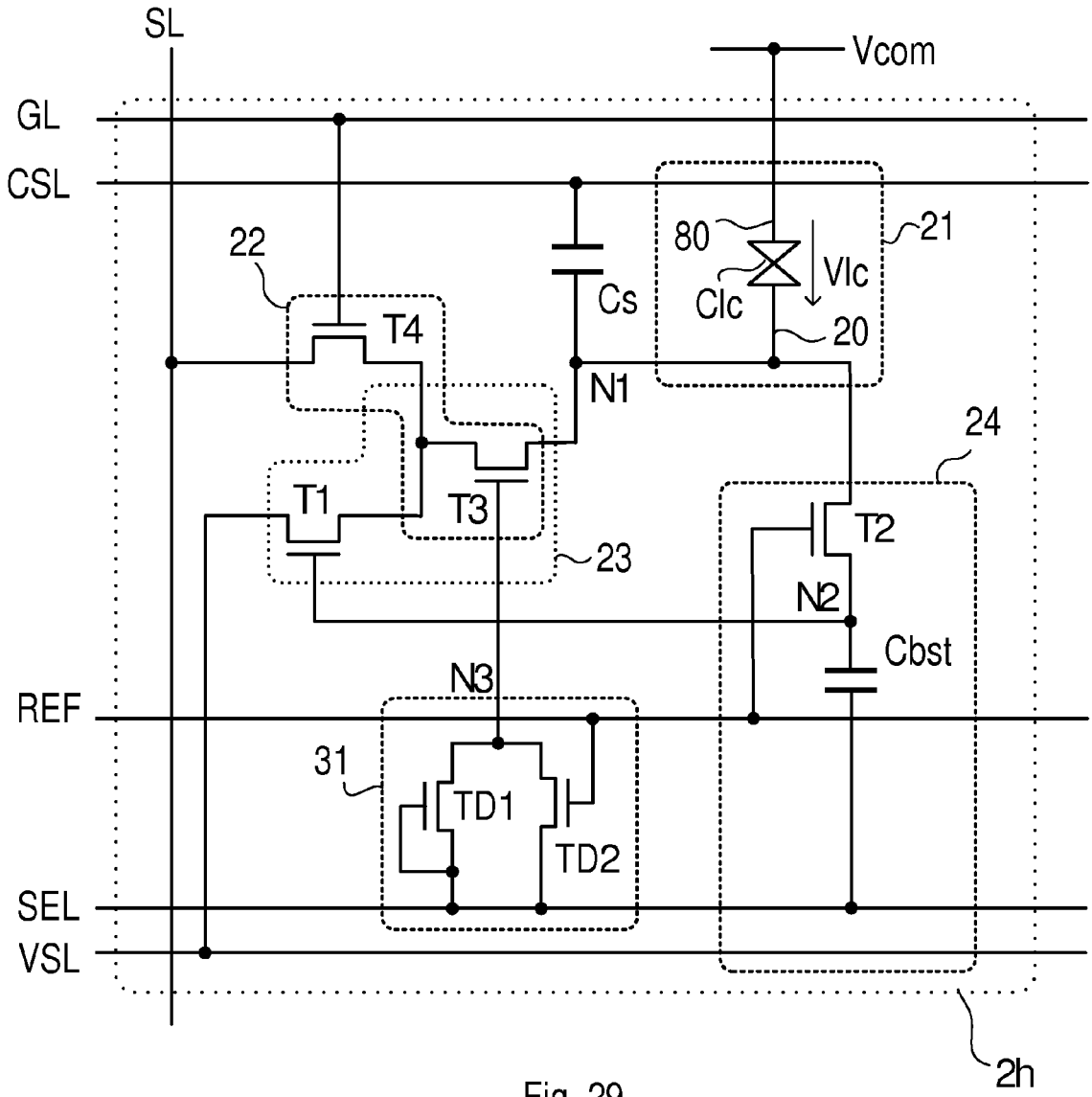
FIG. 29 is a circuit diagram showing a circuit configuration of an eighth type belonging to the group Y of the pixel circuit of the present invention.

In the timing chart in FIG. 35, the maximum value of the potential VN3 is about 8 V because the selecting line SEL is connected to the control terminal of the delay transistor TD1 as shown in FIG. 22. In the configuration in FIG. 30, since the potential of the node ND is higher than the potential of the selecting line SEL while a pulse voltage is applied to the selecting line SEL, a potential slightly higher than a value shown in the timing chart in FIG. 35 is exhibited. The value of the potential VN3 also depends on a ratio of the capacity of the delay capacitor element CD to a full capacity being parasitic in the node ND. For example, when the ratio is 0.8 as described above, when both the threshold voltages of the delay transistors TD1 and TD2 are 2 V each, the maximum value of the potential VN3 is about 9V.

When the transistor T2 in the case L is turned on by time t2, when the potential VN2 (L) of the node N2 is almost equal to the potential VN1 (L) of the node N1, the transistor T1 is not turned on in the case L, i.e., the second switch circuit 23 is not turned on, and 5 V is not supplied from the voltage supply line (in this case, the reference line REF) to the internal node N1. On the other hand, in the case H, since the transistors T1 and T3 are turned on, 5 V is supplied to the internal node N1, and a refresh action is executed.

Thereafter, time t3, when the pulse voltage application to the selecting line SEL is ended, the potential of the node ND decreases to about 3 V again. However, since the value is higher than a voltage (2 V) obtained by adding a threshold voltage to a voltage (0 V) of the selecting line SEL, the delay transistor TD 1 is turned on in a direction from the node N3 to the selecting line SEL. In this manner, a current flows from the node N3 to the selecting line SEL, and the potential of the node N3 begins to decrease toward 0 V.

As described above, even in the circuit configuration in FIG. 30, as in the circuit configuration in FIG. 22, a delay time can be formed, after a pulse voltage is applied to the selecting line SEL, until the voltage is supplied to the control terminal of the transistor T3. In this manner, even though the transistor T1 is turned on by temporarily increasing the potential VN2 (L) of the node N2 immediately after the pulse voltage is applied to the selecting line SEL in the case L, the transistor T3 can be turned off meanwhile. For this reason, a voltage (5 V) in the first voltage state applied to the voltage supply line (reference line REF in FIG. 30) can be prevented from being supplied to the internal node N1. Also when the delay circuit 31 shown in FIG. 30 is arranged in each of the pixel circuits of the second to eighth types, the same effect as described above can be obtained.

[Third Embodiment]

In a third embodiment, a writing action in an always-on display mode will be described for each of the types with reference to the accompanying drawings.

In the writing action in the always-on display mode, pixel data of one frame is divided in units of display lines in a horizontal direction (row direction), and a binary voltage corresponding to each pixel data of one display line, i.e., a high-level voltage (5 V) or a low-level voltage (0 V) is applied to the source line SL of each column for each horizontal period. A selected-row voltage of 8 V is applied to the gate line GL of a selected display line (selected row) to turn on the first switch circuits 22 of all the pixel circuits 2 of the selected row, and voltages of the source lines SL of the columns are transferred to the internal node N1 of each of the pixel circuits 2 of the selected row.

A non-selected row voltage of −5 V is applied to the gate lines GL of display lines (non-selected rows) except for the selected display line to turn off the first switch circuits 22 of all the pixel circuits 2 of the non-selected rows. Timing control of a voltage application of each signal line in a writing action (will be described later) is performed by the display control circuit 11, and each voltage application is performed by the display control circuit 11, the counter electrode drive circuit 12, the source driver 13, and the gate driver 14.

<1. Group X>

A writing action in the always-on display mode for each pixel circuit in which the boost line BST is connected to the control terminal of the transistor T3 and that belongs to the group X will be described first.

(First Type)

Figure 39:
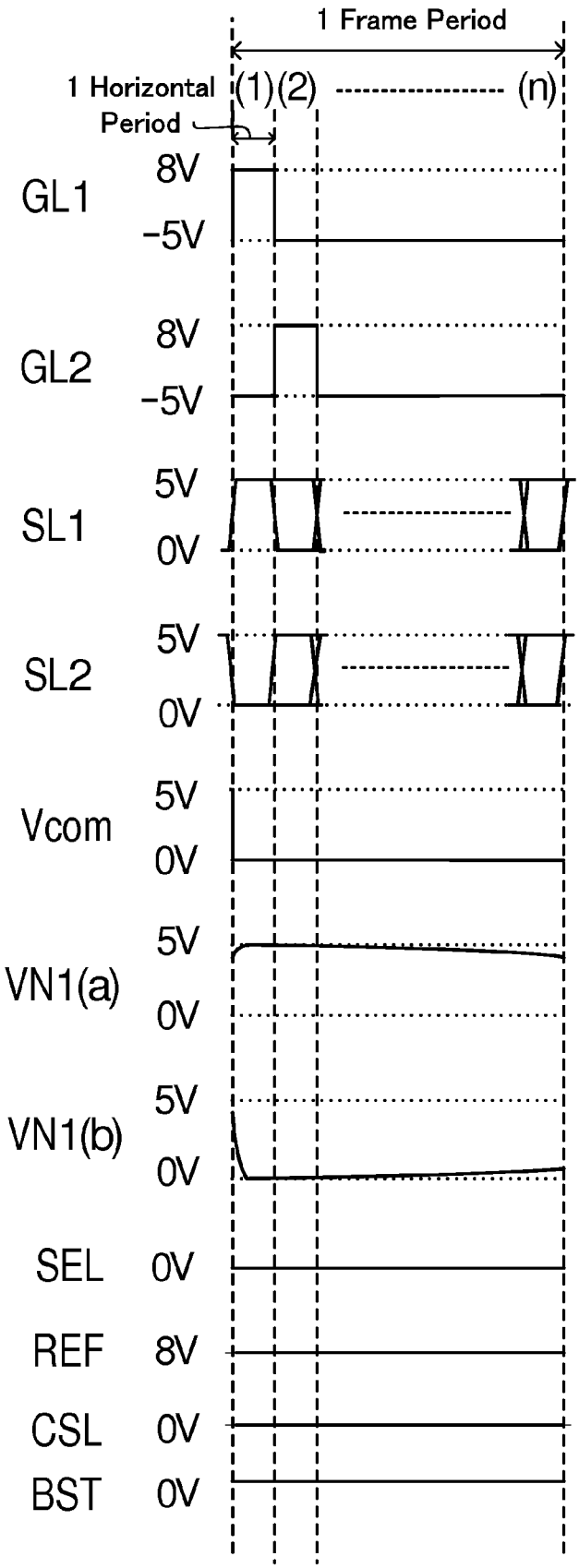
FIG. 39 is a timing chart of a writing action in an always-on display mode performed by the pixel circuit of the first type of the group X.

FIG. 39 is a timing chart of a writing action using the pixel circuit 2A (FIG. 8) of the first type. FIG. 39 shows voltage waveforms of two gate lines GL1 and GL2, two source lines SL1 and SL2, the selecting line SEL, the reference line REF, the auxiliary capacitive line CSL, and the boost line BST in a 1-frame period and a voltage waveform of the counter voltage Vcom. Furthermore, in FIG. 39, variation waveforms of the potentials VN1 of the internal nodes N1 of the two pixel circuits 2A are additionally shown. One of the two pixel circuits 2A is a pixel circuit 2A(a) selected by the gate line GL1 and the source line SL1, and the other is a pixel circuit 2A(b) selected by the gate line GL1 and the source line SL2. The pixel circuits are discriminated from each other by adding (a) and (b) to the backs of VN1 in FIG. 39.

A 1-frame period is divided into horizontal periods the number of which is the number of gate lines GL, and gate lines GL1 to GLn to be selected are sequentially allocated to the horizontal periods, respectively. FIG. 39 shows changes in voltage of the two gate lines GL1 and GL2 in first two horizontal periods. In the first horizontal period, a selected-row voltage of 8 V is applied to the gate line GL1, and a non-selected row voltage of −5 V is applied to the gate line GL2. In the second horizontal period, the selected-row voltage of 8 V is applied to the gate line GL2, and the non-selected row voltage of −5 V is applied to the gate line GL1. In the subsequent horizontal periods, the non-selected row voltage of −5 V is applied to both the gate lines GL1 and GL2.

A voltage (5 V, 0 V) corresponding to pixel data of a display line corresponding to each horizontal period is applied to the source line SL of each column. In FIG. 39, the two source lines SL1 and SL2 are shown as typical source lines SL. In the example shown in FIG. 39, to explain a change of the internal node potential VN1, voltages of the two source lines SL1 and SL2 of the first horizontal period are separately set to 5 V and 0 V, respectively.

In the pixel circuit 2A of the first type, since the first switch circuit 22 is configured by only the transistor T4, control of on/off of the first switch circuit 22 is sufficiently performed by turn-on/off-controlling only the transistor T4. Furthermore, the second switch circuit 23 need not be turned on in the writing action, and, in order to prevent the second switch circuit 23 from being turned on in the pixel circuit 2A of a non-selected row, in a 1-frame period, a non-selected voltage of 0 V (may be −5 V) is applied to the selecting lines SEL connected to all the pixel circuits 2A. The same voltage as that of the selecting line SEL is also applied to the boost line BST.

In order to set the transistor T2 to an always-on state regardless of a voltage state of the internal node N1, 8 V higher than a high-level voltage (5 V) by a threshold voltage (about 2 V) or more is applied to the reference line REF in a 1-frame period. In this manner, the output node N2 and the internal node N1 are electrically connected to each other, and the auxiliary capacitor element Cs connected to the internal node N1 can be used to hold the potential VN1 of the internal node so as to contribute to the stabilization. The auxiliary capacitive line CSL is fixed to a predetermined fixed voltage (for example, 0 V). Although the counter AC drive is performed on the counter voltage Vcom, the counter voltage Vcom is fixed to 0 V or 5 V in a 1-frame period. In FIG. 39, the counter voltage Vcom is fixed to 0 V.

(Second to Fourth Types)

Referring to the timing chart of the writing action in the pixel circuit 2A of the first type shown in FIG. 39, a low-level voltage is always applied to the selecting line SEL throughout a 1-frame period. That is, the second switch circuit 23 is always in an off state.

Therefore, also in the pixel circuit 2B of the second type in which one end of the second switch circuit 23 is connected to the auxiliary capacitive line CSL, the pixel circuit 2C of the third type in which one end of the second switch circuit 23 is connected to the source line SL, or the pixel circuit 2D of the fourth type in which one end of the second switch circuit 23 is connected to the voltage supply line VSL, the writing action can be performed by the same voltage application as that in the timing chart of the first type. In the fourth type, an applied voltage to the voltage supply line VSL may be set to 0 V.

In the fourth type, when 5 V (first voltage state) is applied to the voltage supply line VSL, even though 0 V is not applied to the selecting line SEL and the transistor T3 is not turned off, the voltage of the control terminal of the transistor T1 is equal to that of the internal node N1. For this reason, the transistor T1 in a diode connection state is set to a reverse bias state (off state), and the second switch circuit 23 is turned off.

(Fifth Type)

In the pixel circuit 2E of the fifth type shown in FIG. 14, since the first switch circuit 22 is configured by a series circuit of the transistor T4 and the transistor T3, not only the transistor T4 but also the transistor T3 need to be turned on in writing. With respect to this point, a sequence is different from that in the pixel circuit 2A of the first type.

Figure 40:
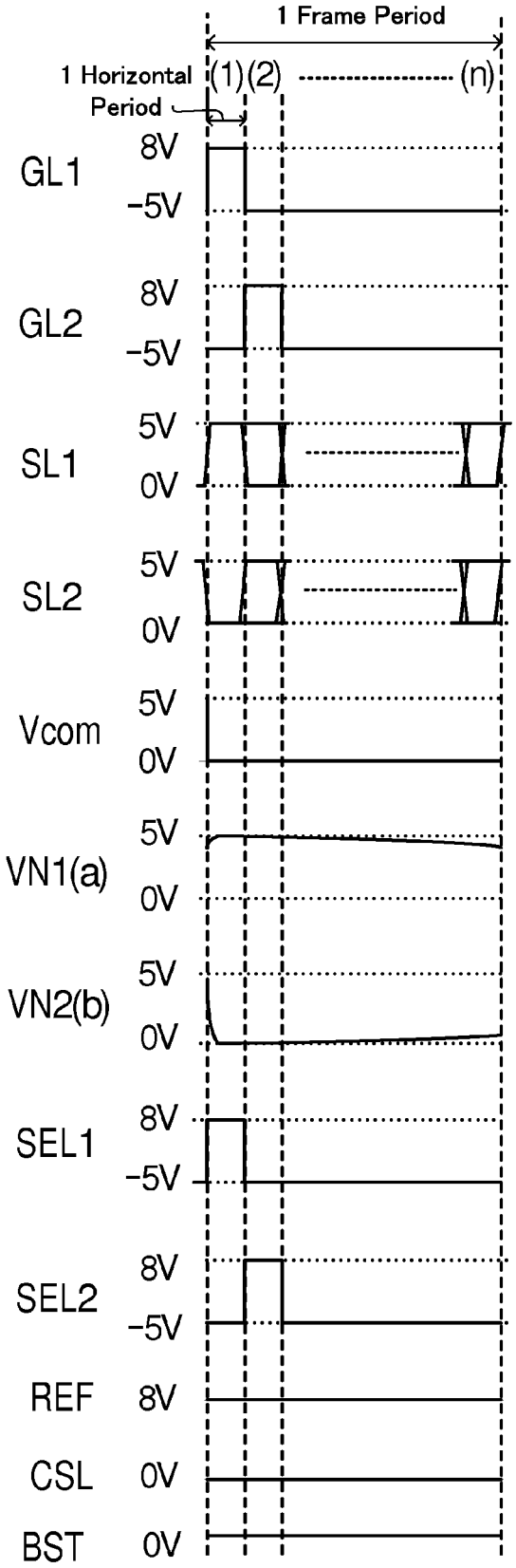
FIG. 40 is a timing chart of a writing action in an always-on display mode performed by the pixel circuit of the fifth type of the group X.

FIG. 40 is a timing chart of a writing action using the pixel circuit 2E of the fifth type. The items in FIG. 40 are the same as those in FIG. 39 except that two selecting lines SEL1 and SEL2 are shown.

Voltage application timings and voltage amplitudes of the gate lines GL (GL1, GL2) and source lines SL (SL1, SL2) are all the same as those in FIG. 39.

In the pixel circuit 2E, since the first switch circuit 22 is configured by a series circuit of the transistor T4 and the transistor T3, when turn-on/off control of the first switch circuit 22 is performed, in addition to the turn-on/off control of the transistor T4, the turn-on/off control of the transistor T3 is required. Thus, in the type, all the selecting lines SEL are not controlled in a lump but, like the gate lines GL, must be independently controlled in units of rows. More specifically, the selecting lines SEL the number of which is the same as the number of gate lines GL1 to GLn are arranged in units of rows one by one, and the selecting lines SEL are sequentially selected like the gate lines GL1 to GLn.

FIG. 40 shows changes in voltage of the two selecting lines SELL and SEL2 in first two horizontal periods. In the first horizontal period, a selecting voltage of 8 V is applied to the selecting line SELL, and a non-selecting voltage of −5 V is applied to the selecting line SEL2. In the second horizontal period, the selecting voltage of 8 V is applied to the selecting line SEL2, and the non-selecting voltage of −5 V is applied to the selecting line SELL. In the subsequent horizontal periods, the non-selecting voltage of −5 V is applied to both the selecting lines SEL1 and SEL2.

Application voltages to the reference line REF, the auxiliary capacitive line CSL, and the boost line BST and the counter voltage Vcom are the same as those in the first type shown in FIG. 39. In a non-selected row, when the first switch circuit 22 is in an off state, the transistor T4 is completely set in an off state. For this reason, a non-selecting voltage of the selecting line SEL to turn off the transistor T3 may not be −5 V but 0 V.

In the pixel circuit of the type, the transistor T3 is turned on in writing. However, since 8 V is applied to the reference line REF, even though the internal node N1 is in the first voltage state, the transistor T1 is not turned on in a direction from the reference line REF to the transistor T3. For this reason, 8 V applied to the reference line REF is not given to the internal node N1 through the second switch circuit 23, and a correct writing voltage given to the source line SL is given to the node N1.

(Sixth Type)

Also in the pixel circuit 2F of the sixth type shown in FIG. 17, as in the fifth type, the selecting lines SEL are not controlled in a lamp, but need to be independently controlled in units of rows like the gate lines GL. More specifically, the selecting lines SEL the number of which is the same as the number of gate lines GL1 to GLn are arranged in units of rows one by one, and the selecting lines SEL are sequentially selected like the gate lines GL1 to GLn.

In the configuration of the type, since the transistor T3 is turned on in writing, 5 V needs to be given to the auxiliary capacitive line CSL to prevent the potential VN1 of the internal node N1 from being varied by turning on the second switch circuit 23. The remaining writing action can be performed by the same voltage applying method as that in the pixel circuit 2E of the fifth type.

(Seventh Type)

Also in the pixel circuit 2G of the seventh type shown in FIG. 18, as in the fifth type, the selecting lines SEL are not controlled in a lamp, but need to be independently controlled in units of rows like the gate lines GL. More specifically, the selecting lines SEL the number of which is the same as the number of gate lines GL1 to GLn are arranged in units of rows one by one, and the selecting lines SEL are sequentially selected like the gate lines GL1 to GLn.

In the configuration of the type, since the second switch circuit 23 is configured to be connected to the source line SL together with the first switch circuit 22, even though the transistor T3 is turned on in writing, the potential VN1 of the internal node does not vary. For this reason, a special countermeasure against that is not necessary. The writing action can be performed by the same voltage applying method as that in the fifth type shown in FIG. 40.

(Eighth Type)

Also in the pixel circuit 2H of the eighth type shown in FIG. 21, as in the fifth type, the selecting lines SEL are not controlled in a lamp, but need to be independently controlled in units of rows like the gate lines GL. More specifically, the selecting lines SEL the number of which is the same as the number of gate lines GL1 to GLn are arranged in units of rows one by one, and the selecting lines SEL are sequentially selected like the gate lines GL1 to GLn.

In the configuration of the type, the transistor T3 may be turned on in writing. That is, if, during the writing action, both the first switch circuit 22 and the second switch circuit 23 are in an on state, and there is a difference between a voltage of the source line SL connected to one end of the first switch circuit 22 and a voltage of the voltage supply line VSL connected to one end of the second switch circuit 23, a current path is generated between the source line SL and the voltage supply line VSL, a voltage of the node located therebetween varies, and a correct voltage corresponding to data to be written may not be written in the internal node N1.

For this reason, when the voltage supply line VSL extends in a vertical direction (column direction) in parallel to the source line SL and arranged so as to be independently driven in units of columns, the voltage supply line VSL connected to one end of the second switch circuit 23 is driven at the same voltage as that of the source line SL connected to one end of the first switch circuit 22 pairing with the second switch circuit 23 to prevent a potential difference between the source line SL and the voltage supply line VSL from being generated so as to provide a method of solving the above problem.

Besides the above method, there is a driving method of solving the above problem by turning off the first switch circuit 22 of a selected row.

Since 8 V is applied to the reference line REF and the transistor T2 is in an on state, a voltage of the control terminal of the transistor T1 is equal to the voltage of the internal node N1. Thus, 5 V (first voltage state) is applied to the voltage supply line VSL to turn the transistor T1 in a diode connection state to a reverse bias state (off state), and the first switch circuit 22 of a selected row can be turned off. According to this method, since the voltage supply line VSL need not be driven at the same voltage as that of the source line SL, even in a circuit configuration in which the voltage supply line VSL extends in a horizontal direction (row direction) in parallel to the gate line GL, a writing action can be performed.

<2. Group Y>

A writing action in an always-on display mode will be described below with respect to each pixel circuit in which the selecting line SEL is connected to the second terminal of the boost capacitor element Cbst and that belongs to the group Y.

(First to Fourth Types)

Referring to the timing chart of the writing action in the pixel circuit 2A of the first type of the group X shown in FIG. 39, a low-level voltage is always applied to the selecting line SEL throughout a 1-frame period. More specifically, the second switch circuit 23 is always in an off state, and, furthermore, a voltage given to one end of the boost capacitor element Cbst does not vary. This can also be applied to each of the second to fourth types.

Thus, also in the pixel circuits 2*a* to 2*d* of the first to fourth types of the group Y, a writing action can be performed by the same voltage application as that of the timing chart of the first type of the group X. In the fourth type, an applied voltage to the voltage supply line VSL may be set to a fixed voltage. In this case, for example, 5 V may be applied such that the transistor T1 forming a diode connection is set to a reverse bias state.

(Fifth to Eighth Types)

Referring to the timing chart of the writing action in the pixel circuit 2D of the fourth type of the group X shown in FIG. 40, a high-level voltage is applied to the selecting line SEL of a selected row, and a low-level voltage is applied to the selecting line SEL of a non-selected row.

In this case, in the pixel circuit 2*e* of the fifth type of the group Y, when a high-level voltage is applied to the selecting line SEL, a voltage given to one end of the boost capacitor element Cbst rises accordingly. However, a high-level voltage (8 V) is given to the reference line REF in the writing action, and the transistor T2 is in an on state. Thus, since the node N1 having a large parasitic capacity is electrically connected to the node N2, the potential of the node N2 hardly rises.

On the other hand, in the group Y, since a configuration includes the delay circuit 31, a predetermined time $\tau$2 is required until a voltage required to turn on the transistor T3 is supplied to the control terminal of the transistor T3 after a high-level voltage is applied to the selecting line SEL. For this reason, when a one-horizontal period is set to be a time shorter than the time 12, when a pixel circuit that shares a source line SL (source line SL1) with the pixel circuit 2A (a) and is connected to a gate line GL different from that connected to the pixel circuit 2A (a) is represented by 2A (c), before a writing action to the pixel circuit 2A (a) is not completed, an applied voltage to the gate line GL1 is set to a low level, and an applied voltage to the source line SL1 has been changed into a voltage corresponding to data to be written in the pixel circuit 2A (c). As a result, correct writing may not be executed to the pixel circuit 2A (a).

In order to execute the correct writing action to prevent the above drawback, the one-horizontal period must be at least longer than the time 12. With this setting, while a high-level voltage is applied to the gate line GL connected to a pixel circuit to be written, a voltage corresponding to the data to be written to the pixel circuit is applied to the source line SL, and the applied voltage is given to the internal node N1 through the first switch circuit 22 configured by a series circuit of the transistors T4 and T3 (or T5).

Also in the sixth to eighth types, the writing action can be realized by the same voltage applying method as that in each of the sixth to eighth types of the group X except that the one-horizontal period is set to be longer than the time $\tau$2.

In the sixth to eighth types, when the delay circuit has the configuration in FIG. 30, the potential of the node ND exhibits about 8 V when the 10 V is applied to the reference line REF. In this state, when a selected-row voltage of 8 V is applied to the selecting line SEL, the potential of the node ND largely rises. However, the transistor TD2 forms a diode connection that performs rectification in a direction from the reference line REF to the node ND, and the potential of the node ND is not given to the reference line REF. 8V is given from the selecting line SEL to the control terminal of the transistor T3 through the transistor TD1 to turn on the transistor T3.

Thereafter, when a non-selected row voltage (−5 V) is applied to the selecting line SEL, the potential of the node ND lowers. However, the potential exhibits about 8 V that is obtained by decreasing the voltage (10 V) applied to the reference line REF by the threshold voltage (2 V) of the delay transistor TD2. In this state, since the delay transistor TD1 is turned on, a current flowing from the control terminal of the transistor T3 to the selecting line SEL is generated, and the potential of the node N3 decreases toward the applied voltage (−5 V) of the selecting line SEL. In this manner, the transistor T3 of a non-selected row is turned off.

[Fourth Embodiment]

In the fourth embodiment, a relationship between a self-refresh action and a writing action in an always-on display mode will be described below.

In the always-on display mode, after a writing action is executed to image data of one frame, display contents obtained by the immediately previous writing action can be maintained without performing the writing action in a predetermined period.

By the writing action, a voltage is given to the pixel electrode 20 in each pixel through the source line SL. Thereafter, the gate line GL is set at a low level, and the transistor T4 is turned off. However, a potential of the pixel electrode 20 is kept by the presence of charges accumulated in the pixel electrode 20 by the immediately previous writing action. More specifically, a voltage Vlc is maintained between the pixel electrode 20 and the counter electrode 80. In this manner, even after the writing action is completed, a state in which a voltage required to display image data is applied across both the terminals of the liquid crystal capacity Clc continues.

When a potential of the counter electrode 80 is fixed, the liquid crystal voltage Vlc depends on the potential of the pixel electrode 20. The potential varies with time in accordance with occurrence of a leakage current of a transistor in the pixel circuit 2. For example, when a potential of the source line SL is lower than a potential of the internal node N1, a leakage current flowing from the internal node N1 to the source line SL is generated, and the potential VN1 of the internal node N1 decreases with time. In contrast to this, when the potential of the source line SL is higher than the potential of the internal node N1, a leakage current flowing from the source line SL to the internal node N1 is generated, and a potential of the pixel electrode 20 increases with time. More specifically, when time has elapsed without performing an external writing action, the liquid crystal voltage Vlc gradually changes. As a result, a displayed image also changes.

In a normal display mode, a writing action is executed to all the pixel circuits 2 in units of frames even in a still image. Therefore, the amount of electric charges accumulated in the pixel electrode 20 need only be maintained in a 1-frame period. Since a variation in potential of the pixel electrode 20 in a 1-frame period at most is very small, the variation in potential meanwhile does not give an influence that is enough to be visually confirmed to image data to be displayed. For this reason, in the normal display mode, the variation in potential of the pixel electrode 20 does not cause a serious problem.

In contrast to this, in the always-on display mode, a writing action is not configured to be executed for each frame. Therefore, while the potential of the counter electrode 80 is fixed, depending on the circumstances, the potential (internal node potential VN1) of the pixel electrode 20 needs to be kept for several frames. However, when the pixel circuit is left without performing a writing action for several frame periods, a potential of the pixel electrode 20 intermittently varies due to generation of the leakage current described above. As a result, image data to be displayed may be changed enough to be visually confirmed.

Figure 41:
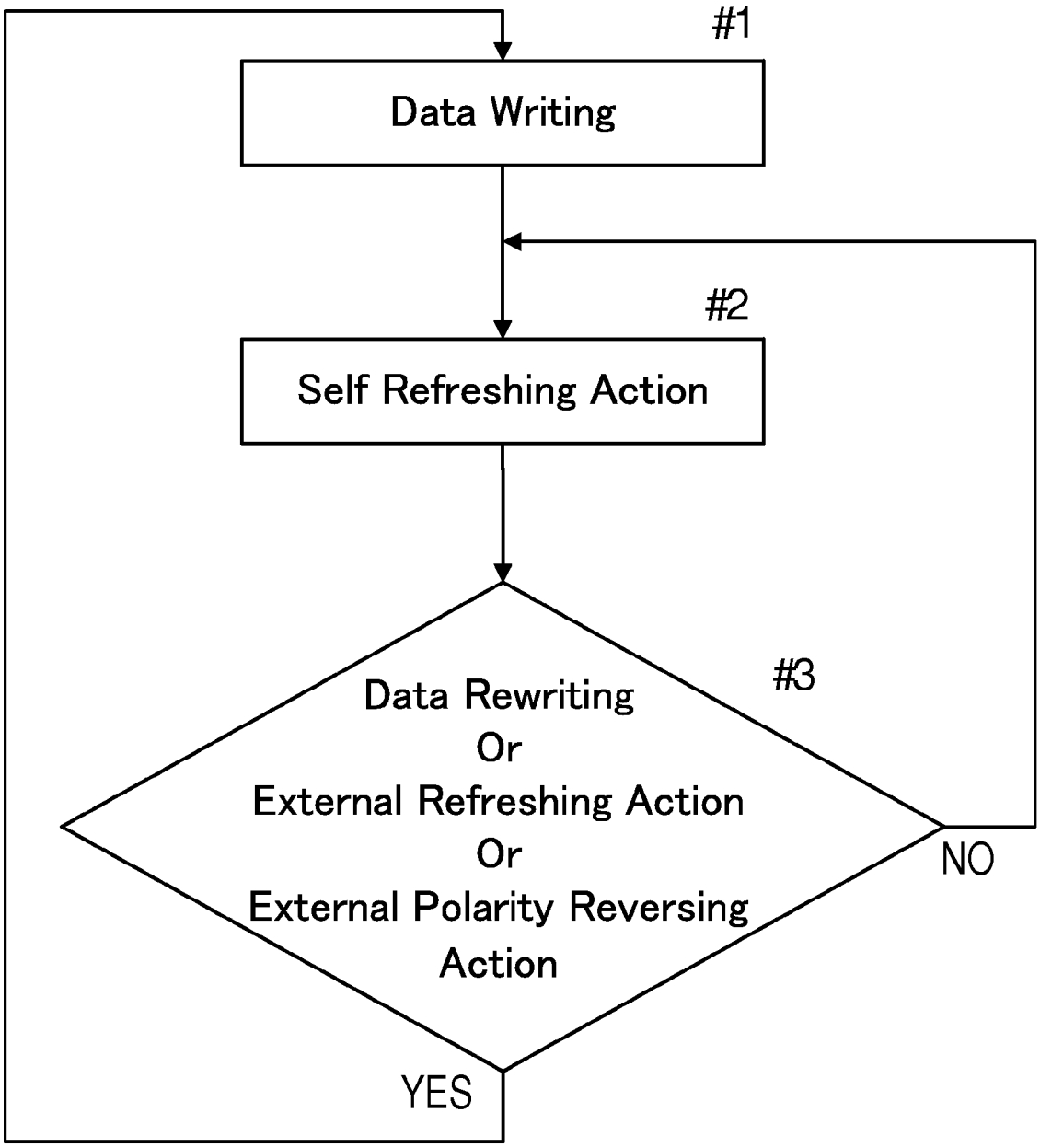
FIG. 41 is a flow chart showing procedures of a writing action and a self-refresh action in the always-on display mode.

In order to avoid the phenomenon, in the always-on display mode, by the manner shown in the flow chart in FIG. 41, the self-refresh action and the writing action are executed in combination with each other to considerably reduce a power consumption while suppressing a variation in potential of the pixel electrode.

A writing action of pixel data of one frame in the always-on display mode is executed by the manner described in the above third embodiment (step #1).

After the writing action in step #1, a self-refresh action is executed by the manner described in the above second embodiment (step #2). The self-refresh action is realized by the phase P1 in which a pulse voltage is applied and the phase P2 in which a standby state is set.

In this case, in a period of the phase P2 of the self-refresh action period, when a request for a writing action (data rewriting) of new pixel data, an external refresh action, or an external polarity inverting action is received (YES in step #3), the control flow returns to step #1 to execute the writing action of the new pixel data or previous pixel data. In the period of the phase P2, when the request is not received (NO in step #3), the control flow returns to step #2 to execute the self-refresh action again. In this manner, a change of a display image by an influence of a leakage current can be suppressed.

When a refresh action is to be performed by a writing action without performing a self-refresh action, a power consumption expressed by the relational expression shown in numerical expression 1 described above is obtained. However, when the self-refresh action is repeated at the same refresh rate, the number of times of driving all source line voltages is one. For this reason, the variable m in numerical expression 1 becomes 1. When VGA is supposed as a display resolution (the number of pixels), m=1920 and n=480. Thus, a power consumption is expected to be reduced to about 1/1920 of it.

In the embodiment, the reason the self-refresh action and the external refresh action or the external polarity inverting action are used in combination with each other is to cope with the following case. That is, even in the pixel circuit 2 that normally operates at first, the second switch circuit 23 or the control circuit 24 is defected by aging, although a writing action can be performed without a trouble, a self-refresh action cannot be normally executed in some pixel circuits 2. More specifically, when only the self-refresh action is performed, displays of the corresponding pixel circuits 2 are deteriorated, and the deterioration is fixed. By using the external polarity inverting action, the display defect can be prevented from being fixed.

In the pixel circuits (2B, 2*b*) of the second type and pixel circuits (2F, 2*f*) of the sixth type, in order to realize the flow of the embodiment, the auxiliary capacitive line CSL needs to be set to 5 V in step #1 to execute a writing action as described in the second embodiment.

[Fifth Embodiment]

In the fifth embodiment, a writing action in a normal display mode will be described for each type with reference to the accompanying drawings.

In the writing action in the normal display mode, pixel data of one frame is divided in units of display lines in a horizontal direction (row direction), and a multi-tone analog voltage corresponding to each pixel data of one display line is applied to the source line SL of each column for each horizontal period, and a selected-row voltage of 8 V is applied to the gate line GL of a selected display line (selected row) to turn on the first switch circuits 22 of all the pixel circuits 2 of the selected row, and voltages of the source lines SL of each column are transferred to the internal node N1 of each of the pixel circuits 2 of the selected row. A non-selected row voltage of −5 V is applied to the gate lines GL of display lines (non-selected rows) except for the selected display line to turn off the first switch circuits 22 of all the pixel circuits 2 of the non-selected row.

Timing control of a voltage application of each signal line in a writing action (will be described later) is performed by the display control circuit 11, and each voltage application is performed by the display control circuit 11, the counter electrode drive circuit 12, the source driver 13, and the gate driver 14.

Figure 42:
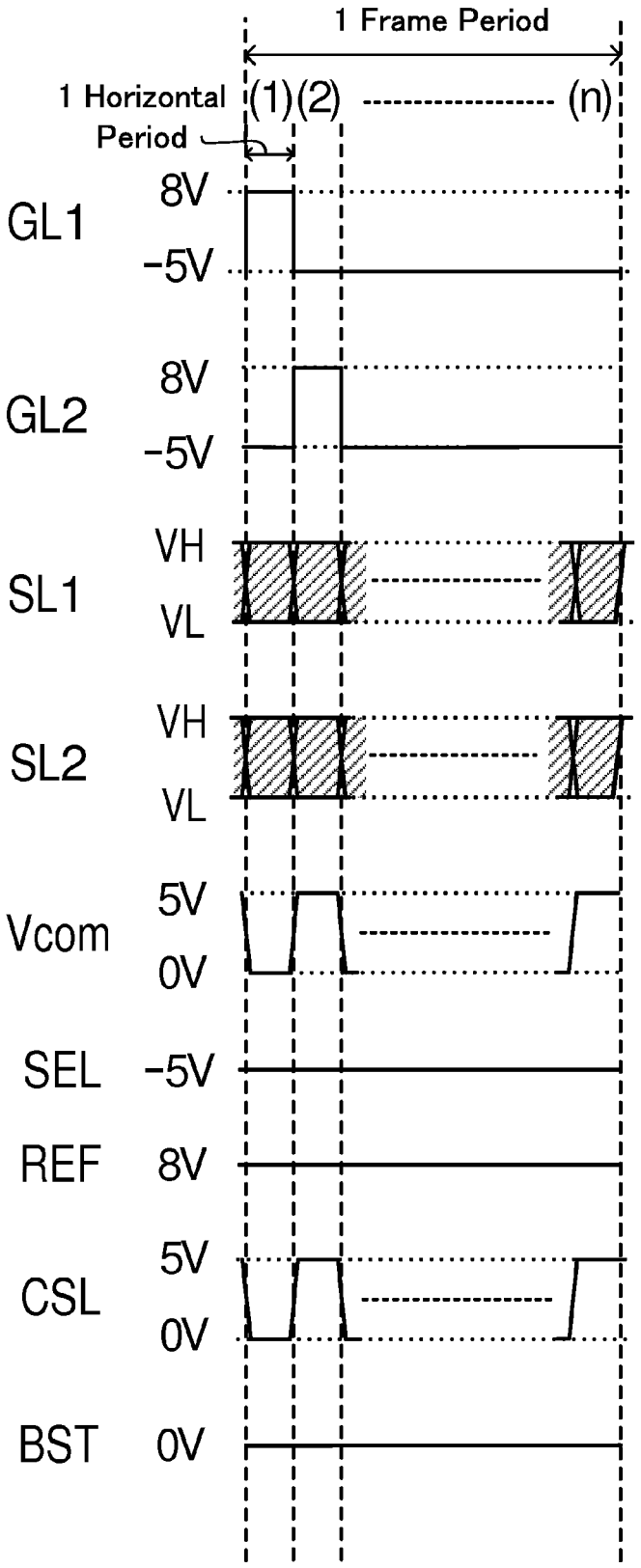
FIG. 42 is a timing chart of a writing action in a normal display mode performed by the pixel circuit of the first type.

FIG. 42 is a timing chart of a writing action using the pixel circuit 2A of the first type of the group X. FIG. 42 shows voltage waveforms of the two gate lines GL1 and GL2, the two source lines SL1 and SL2, the selecting line SEL, the reference line REF, the auxiliary capacitive line CSL, and the boost line BST in a 1-frame period and a voltage waveform of the counter voltage Vcom.

A 1-frame period is divided into horizontal periods the number of which is the number of gate lines GL, and gate lines GL1 to GLn to be selected are sequentially allocated to the horizontal periods, respectively. FIG. 42 shows changes in voltage of the two gate lines GL1 and GL2 in first two horizontal periods. In the first horizontal period, a selected-row voltage of 8 V is applied to the gate line GL1, and a non-selected row voltage of −5 V is applied to the gate line GL2. In the second horizontal period, the selected-row voltage of 8 V is applied to the gate line GL2, and the non-selected row voltage of −5 V is applied to the gate line GL1. In the subsequent horizontal periods, the non-selected row voltage of −5 V is applied to both the gate lines GL1 and GL2.

A multi-tone analog voltage corresponding to pixel data of a display line corresponding to each horizontal period is applied to the source line SL of each column. In the normal display mode, a multi-tone analog voltage corresponding to pixel data of an analog display line is applied, and the application voltage is not uniquely specified. For this reason, this area is expressed by hatching the area in FIG. 42. In FIG. 42, the two source lines SL1 and SL2 are shown as typical source lines SL1, SL2, . . . , SLm.

Since the counter voltage Vcom changes for each horizontal period (counter AC drive), the analog voltage has a voltage value corresponding to the counter voltage Vcom in the same horizontal period. More specifically, an analog voltage applied to the source line SL is set such that the liquid crystal voltage Vlc given by numerical expression 2 changes in only polarity without changing in absolute value depending on whether the counter voltage Vcom is 5 V or 0 V.

In the pixel circuits of the first to fourth types, since the first switch circuit 22 is configured by only the transistor T4, turn-on/off control of the first switch circuit 22 is sufficiently performed by turn-on/off-controlling only the transistor T4. Furthermore, the second switch circuit 23 needs not be turned on in the writing action, and, in order to prevent the second switch circuit 23 from being turned on in the pixel circuit 2A of a non-selected row, in a 1-frame period, a non-selecting voltage of −5 V is applied to the selecting lines SEL connected to all the pixel circuits 2A. The non-selecting voltage is not limited to a negative voltage and may be 0 V.

In the 1-frame period, a voltage that always sets the transistor T2 in an on state regardless of a voltage state of the internal node N1 is applied to the reference line REF. The voltage value needs only be higher than a maximum value of voltage values given from the source line SL as multi-tone analog voltages by a threshold voltage of the transistor T2 or more. In FIG. 42, the maximum value is set to 5 V, and the threshold voltage is set to 2 V, and 8 V that is higher than the sum of the voltages is applied.

Since the counter AC drive is performed on the counter voltage Vcom for each horizontal period, the auxiliary capacitive line CSL is driven to have a voltage equal to the counter voltage Vcom. The pixel electrode 20 is capacitively coupled to the counter electrode 80 through a liquid crystal layer and also capacitively coupled to the auxiliary capacitive line CSL through the auxiliary capacitor element Cs. For this reason, when the voltage of the auxiliary capacitor element C2 on the auxiliary capacitive line CSL side is fixed, a change of the counter voltage Vcom is divided between the auxiliary capacitive line CSL and the auxiliary capacitor element C2 and appears at the pixel electrode 20, and the liquid crystal voltages Vlc of the pixel circuits 2 of a non-selected row vary. Thus, when all the auxiliary capacitive lines CSL are driven at the same voltage as the counter voltage Vcom, the voltages of the counter electrode 80 and the pixel electrode 20 change in the same voltage direction, and variation in the liquid crystal voltages Vlc of the pixel circuits 2 of the non-selected row can be suppressed.

As described in the third embodiment, for the same reason as that in the writing action in the always-on display mode, also in the pixel circuits of the second to fourth types, the writing action can be realized by the same voltage applying method as that in the first type. In the pixel circuits of the fifth to eighth types, as in the writing action in the always-on display mode, the selecting lines SEL may be independently controlled in units of rows, and the remaining writing action can be realized by the same voltage applying method as that in the first type. In the third and sixth types, an applied voltage to the voltage supply line VSL may be set to 0 V.

Furthermore, in each pixel circuit (2*a* to 2*d*) of the first to fourth types of the group Y, a writing action can be realized by performing the same voltage application as that in each of the pixel circuits (2A to 2D) of the group X of the same type. Furthermore, in each pixel circuit (2*e* to 2*h*) of the fifth to eighth types of the group Y, a writing action can be realized by performing the same voltage application as that in each of the pixel circuits (2E to 2H) of the group X of the same type except that the one-horizontal period is set to be longer than the time t2 as described in the third embodiment. Since this point can also be explained by the same reason as that in the writing action in the always-on display mode explained in the third embodiment, a detailed description thereof will be omitted.

In the writing action in the normal display mode, as a method of inverting the polarity of each display line for each horizontal period, in addition to the "counter AC drive", there is a method of applying a predetermined fixed voltage to the counter electrode 80 as the counter voltage Vcom. According to the method, a voltage applied to the pixel electrode 20 alternately changes into a positive voltage or a negative voltage every horizontal period with reference to the counter voltage Vcom.

In this case, there are a method of directly writing the pixel voltage through the source line SL and a method of adjusting a voltage to any one of a positive voltage and a negative voltage with reference to the counter voltage Vcom by capacitive coupling using the auxiliary capacitor element Cs after a voltage falling within a voltage range centered at the counter voltage Vcom is written. In this case, the auxiliary capacitive line CSL is not driven at the same voltage as the counter voltage Vcom, and independently pulse-driven in units of rows.

In the embodiment, in the writing action in the normal display mode, a method of inverting the polarity of each display line for each horizontal period is employed. However, the method is employed to cancel a disadvantage (will be described below) occurring when polarity inversion is performed in units of frames. As the method of canceling the disadvantage, there are a method of performing polarity inversion drive for each column and a method of simultaneously performing polarity inversion drive in units of pixels in row and column directions.

It is assumed that the positive liquid crystal voltage Vlc is applied in all pixels in a certain frame F1 and the negative liquid crystal voltage Vlc is applied in all the pixels in the next frame F2. Even though the voltages having the same absolute value are applied to the liquid crystal layer 75, light transmittances may be slightly different from each other depending on the positive polarity or the negative polarity. When a high-quality still image is displayed, the presence of the slight difference may possibly cause small changes in display manners in the frame F1 and the frame F2. Even in a moving image display state, in a display area in which the same display contents should be displayed in the frames, the display manners may be possibly slightly changed. In display of a high-quality still image or moving image, it is assumed that even the slight change can be visually recognized.

Since the normal display mode is a mode of displaying a high-quality still image or moving image, the above slight change may be possibly visually recognized. In order to avoid the phenomenon, in the embodiment, the polarity is inverted for each display line in the same frame. In this manner, since the liquid crystal voltages Vlc having polarities different between display lines in the same frame are applied, an influence on display image data based on the polarity of the liquid crystal voltage Vlc can be suppressed.

[Another Embodiment]

Another embodiment will be described below.

<1> With respect to the pixel circuits 2A to 2H belonging to the group X, in writing actions in the normal display mode and the always-on display mode, a low-level voltage may be given to the reference line REF to set the transistor T2 to an off state. In this manner, when the internal node N1 and the output node N2 are electrically separated from each other, the potential of the pixel electrode 20 is not influenced by the voltage of the output node N2 obtained before the writing action. In this manner, the voltage of the pixel electrode 20 correctly reflects an application voltage to the source line SL, and the image data can be displayed without an error.

As described above, a total parasitic capacity of the node N1 is considerably larger than that of the node N2, and the potential of the node N2 in the initial state hardly influences the potential of the pixel electrode 20. For this reason, it is preferable that the transistor T2 may always be in an on state.

<2> In the embodiment, the second switch circuits 23 and the control circuits 24 are arranged in each of all the pixel circuits 2 arranged on the active matrix substrate 10. In contrast to this, when pixel units of two types, i.e., a transmissive pixel unit that performs a transmissive liquid crystal display and a reflective pixel unit that performs a reflective liquid crystal display are arranged on the active matrix substrate 10, only pixel circuits of the reflective pixel unit may include the second switch circuits 23 and the control circuits 24, and pixel circuits of the transmissive display unit may not include the second switch circuits 23 and the control circuits 24.

In this case, an image display is performed by the transmissive pixel unit in the normal display mode, and an image display is performed by the reflective pixel unit in the always-on display mode. With the above configuration, the number of elements formed on the entire area of the active matrix substrate 10 can be reduced.

<3> In the embodiment, each of the pixel circuits 2 includes the auxiliary capacitor element Cs. However, the pixel circuit 2 needs not always include the auxiliary capacitor element Cs. However, in order to more stabilize the potential of the internal node N1 to reliably stabilize a display image, the auxiliary capacitor element Cs is preferably included.

Figure 43:
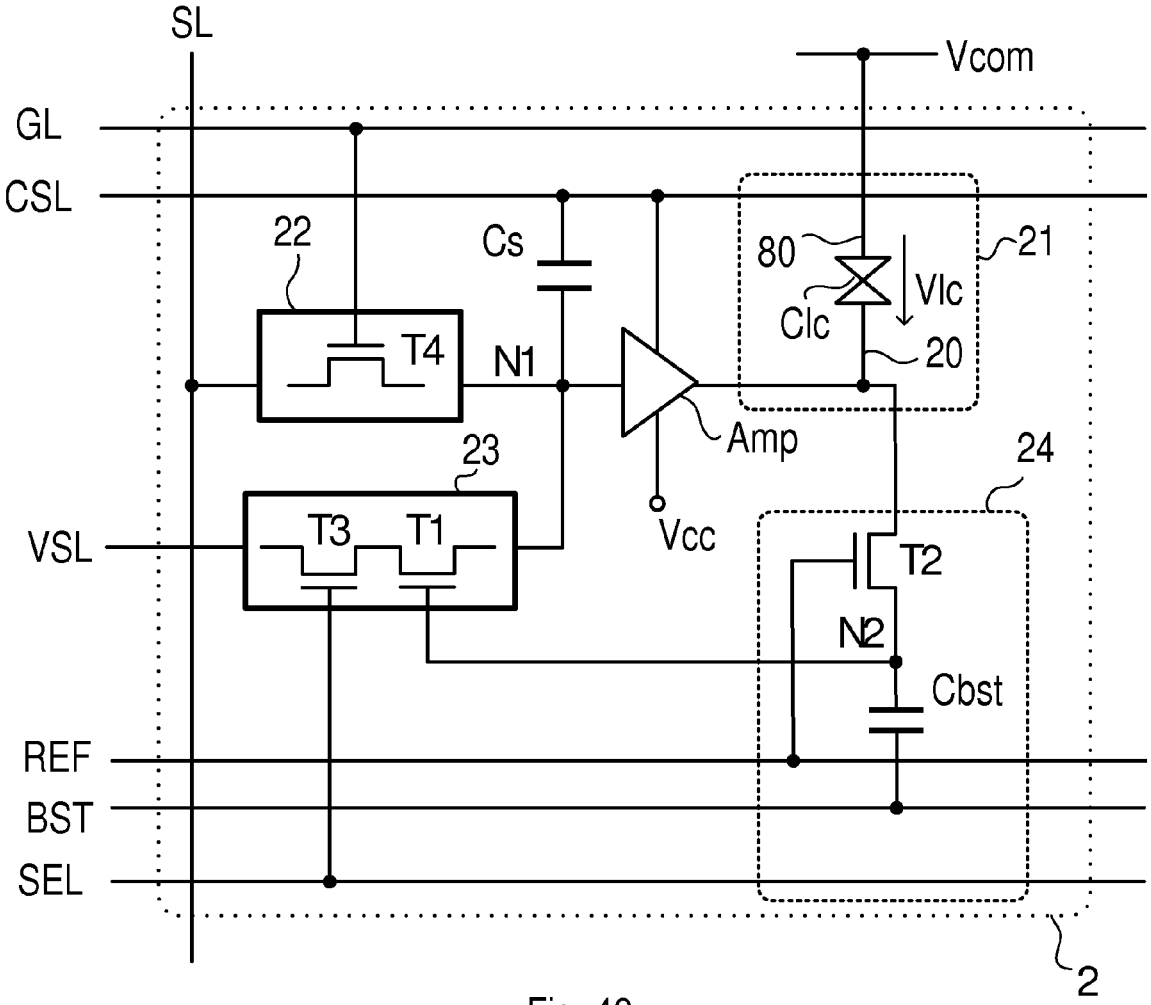
FIG. 43 is a circuit diagram showing still another basic circuit configuration of the pixel circuit of the present invention.

<4> In the embodiment, it is assumed that the display element unit 21 of each of the pixel circuits 2 is configured by only the unit liquid crystal display element Clc. However, as shown in FIG. 43, an analog amplifier Amp (voltage amplifier) may be arranged between the internal node N1 and the pixel electrode 20. In FIG. 43, as an example, as a power supply line for the analog amplifier Amp, the auxiliary capacitive line CSL and a power supply line Vcc are input.

In this case, a voltage given to the internal node N1 is amplified by a gain η set by the analog amplifier Amp, and the amplified voltage is supplied to the pixel electrode 20. Thus, in the configuration, a small voltage change at the internal node N1 can be reflected on a display image.

<5> In the embodiment, as the potentials VN1 of the internal node N1 in the always-on display mode and voltage values of the counter voltage Vcom in the first and second voltage states are supposed to be 0 V and 5 V, respectively, and, accordingly, voltage values applied to the signal lines are set to −5 V, 0 V, 5 V, 8 V, and 10 V, respectively. However, the voltage values can be arbitrarily set depending on the characteristics (threshold voltages or the like) of liquid crystal elements and transistor elements to be used.

<6> In the embodiments, the liquid crystal display device is exemplified. However, the present invention is not limited to the embodiments. The present invention can be applied to any display device that has a capacity corresponding to the pixel capacity Cp to hold pixel data and displays an image based on a voltage held in the capacity.

Figure 44:
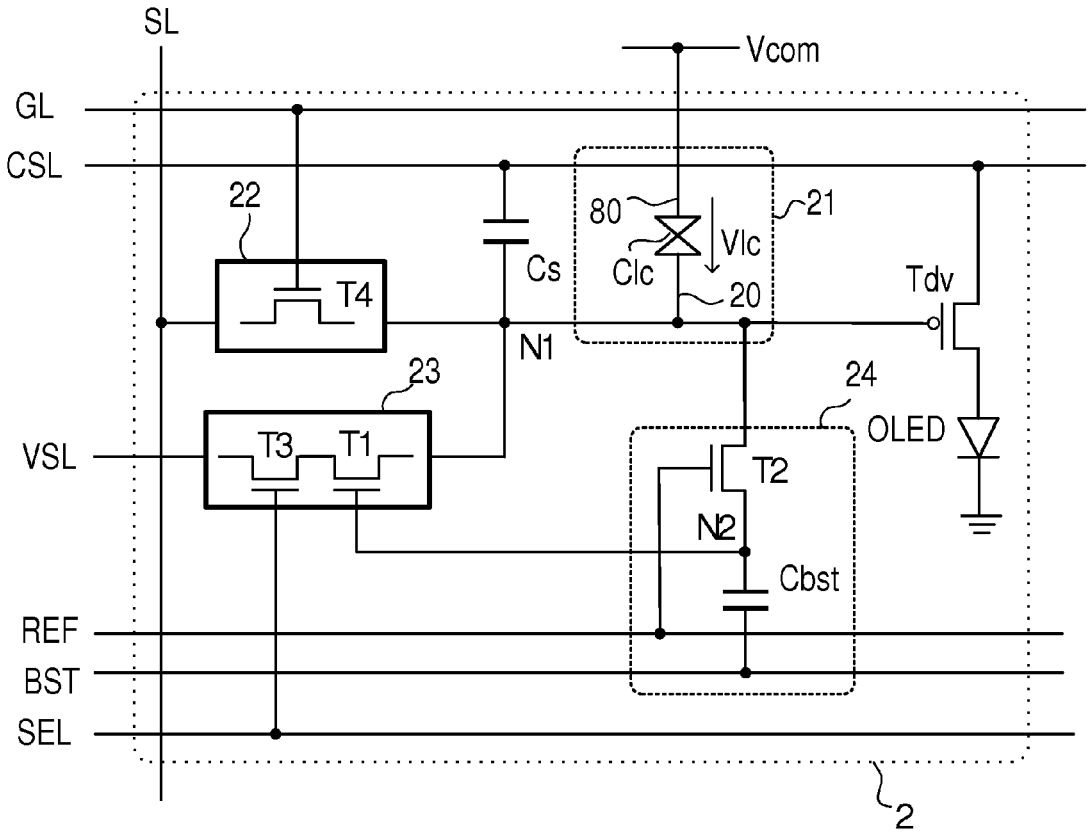
FIG. 44 is a circuit diagram showing still another basic circuit configuration of the pixel circuit of the present invention.

For example, in an organic EL (Electroluminescence) display device in which a voltage corresponding to pixel data is held in a capacity corresponding to a pixel capacity to display an image, the present invention can be especially applied to a self-refresh action. FIG. 44 is a circuit diagram showing an example of a pixel circuit of the organic EL display device. In the pixel circuit, a voltage held in the auxiliary capacity Cs as pixel data is given to a gate terminal of a drive transistor Tdv configured by a TFT, and a current corresponding to the voltage flows in a light-emitting element OLED through the drive transistor Tdv. Thus, the auxiliary capacity Cs corresponds to the pixel capacity Cp in each of the embodiments.

<7> In each of the embodiments, the explanation has been made on the assumption that a pixel circuit has an amorphous TFT having a low electron mobility. However, it is not impossible to apply the technique of the present invention to a configuration including a transistor such as a polysilicon TFT having a high electron mobility, and a more enhanced effect can be exerted when a transistor having a low electron mobility is included.

EXPLANATION OF REFERENCES

1: Liquid crystal display device
2: Pixel circuit
2A, 2B, 2C, 2D, 2E, 2F, 2G, 2H: Pixel circuit
2*a*, 2*b*, 2*c*, 2*d*, 2*e*, 2*f*, 2*g*, 2*h*: Pixel circuit
10: Active matrix substrate
11: Display control circuit
12: Counter electrode drive circuit
13: Source driver
14: Gate driver
20: Pixel electrode
21: Display element unit
22: First switch circuit
23: Second switch circuit
24: Control circuit
31: Delay circuit
74: Seal member
75: Liquid crystal layer
80: Counter electrode
81: Counter substrate
Amp: Analog amplifier
BST: Boost line
Cbst: Boost capacitor element
CD: Delay capacitor element
Clc: Liquid crystal display element
CML: Counter electrode wire
CSL: Auxiliary capacitive line
Cs: Auxiliary capacitor element
Ct: Timing signal
DA: Digital image signal
Dv: Data signal
GL (GL1, GL2, . . . , GLn): Gate line
Gtc: Scanning-side timing control signal
N1: Internal note
N2: Output node
OLED: Light emitting element
P1, P2: Phase
P10, P11, . . . , P18: Phase
P20, P21, . . . , P27: Phase
REF: Reference line
Sc1, Sc2, . . . , Scm: Source signal
SEL: Selecting line
SL (SL1, SL2, . . . , SLm): Source line
Stc: Data-side timing control signal
T1, T2, T3, T4, T5: Transistor
TD1, TD2: Delay transistor
Tdv: Drive transistor
Vcom: Counter voltage
Vlc: Liquid crystal voltage
VN1: Internal node potential
VN2: Output node potential

The invention claimed is:

1. A pixel circuit comprising:

a display element unit including a unit display element;

an internal node that is a part of the display element unit and holds a voltage of pixel data applied to the display element unit;

first to fourth transistor elements, each of the first to fourth transistor elements having a first terminal, a second terminal, and a control terminal that controls conduction between the first and second terminals;

a first switch circuit that transfers the voltage of the pixel data supplied from a data signal line to the internal node through at least the fourth transistor element;

a second switch circuit that transfers a voltage supplied to a predetermined voltage supply line to the internal node without passing through the fourth transistor element; and a control circuit that holds a predetermined voltage depending on the voltage of the pixel data held by the internal node at one end of a first capacitor element and controls on/off of the second switch circuit, wherein the second switch circuit includes the first transistor element and the third transistor element, the control circuit includes the second transistor element, the second switch circuit is configured by a series circuit of the first transistor element and the third transistor element, the control circuit is configured by a series circuit of the second transistor element and the first capacitor element, one end of the first switch circuit is connected to the data signal line, one end of the second switch circuit is connected to the voltage supply line, the other ends of the first and second switch circuits and the first terminal of the second transistor element are connected to the internal node, the control terminal of the first transistor element, the second terminal of the second transistor element, and one end of the first capacitor element are connected to each other, the control terminal of the second transistor element is connected to a first control line, the control terminal of the fourth transistor element is connected to a scanning signal line, the control terminal of the third transistor element is connected to a second control line through a delay circuit, and the other terminal of the first capacitor element is connected to the second control line without passing through the delay circuit.

2. The pixel circuit according to claim 1, wherein the delay circuit includes first and second delay transistor elements each having a first terminal, a second terminal, and a control terminal that controls conduction between the first and second terminals, the first delay transistor element has the first terminal connected to the control terminal of the third transistor element, and the second terminal and the control terminal connected to the second control line, and the second delay transistor element has the first terminal connected to the control terminal of the third transistor element, the second terminal connected to the second control line, and the control terminal connected to the first control line.

3. The pixel circuit according to claim 1, wherein the delay circuit includes first and second delay transistor elements each having a first terminal, a second terminal, and a control terminal that controls conduction between the first and second terminals and a delay capacitor element, the first delay transistor element has the first terminal connected to the control terminal of the third transistor element and the second terminal connected to the second control line, the second delay transistor element has the first terminal and the control terminal connected to the first control line, and the delay capacitor element has one end connected to the second control line and the other end connected to the control terminal of the first delay transistor element and the second terminal of the second delay transistor element.

4. The pixel circuit according to claim 1, further comprising a second capacitor element having one end connected to the internal node and having the other end connected a fourth control line or a fixed voltage line.

5. The pixel circuit according to claim 4, wherein the fourth control line also serves as the voltage supply line.

6. The pixel circuit according to claim 1, wherein the first control line also serves as the voltage supply line.

7. The pixel circuit according to claim 1, wherein the data signal line also serves as the voltage supply line.

8. The pixel circuit according to claim 1, wherein the first switch circuit does not include a switch element except for the fourth transistor element.

9. The pixel circuit according to claim 1, wherein the first switch circuit is configured by a series circuit of the third transistor element in the second switch circuit and the fourth transistor element or a series circuit of a fifth transistor having a control terminal connected to the control terminal of the third transistor element in the second switch circuit and the fourth transistor element.

10. The pixel circuit according to claim 1, wherein at least the second transistor element is an amorphous TFT.

11. A display device comprising a pixel circuit array in which a plurality of pixel circuits according to claim 1 are arranged in a row direction and a column direction, wherein the data signal line is arranged for each of the columns one by one, the scanning signal line is arranged for each of the rows one by one, the pixel circuits arranged in the same column have one ends of the first switch circuits connected to a common data signal line, the pixel circuits arranged in the same row have the control terminals of the fourth transistor elements connected to a common scanning signal line, the pixel circuits arranged in the same row or the same column have the control terminals of the second transistor elements connected to a common first control line, the pixel circuits arranged in the same row or the same column have the control terminals of the third transistor elements connected to a common second control line through the delay circuits, the pixel circuits arranged in the same row or the same column have the other ends of the first capacitor elements connected to the common second control line without passing through the delay circuits, a data signal line drive circuit that independently drives the data signal lines, a control line drive circuit that independently drives the first and second control lines, and a scanning signal line drive circuit that independently drives the scanning signal lines are arranged, and when the first control line also serves as the voltage supply line or when the voltage supply line is an independent wire, the control line drive circuit drives the voltage supply line, and when the data signal line also serves as the voltage supply line, the data signal line drive circuit drives the voltage supply line.

12. The display device according to claim 11, wherein, when the voltage supply line is an independent wire, in the pixel circuits arranged in the same row or the same column, one ends of the second switch circuits are connected to a common voltage supply line.

13. The display device according to claim 11, wherein, in a self-refresh action for compensating for variations in voltage of the internal nodes at the same time by operating the second switch circuits and the control circuits in the plurality of pixel circuits, the scanning signal line drive circuit applies a predetermined voltage to the scanning signal lines connected to all the pixel circuits in the pixel circuit array to turn off the fourth transistor elements, the control line drive circuit applies a predetermined voltage to the first control line so that when a voltage state of binary pixel data held by the internal node is in a first voltage state, a current flowing from one end of the first capacitor element to the internal node is blocked by the second transistor element, and when the voltage state is in a second voltage state, the second transistor element is turned on, and, applies a voltage pulse having a predetermined voltage amplitude to the second control line to give a change in voltage by capacitive coupling through the first capacitor element to one end of the first capacitor element so that when the voltage of the internal node is in the first voltage state, the change in voltage is not suppressed and the first transistor element is turned on, and when the voltage of the internal node is in the second voltage state, the change in voltage is suppressed and the first transistor element is turned off, and the voltage pulse is given to the control terminal of the third transistor element through the delay circuit to turn on the third transistor element, when the voltage supply line also serves as the first control line or an independent signal line, the control line drive circuit supplies the voltage of the pixel data in the first voltage state to all the voltage supply lines connected to the plurality of pixel circuits targeted by the self-refresh action, and when the voltage supply line also serves as the data signal line, the data signal line drive circuit supplies the voltage of the pixel data in the first voltage state to all the voltage supply lines connected to the plurality of pixel circuits targeted by the self-refresh action.

14. The display device according to claim 13, wherein a standby state is set immediately after the self-refresh action is ended, and, in the standby state, the control line drive circuit ends the application of the voltage pulse to the second control line to turn off the third transistor element.

15. The display device according to claim 14, wherein the self-refresh action is repeated through the standby state a period of which is not less than 10 times a period of the self-refresh action.

16. The display device according to claim 14, wherein, in the standby state, the data signal line drive circuit applies a fixed voltage to the data signal line.

17. The display device according to claim 16, wherein, in the standby state, the data signal line drive circuit applies a voltage in the second voltage state to the data signal line.

18. The display device according to claim 14, wherein, when the first switch circuit does not include a switch element except for the fourth transistor element, the plurality of pixel circuits targeted by the self-refresh action are divided into a plurality of sections each having one ore more columns, at least the second control lines are arranged so as to be driven for each of the sections, and the control line drive circuit, with respect to the section that is not targeted by the self-refresh action, does not apply the voltage pulse to the second control line, and sequentially switches the sections targeted by the self-refresh action to separately execute the self-refresh action for each of the sections.

19. The display device according to claim 13, wherein the pixel circuit includes a second capacitor element having one end connected to the internal node and the other end connected to a fourth control line, and the pixel circuits arranged in the same row or the same column have the other terminals of the second capacitor elements connected to a common fourth control line, the control line drive circuit independently drives the fourth control lines, and when the voltage supply line also serves as the fourth control line, the control line drive circuit supplies a voltage of the pixel data in the first voltage state to all the voltage supply lines connected to the plurality of pixel circuits targeted by the self-refresh action.

20. The display device according to claim 11, wherein the pixel circuits are formed on an amorphous silicon substrate.

21. A pixel circuit comprising:

a display element unit including a unit display element;

an internal node that is a part of the display element unit and holds a voltage of pixel data applied to the display element unit;

first to fourth transistor elements, each of the first to fourth transistor elements having a first terminal, a second terminal, and a control terminal that controls conduction between the first and second terminals;

a first switch circuit that transfers the voltage of the pixel data supplied from a data signal line to the internal node through at least the fourth transistor element;

a second switch circuit that transfers a voltage supplied to a predetermined voltage supply line to the internal node without passing through the fourth transistor element; and a control circuit that holds a predetermined voltage depending on the voltage of the pixel data held by the internal node at one end of a first capacitor element and controls on/off of the second switch circuit, wherein the second switch circuit includes the first transistor element and the third transistor element, the control circuit includes the second transistor element, the second switch circuit is configured by a series circuit of the first transistor element and the third transistor element, the control circuit is configured by a series circuit of the second transistor element and the first capacitor element, one end of the first switch circuit is connected to the data signal line, one end of the second switch circuit is connected to the voltage supply line, the other ends of the first and second switch circuits and the first terminal of the second transistor element are connected to the internal node, the control terminal of the first transistor element, the second terminal of the second transistor element, and one end of the first capacitor element are connected to each other, the control terminal of the second transistor element is connected to a first control line, the control terminal of the fourth transistor element is connected to a scanning signal line, the control terminal of the third transistor element is connected to a second control line through a delay circuit, and the other terminal of the first capacitor element is connected to a third control line without passing through the delay circuit.

22. A display device comprising a pixel circuit array in which a plurality of pixel circuits according to claim 21 are arranged in a row direction and a column direction, wherein the data signal line is arranged for each of the columns one by one, the scanning signal line is arranged for each of the rows one by one, the pixel circuits arranged in the same column have one ends of the first switch circuits connected to a common data signal line, the pixel circuits arranged in the same row have the control terminals of the fourth transistor elements connected to a common scanning signal line, the pixel circuits arranged in the same row or the same column have the control terminals of the second transistor elements connected to a common first control line, the pixel circuits arranged in the same row or the same column have the control terminals of the third transistor elements connected to a common second control line through the delay circuits, the pixel circuits arranged in the same row or the same column have the other ends of the first capacitor elements connected to a common third control line without passing through the delay circuits, a data signal line drive circuit that independently drives the data signal lines, a control line drive circuit that independently drives the first, second, and third control lines, and a scanning signal line drive circuit that independently drives the scanning signal lines are arranged, and when the first control line also serves as the voltage supply line or when the voltage supply line is an independent wire, the control line drive circuit drives the voltage supply line, and when the data signal line also serves as the voltage supply line, the data signal line drive circuit drives the voltage supply line.

23. The display device according to claim 22, wherein, in a self-refresh action for compensating for variations in voltage of the internal nodes at the same time by operating the second switch circuits and the control circuits in the plurality of pixel circuits, the scanning signal line drive circuit applies a predetermined voltage to the scanning signal lines connected to all the pixel circuits in the pixel circuit array to turn off the fourth transistor elements, the control line drive circuit applies a predetermined voltage to the first control line so that when a voltage state of binary pixel data held by the internal node is in a first voltage state, a current flowing from one end of the first capacitor element to the internal node is blocked by the second transistor element, and when the voltage state is in a second voltage state, the second transistor element is turned on, and applies a voltage pulse having a predetermined voltage amplitude to the second control line and the third control line to give a change in voltage by capacitive coupling through the first capacitor element to one end of the first capacitor element so that when the voltage of the internal node is in the first voltage state, the change in voltage is not suppressed and the first transistor element is turned on, and when the voltage of the internal node is in the second voltage state, the change in voltage is suppressed and the first transistor element is turned off, and the voltage pulse is given to the control terminal of the third transistor element through the delay circuit to turn on the third transistor element, when the voltage supply line also serves as the first control line or an independent signal line, the control line drive circuit supplies the voltage of the pixel data in the first voltage state to all the voltage supply lines connected to the plurality of pixel circuits targeted by the self-refresh action, and when the voltage supply line also serves as the data signal line, the data signal line drive circuit supplies the voltage of the pixel data in the first voltage state to all the voltage supply lines connected to the plurality of pixel circuits targeted by the self-refresh action.

24. The display device according to claim 23, wherein a standby state is set immediately after the self-refresh action is ended, and, in the standby state, the control line drive circuit ends the application of the voltage pulses to the second control line and the third control line to turn off the third transistor element.

25. The display device according to claim 24, wherein, when the first switch circuit does not include a switch element except for the fourth transistor element, the plurality of pixel circuits targeted by the self-refresh action are divided into a plurality of sections each having one or more columns, at least the second control lines and the third control lines are arranged so as to be driven for each of the sections, and the control line drive circuit, with respect to the section that is not targeted by the self-refresh action, does not apply the voltage pulse to the second control line and the third control line, and sequentially switches the sections targeted by the self-refresh action to separately execute the self-refresh action for each of the sections.

26. A display device comprising a pixel circuit array in which a plurality of pixel circuits are arranged in a row direction and a column direction, wherein the pixel circuit includes:

a display element unit including a unit display element;

an internal node that is a part of the display element unit and holds a voltage of pixel data applied to the display element unit;

first to fourth transistor elements, each of the first to fourth transistor elements having a first terminal, a second terminal, and a control terminal that controls conduction between the first and second terminals, a first switch circuit that transfers the voltage of the pixel data supplied from a data signal line to the internal node through at least the fourth transistor element;

a second switch circuit that transfers a voltage supplied to a predetermined voltage supply line to the internal node without passing through the fourth transistor element; and a control circuit that holds a predetermined voltage depending on the voltage of the pixel data held by the internal node at one end of a first capacitor element and controls on/off of the second switch circuit, the second switch circuit includes the first transistor element and the third transistor element, the control circuit includes the second transistor circuit, the second switch circuit is configured by a series circuit of the first transistor element and the third transistor element, the control circuit is configured by a series circuit of the second transistor element and the first capacitor element, one end of the first switch circuit is connected to the data signal line, one end of the second switch circuit is connected to the voltage supply line, the other ends of the first and second switch circuits and the first terminal of the second transistor element are connected to the internal node, the control terminal of the first transistor element, the second terminal of the second transistor element, and one end of the first capacitor element are connected to each other, the control terminal of the second transistor element is connected to a first control line, the control terminal of the third transistor element is connected to a second control line, the control terminal of the fourth transistor element is connected to a scanning signal line, the other end of the first capacitor element is connected to a third control line, the data signal line is arranged for each of the columns one by one, the scanning signal line is arranged for each of the rows one by one, the pixel circuits arranged in the same column have one ends of the first switch circuit connected to a common data signal line, the pixel circuits arranged in the same row have the control terminals of the fourth transistor elements connected to a common scanning signal line, the pixel circuits arranged in the same row or the same column have the control terminals of the second transistor elements connected to a common first control line, the pixel circuits arranged in the same row or the same column have the control terminals of the third transistor elements connected to a common second control line, the pixel circuits arranged in the same row or the same column have the other ends of the first capacitor elements connected to a common third control line, a data signal line drive circuit that independently drives the data signal lines, a control line drive circuit that independently drives the first to third control lines, and a scanning signal line drive circuit that independently drives the scanning signal lines are arranged, when the first control line also serves as the voltage supply line or when the voltage supply line is an independent wire, the control line drive circuit drives the voltage supply line, and when the data signal line also serves as the voltage supply line, the data signal line drive circuit drives the voltage supply line, and after a predetermined delay time has elapsed after the control line drive circuit causes a variation in potential in the third control line, the control line drive circuit causes a variation in potential having the same polarity in the second control line.

27. The display device according to claim 26, wherein, in a self-refresh action for compensating for variations in voltage of the internal nodes at the same time by operating the second switch circuits and the control circuits in the plurality of pixel circuits, the scanning signal line drive circuit applies a predetermined voltage to the scanning signal lines connected to all the pixel circuits in the pixel circuit array to turn off the fourth transistor elements, the control line drive circuit applies a predetermined voltage to the first control line so that when a voltage state of binary pixel data held by the internal node is in a first voltage state, a current flowing from one end of the first capacitor element to the internal node is blocked by the second transistor element, and when the voltage state is in a second voltage state, the second transistor element is turned on, applies a voltage pulse having a predetermined voltage amplitude to the second control line to give a change in voltage by capacitive coupling through the first capacitor element to one end of the first capacitor element so that when the voltage of the internal node is in the first voltage state, the change in voltage is not suppressed and the first transistor element is turned on, and when the voltage of the internal node is in the second voltage state, the change in voltage is suppressed and the first transistor element is turned off, and, after a predetermined delay time has elapsed after the voltage pulse is applied to the second control line, applies a voltage pulse having a predetelinined voltage amplitude to the third control line to give the voltage pulse to the control terminal of the third transistor element so as to turn on the third transistor element, when the voltage supply line also serves as the first control line or an independent signal line, the control line drive circuit supplies the voltage of the pixel data in the first voltage state to all the voltage supply lines connected to the plurality of pixel circuits targeted by the self-refresh action, and when the voltage supply line also serves as the data signal line, the data signal line drive circuit supplies the voltage of the pixel data in the first voltage state to all the voltage supply lines connected to the plurality of pixel circuits targeted by the self-refresh action.

* * * * *